US006646663B2

(12) United States Patent
Kamoshida et al.

(10) Patent No.: US 6,646,663 B2
(45) Date of Patent: Nov. 11, 2003

(54) IMAGE CARRIER AND WRITING ELECTRODES, METHOD FOR MANUFACTURING THE SAME, AND IMAGE FORMING APPARATUS USING THE SAME

(75) Inventors: Shinichi Kamoshida, Nagano-Ken (JP); Kaneo Yoda, Nagano-Ken (JP); Kenjiro Yoshioka, Nagano-Ken (JP); Mikio Furumizu, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/060,016

(22) Filed: Jan. 31, 2002

(65) Prior Publication Data

US 2002/0146558 A1 Oct. 10, 2002

(30) Foreign Application Priority Data

| | | |
|---|---|---|
| Jan. 31, 2001 | (JP) | 2001-023601 |
| Jan. 31, 2001 | (JP) | 2001-023602 |
| Jan. 31, 2001 | (JP) | 2001-024048 |
| Jan. 31, 2001 | (JP) | 2001-024050 |
| Jan. 31, 2001 | (JP) | 2001-024051 |

(51) Int. Cl.[7] ..... B41J 2/41
(52) U.S. Cl. ..... 347/112; 347/141
(58) Field of Search ..... 347/112, 141, 347/142, 143, 144, 145, 146, 147, 148, 149, 150

(56) References Cited

U.S. PATENT DOCUMENTS 5,812,170 A * 9/1998 Kuehnle et al. ..... 347/147
6,362,845 B1 * 3/2002 Genovese ..... 347/141

FOREIGN PATENT DOCUMENTS

| | | |
|---|---|---|
| JP | 59-33969 | 2/1984 |
| JP | 63-45104 | 2/1988 |
| JP | 6-3921 | 1/1994 |
| JP | 6-8510 | 1/1994 |

OTHER PUBLICATIONS

Japanese abstract, 59–033969, Feb. 24, 1984.
Japanese abstract, 63–045104, Feb. 26, 1988.
Japanese abstract, 06–003921, Jan. 14, 1994.
Japanese abstract, 06–008510, Jan. 18, 1994.

* cited by examiner

*Primary Examiner*—Joan Pendegrass
(74) *Attorney, Agent, or Firm*—Sughrue Mion, PLLC

(57) ABSTRACT

The object of the invention is to provide an image carrier which is capable of securely preventing the leakage of charge in lateral direction so as to stably conduct the application or removal of charge and which can be easily manufactured. An image carrier comprises a dielectric layer, wherein charge is transferred between the dielectric layer and a charge-transfer controlling means so as to apply charge to or remove charge from the dielectric layer, wherein the dielectric layer is formed in such a structure that a large number of conductive portions are formed to be separately dispersed in its outer surface. Charge is transferred between the conductive portions and the charge-transfer controlling means so as to apply charge to or remove charge from the conductive portions.

20 Claims, 28 Drawing Sheets

2a Substrate

Dielectric Layer 2b
2a

2b1
2b1
2b1
2b
2a

2c1
2b1
2b
2a

2c1
2c1
2c
2b
2a
Local Conductive Portion 2b
2c1
2c1
2c1
Completed Article (Top View)

Charging Member
A2
Contact Area of Toner
A3
A1
2c1
Charge Injection Portion

Example (1), Thickness of Charge Injection Layer : 1μm

Example (2), Thickness of Charge Injection Layer : 10μm

IMAGE CARRIER AND WRITING ELECTRODES, METHOD FOR MANUFACTURING THE SAME, AND IMAGE FORMING APPARATUS USING THE SAME

BACKGROUND OF THE INVENTION

The present invention belongs to a technical field of an image forming apparatus which writes an electrostatic latent image onto an image carrier by writing electrodes of a writing device thereby to form an image and, particularly, to a technical field of an image forming apparatus which writes an electrostatic latent image onto an image carrier by charge injection between writing electrodes and the image carrier.

An image forming apparatus of which an image carrier is charged by injecting charge directly to the image carrier on which a latent image will be formed has been proposed by Japanese Unexamined Patent Publication No. H6-3921. The image forming apparatus disclosed in this publication has a charge injection layer on a photo-conductive layer of a photosensitive drum. A contact charging member is in contact with the charge injection layer to inject charge to the charge injection layer, thereby uniformly charging the photosensitive drum. The charge injection layer is formed by a binder resin composed of a phosphazene resin and a conductive filler of $SnO_2$ dispersed in the binder resin so as to have a predetermined thickness.

As another conventional image forming apparatus, an image forming apparatus which employs electrodes as a writing device and writes an electrostatic latent image onto an image carrier by the electrodes has been proposed by Japanese Unexamined Patent Publication No. S59-33969. The image forming apparatus disclosed in this publication comprises a large number of pin electrodes, and a recording drum which is a metallic drum having a dielectric layer formed on the surface thereof. All pin electrodes are driven to make discharge phenomenon between the pin electrodes and the recording drum which are spaced apart from the other, thereby forming a solid black latent image for every line onto the surface of the recording drum.

As still another conventional image forming apparatus, an image forming apparatus which writes an electrostatic latent image onto a surface of a recording medium in the ion flow system as a writing device has been proposed in Japanese Unexamined Patent Publication No. H6-8510. The image forming apparatus disclosed in this publication comprises a corona charger and an aperture electrode which controls a flow of corona ions generated from wires of the corona charger. In the apparatus, an electrostatic latent image is formed on the surface of the recording medium by the controlled ion flow.

As for the image carrier disclosed in the aforementioned Japanese Unexamined Patent Publication H6-3921, the charge injection layer is formed in a wide range of the photo-conductive layer of the photosensitive drum and the conductive filler of $SnO_2$ is dispersed in the binder resin. When the dispersed amount of $SnO_2$ is too large, the surface resistivity of the charge injection layer should be too low, leading to drifts of latent image charge. On the other hand, when the dispersed amount of $SnO_2$ is too small, the surface of the charge injection layer has poor exposure of $SnO_2$, leading to poor injection of charge and thereby partially producing insufficient charged portions. Therefore, there are disadvantages that the lateral leakage of latent image charge can not be securely prevented, that the setting of dispersed amount of $SnO_2$ is troublesome, that the stable charge is hardly achieved, and that the manufacturing of this image carrier is difficult.

On the other hand, in either of the image forming apparatuses disclosed in Japanese Unexamined Patent Publication No. S59-33969 and Japanese Unexamined Patent Publication No. H6-8510, writing is conducted by using discharge phenomenon so that the voltage to be applied should be very high. Since ion functions the role of the carrier, ionization due to the discharge phenomenon depends on the environmental conditions such as temperature and humidity. Variation in ionization may distort the positions of a latent image to be written. Therefore, there is a disadvantage that it is hardly stably charged.

SUMMARY OF THE INVENTION

The present invention was made in the light of the above described problems and the object of the present invention is to provide an image carrier which is capable of securely preventing the leakage of charge in lateral direction so as to stably conduct the application or removal of charge and which can be easily manufactured.

To solve the aforementioned problems, an image carrier of the present invention comprises a dielectric layer, wherein charge is transferred between said dielectric layer and a charge-transfer controlling means so as to apply charge to or remove charge from said dielectric layer, and is characterized in that said dielectric layer has a low-resistance layer formed on the outer surface thereof, said low-resistance layer comprises a large number of conductive portions, charge is transferred between said conductive portions and said charge-transfer controlling means so as to apply charge to or remove charge from said conductive portions, and said conductive portions are arranged to be dispersed separately from each other.

The image carrier of the present invention is further characterized in that said conductive portions are a large number of dots which are dispersedly arranged, that said large number of conductive portions are at least partially exposed on the surface of said low-resistance layer, that the electric resistance of said low-resistance layer is anisotropic in such a manner as to satisfy "resistance in a direction perpendicular to the plane direction of said low-resistance layer (i.e. in vertical direction)<resistance in the plane direction of said low-resistance layer (i.e. in lateral direction)", and that the thickness of said low-resistance layer is set to be 1 $\mu$m or less.

According to the image carrier of the present invention, since the large number of conductive portions which are separately and dispersedly formed in the outer surface of the dielectric layer and the application or removal of charge can be conducted dominantly by charge injection between the conductive portions and the charge-transfer controlling means, the voltage to be applied can be significantly reduced as compared with the conventional device which applies or removes charge by discharge phenomenon.

Since a large number of the conductive portions are separately dispersed, charge applied to the conductive portions can be prevented from leaking in the lateral direction and charge on charged conductive portions can be prevented from leaking i.e. from moving to another conductive portion. Therefore, stable application or removal of charge relative to the image carrier can be conducted by charge injection.

Particularly, since the conductive portions are a large number of dots separately dispersed, the stable application or removal of charge can be conducted with higher precision. Further, the large number of conductive portions are partially exposed, thereby further reliably conducting the stable application or removal of charge relative to the image carrier.

Since the electric resistance of the low-resistance layer of the image carrier is set such that the resistance in the vertical direction is smaller than the resistance in the lateral direction, the leakage of charge in the lateral direction can be further securely prevented in the low-resistance layer so that charge can be effectively transferred between the charge-transfer controlling means and the low-resistance layer, thereby achieving the reliable application or removal of charge relative to the image carrier.

Since the thickness of the low-resistance layer is set to be 1 $\mu$m or less, the electric resistance can be easily set such that the difference between the resistance in the lateral direction and the resistance in the vertical direction is enlarged by just forming the low-resistance layer to have a small thickness. Therefore, the potential contrast of the electrostatic latent image can be larger, thereby further improving the precision in writing latent images.

On the other hand, the method of manufacturing the image carrier of the present invention comprises previously forming a large number of concavities in the outer surface of the dielectric layer so that the concavities are dispersed separately from each other, coating conductive material onto the surface of the dielectric layer formed with the concavities, and then grinding the coated conductive material. According to this method, the large number of conductive portions separately dispersed can be easily formed. Therefore, the image carrier can be easily manufactured.

In another method of manufacturing the image carrier of the present invention, a liquid, prepared by dispensing conductive particles dispersed into the predetermined liquid, is displayed onto predetermined positions of the outer surface of an image carrier made of an insulating material which is soluble relative to the predetermined liquid, thereby forming the conductive portions. Also according to this method, the large number of conductive portions separately dispersed can be easily formed. Therefore, the image carrier can be easily manufactured.

BRIEF DESCRIPTION OF THE DRAWINGS

FIGS. 20(A), 20(B) show a comparative example relative to the present invention, wherein FIG. 20(A) is a schematic illustration showing the function of a case without charge injection layer in FIG. 19(A) and FIG. 20(B) is a graph showing the relation between the voltage applied to electrodes and the surface potential of a dielectric layer;

FIGS. 28(A) and 28(B) show another example of the image forming apparatus of the present invention, wherein FIG. 28(A) is a schematic illustration showing the function of a charge injection layer through application or removal of charge of the writing electrodes of the writing device, FIG. (B) is a graph showing the relation between the voltage applied to electrodes and the surface potential of the charge injection layer;

DESCRIPTION OF THE PREFERRED EMBODIMENTS

The embodiments of the present invention will be described hereinafter with reference to the drawings.

Figure 1:
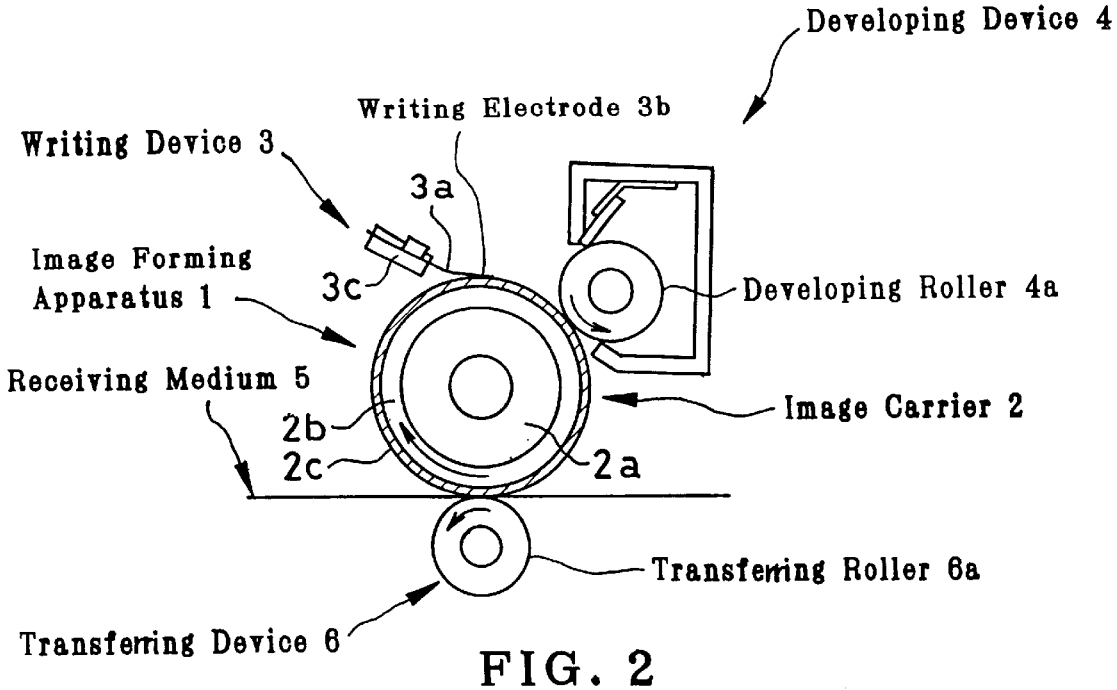
FIG. 1 is an illustration schematically showing the basic structure of an image forming apparatus employing an embodiment of the image carrier according to the present invention.
Figure 2:
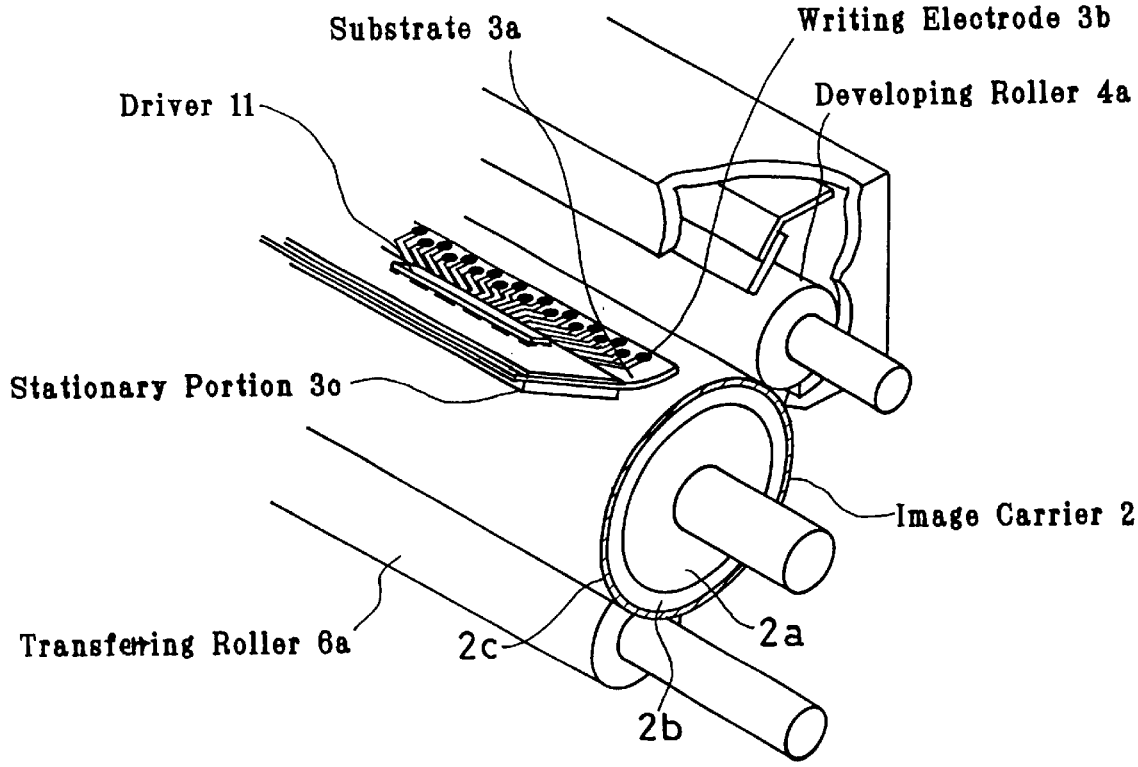
FIG. 2 is a perspective view partially illustrating the basic structure of the image forming apparatus shown in FIG. 1.

FIG. 1 is an illustration schematically showing the basic structure of an image forming apparatus employing an embodiment of the image carrier according to the present invention, and FIG. 2 is a perspective view partially illustrating the basic structure of the image forming apparatus shown in FIG. 1.

As shown in FIG. 1, an image forming apparatus 1 of this embodiment comprises, at least, an image carrier 2 on which an electrostatic latent image and a developing powder image are formed, a writing device 3 which is arranged in contact with the image carrier 2 to write the electrostatic latent image onto the image carrier 2, a developing device 4 which develops the electrostatic latent image on the image carrier 2 with developing powder carried by a developing roller 4*a*, and a transferring device 6 which transfers the developing power image on the image carrier 2 developed by the developing device to a receiving medium 5 such as a paper by a transferring roller 6*a*.

As shown in FIG. 2, the image carrier 2 is formed in a drum shape having a multi-layer structure comprising a conductive substrate 2*a* which is mage of a conductive material such as aluminium, positioned near the axis of the image carrier 2, and grounded, a dielectric layer 2*b* formed on the outer surface of the conductive substrate 2*a*, and a charge injection layer 2*c* having a large number of conductive portions formed on the outer surface of the dielectric layer 2*b*. It should be noted that the image carrier 2 may be formed in a belt shape.

Figure 3A:
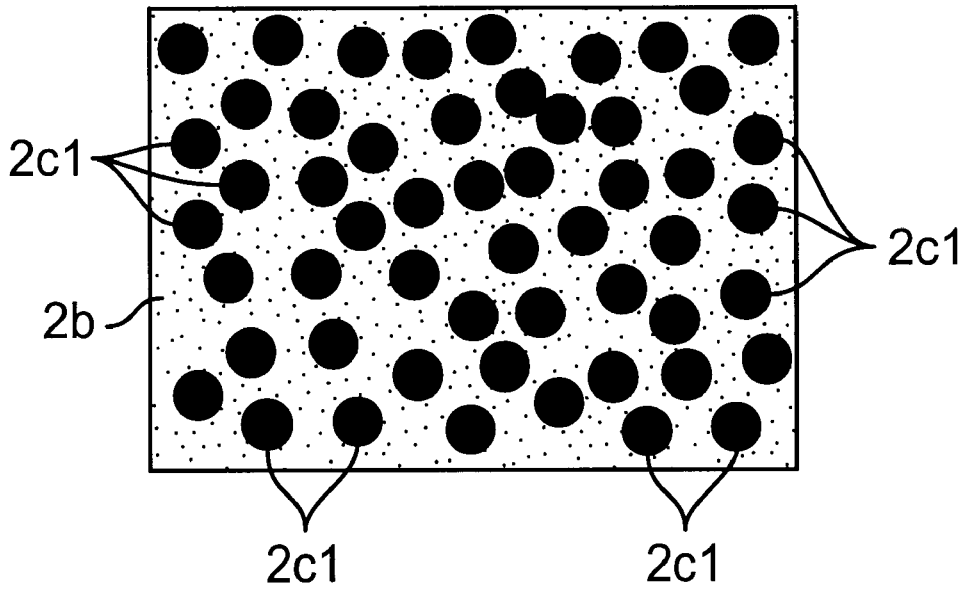
FIGS. 3(*a*), 3(*b*) show an embodiment of the image carrier according to the present invention, wherein FIG. 3(*a*) is a plan view thereof and FIG. 3(*b*) is a sectional view taken along a transverse direction of FIG. 3(*a*)
Figure 3B:
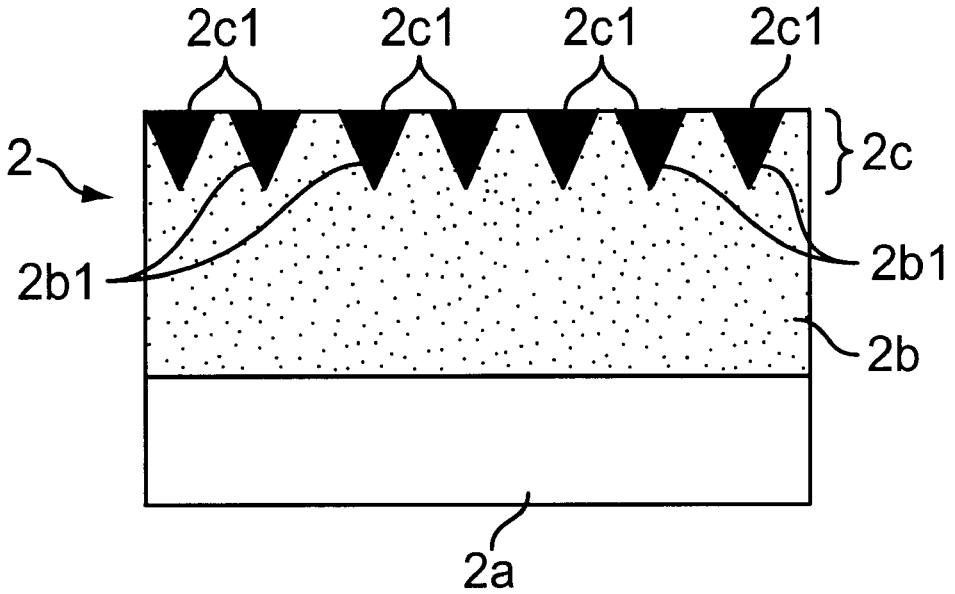

As shown in FIGS. 3(*a*) and 3(*b*), the large number of conductive portions $2c_1$, are formed just like islands (hereinafter, sometimes called as "islands-in-sea structure") on the outer surface of the dielectric layer 2*b* in such a manner that these conductive portions $2c_1$ are electrically separated from, independent of each other, and dispersed from each other. That is, a number of indented concavities $2b_1$ are formed to be dispersed separately from each other in the outer surface of the dielectric layer 2*b* and a conductive material $2c_1$, (shown in FIGS. 4(*a*)–4(*g*) as will be described later) such as a conductive resin or a conductive filler is filled in the indented concavities $2b_1$, thereby forming the conductive portions $2c_1$ just like islands in the sea, on the outer surface of the dielectric layer 2*b*, the conductive portions $2c_1$ being composed of local conductive portions dispersed separately from each other.

Parts of the large number of conductive portions $2c_1$ may be exposed on the surface of the dielectric layer 2*b* and the other parts may be embedded in the surface of the dielectric layer 2*b*. That is, the conductive portions $2c_1$ are provided in such a manner that at least parts thereof are exposed on the surface. The exposed parts of the conductive portions $2c_1$ ensure the stable application or removal of charge relative to the image carrier.

The dielectric layer 2*b* exhibits a role as the inside of a condenser and has a function of placing charge to the image carrier 2 in a spot manner. Therefore, the dielectric layer 2*b* is preferably set to have electric resistance of $10^{16}\Omega$ or less. As examples of the material for the dielectric layer 2*b*, there are polyester resin, polycarbonate resin, polyethylene resin, fluoride resin, cellulose, vinyl chloride resin, polyurethane resin, acrylic resin, epoxy resin, silicone resin, alkyd resin, vinyl chloride-vinyl acetate copolymer resin, polyamide resin (nylon), and the like.

The material for the conductive portions $2c_1$ is a material of which resistance is in a range lower than the resistance of the dielectric layer 2*b* which is about $10^{10}\Omega$ in maximum. In this case, too large electric resistance of the conductive portions $2c_1$ leads to defect in writing of an latent image due to some delay of writing. Therefore, the electric resistance of the conductive portions $2c_1$ is preferably lower as the process speed is increased.

As the material used for the conductive portions $2c_1$, conductive resin or conductive filler can be employed. As the material used as the conductive resin and the conductive filler, a conductive high-molecular powder such as a high-molecular complex made of polyacetylene doped with iodine, a high-molecular complex made of polythiopene doped with iodine, and a high-molecular complex made of polypyrrole doped with iodine, and a combination thereof may be employed. In this case, the content of conductive particles/conductive filler is from 10 to 100% by weight for regulating the resistance.

The charge injection between the conductive portions $2c_1$ and the writing electrodes 3*b* is conducted by the contact of the writing electrodes (corresponding to the charge-transfer controlling means of the present invention) 3*b* with the plurality of conductive portions $2c_1$. It should be understood that there are a case where charge is injected (transferred) from the writing electrodes 3*b* to the conductive portions $2c_1$ and a case where charge is injected (transferred) from the conductive portions $2c_1$ to the writing electrodes 3*b* and that the former case means that charge is applied to the image carrier and the latter case means that charge is removed from the image carrier 2.

The electric resistance of each conductive portion $2c_1$ is set to satisfy "electric resistance in vertical direction (i.e. the depth direction perpendicular to the plane direction of the conductive portion $2c_1$)<electric resistance in lateral direction (i.e. the plane direction of the conductive portion $2c_1$)". That is, the conductive portions are anisotropic, thereby making the lateral movement of charge difficult, i.e. making the leakage difficult during charge injection between the writing electrodes 3*b* and the conductive portion $2c_1$. Therefore, charge can be effectively transferred in the vertical direction. This ensures the application of charge and the removal of charge relative to the image carrier 2.

In this case, it is preferable that the difference between the electro resistance in lateral direction and the electro resistance in vertical direction (the ratio of lateral resistance/vertical resistance) is larger. Further, a relation "the ratio of lateral resistance/vertical resistance>$10^5$" is preferable.

Now, description will be made as regard to the method for manufacturing the image carrier 2 having the aforementioned structure.

Figures 4A, 4B, 4C, 4D, 4E, 4F, 4G:
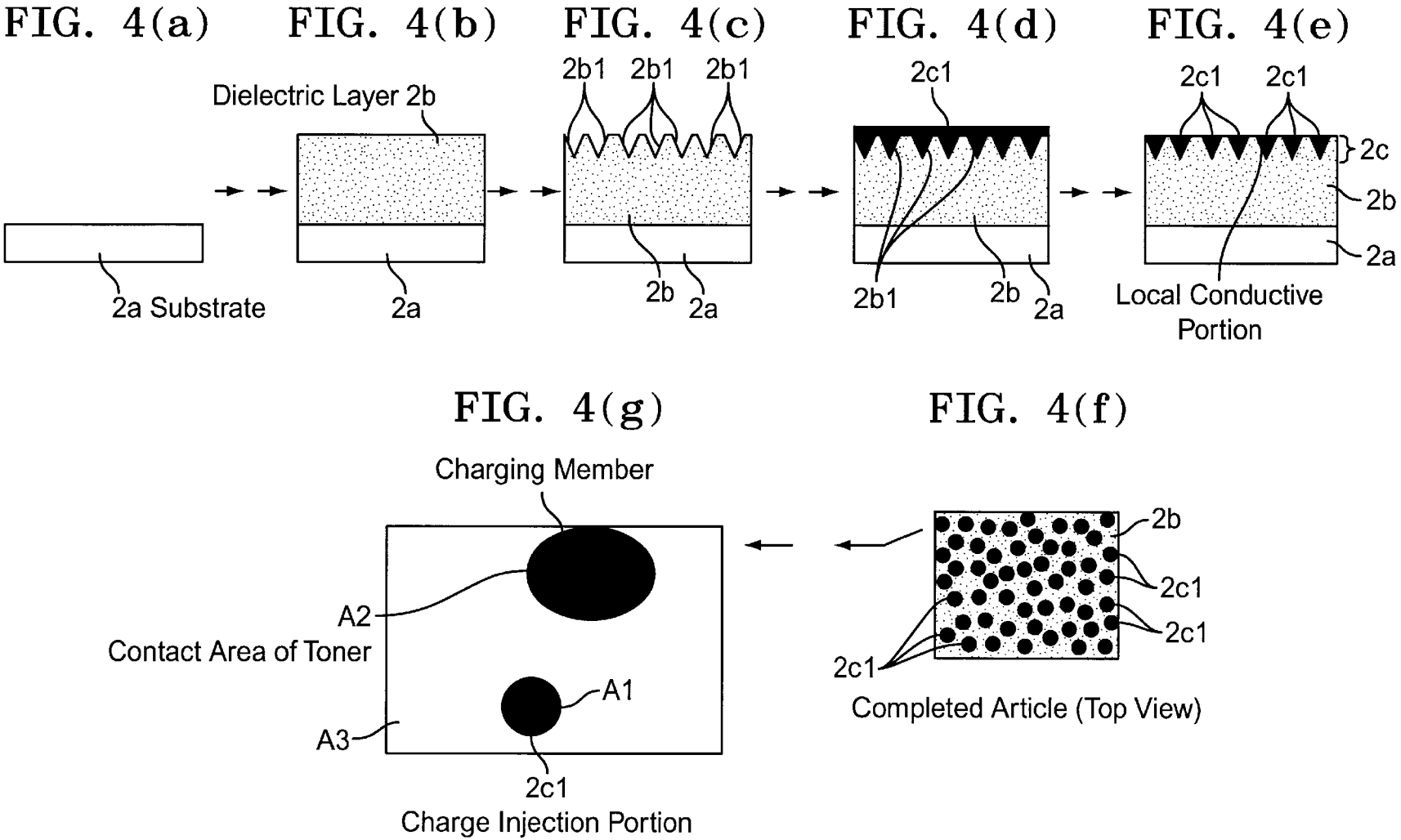
FIGS. 4(*a*)–4(*g*) are illustrations for explaining an example of methods for manufacturing the image carrier according to the present invention.

FIGS. 4(*a*)–4(*g*) are illustrations for explaining an example of methods for manufacturing the image carrier according to the present invention.

First, as shown in FIG. 4(*a*), a conductive substrate 2*a* of a conductive material such as Al is prepared. As shown in FIG. 4(*b*), a dielectric layer 2*b* is formed onto the conductive substrate 2*a* by coating. Then, as shown in FIG. 4(*c*), a large number of concavities $2b_1$, which are suitably rough and dispersed separately from each other, are formed in the outer surface of the dielectric layer 2*b* by surface treatment such as blasting the surface of the dielectric layer 2*b*. During this process, the concavities $2b_1$, may be aligned or formed at random, just in such a manner that they are separately dispersed.

Then, as shown in FIG. 4(*d*), a conductive material $2c_1$ such as a conductive resin or a conductive filter is coated on the surface of the dielectric layer 2*b* with the concavities $2b_1$. After that, as shown in FIG. 4(*e*), at least a surface of the coated conductive material $2c_1$ is ground such that the conductive material $2c_1$ remains in the concavities $2b_1$, thereby forming a large number of local conductive portions. In this manner, the latent carrier 2 is formed which has the dielectric layer 2*b* of a predetermined thickness (for example, 10–30 $\mu$m) formed on the conductive substrate 2*a*, and the large number of local conductive portions i.e. the conductive portions $2c_1$ separately and dispersedly formed in the surface of the dielectric layer 2*b* as shown in FIG. 4(*f*).

In this case, as shown in FIG. 4(*g*), the surface area $A_1$ of each conductive portion $2c_1$ is set to be smaller than the contact area $A_2$ of each writing electrode 3*b* when the writing electrode 3*b* is in contact with the surface of the dielectric layer 2*b* and also smaller than the contact area $A_3$ of toner supplied from the developing device 4 to the surface of the dielectric layer 2*b*.

Figures 5A, 5B, 5C:
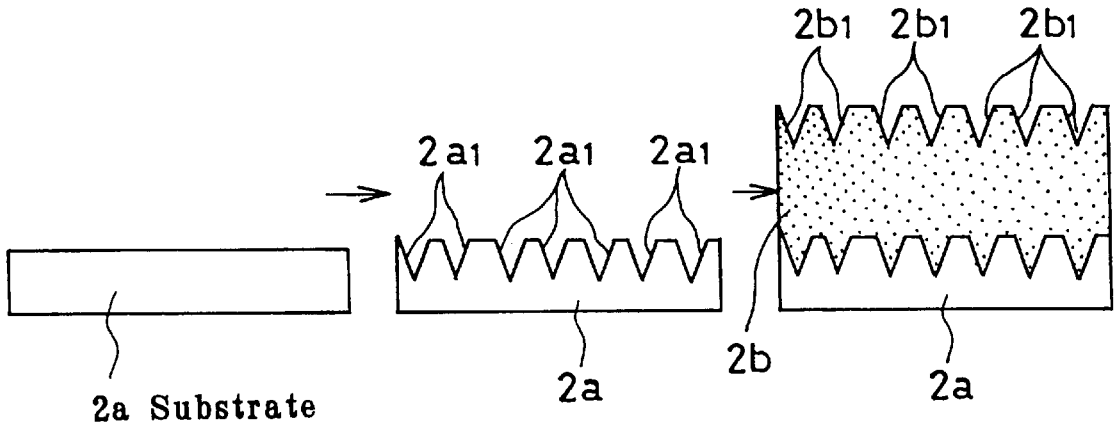
FIGS. 5(*a*)–5(*c*) are illustrations for explaining another example of methods for manufacturing the image carrier according to the present invention.

FIGS. 5(*a*)–5(*c*) are illustrations for explaining another example of methods for manufacturing the image carrier according to the present invention.

First, as shown in FIG. 5(*a*), a conductive substrate 2*a* of a conductive material such as Al is prepared. As shown in FIG. 5(*b*), a large number of concavities $2a_1$, which are suitably rough and dispersed separately from each other, are formed in the outer surface of the conductive substrate 2*a* by surface treatment such as blasting the surface of the conductive substrate 2*a*. Then, as shown in FIG. 5(*c*), a dielectric layer 2*b* is formed on the conductive substrate 2*a* by coating. At this point, stable surface roughness is formed in the surface of the dielectric layer 2*b* corresponding to the concavities $2a_1$ of the conductive substrate 2*a* so that the dielectric layer 2*b* is formed with a large number of concavities $2b_1$ which are dispersed separately from each other. After that, the same or similar processes as those shown in FIGS. 4(*d*)–4(*f*) are conducted so as to form a large number of local conductive portions, i.e. conductive portions $2c_1$, which are separately dispersed, in the respective concavities $2b_1$.

In this case, similarly to the above case, the surface area $A_1$ of each conductive portion 2*c* is set to be smaller than the contact area $A_2$ of each writing electrode 3*b* when the writing electrode 3*b* is in contact with the surface of the dielectric layer 2*b* and also smaller than the contact area $A_3$ of toner supplied from the developing device 4 to the surface of the dielectric layer 2*b*.

In the examples shown in FIGS. 4(*d*)–4(*f*) and FIGS. 5(*a*)–5(*c*), though the conductive material $2c_1$ such as conductive resin and conductive filler is coated on the surface of the dielectric layer 2*b*, the present invention is not limited thereto so that other materials may be employed. For example, as the conductive material $2c_1$, a paint (coat) composed of a binder resin and conductive particles or conductive filler of a suitable amount to be dispersed in the binder resin may be used, so this paint is coated on the surface of the dielectric layer 2*b* formed with the concavities $2a_1$, and then the resultant coating layer is ground, thereby forming the latent carrier 2 is formed which has the dielectric layer 2*b* formed on the conductive substrate 2*a*, and the local conductive portions i.e. the conductive portions $2c_1$ separately and dispersedly formed in the surface of the dielectric layer 2*b*.

In this case, as examples of the material used as the binder resin, there are polyester resin, polycarbonate resin, polyethylene resin, fluoride resin, cellulose, vinyl chloride resin, polyurethane resin, acrylic resin, epoxy resin, silicone resin, alkyd resin, vinyl chloride-vinyl acetate copolymer resin, polyamide resin (nylon), and the like. As examples of the material used as the conductive particles/conductive filler, there are metallic powder of Cu, Al, or Ni, metallic oxide powder of ZnO, tin oxide, antimony oxide, or $TiO_2$ (treated to have conductivity), conductive high-molecular powder such as a high-molecular complex made of polyacetylene doped with iodine, a high-molecular complex made of polythiopene doped with iodine, and a high-molecular complex made of polypyrrole doped with iodine, and a combination thereof. In this case, the content of conductive particles/conductive filler is from 10 to 100% by weight for regulating the resistance.

In case of the conductive portions $2c_1$ with uniform dispersal obtained by a binder dispersant method as shown in Table 1, smaller thickness of the conductive portions $2c_1$ facilitates the achievement of anisotropy in the resistance.

TABLE 1

Comparison of vertical and lateral resistances according to the thickness of conductive layers as test pieces of volume resistivity = $1.0 \times 10^{10}$ ($\Omega \cdot$ cm)

| Thickness ($\mu$m) | Vertical Electric Resistance ($\Omega$) | Lateral Electric Resistance ($\Omega$) | Ratio of Resistance (Lateral/Vertical) |
|---|---|---|---|
| 1 | $1.0 \times 10^6$ | $1.0 \times 10^{14}$ | $10^8$ |
| 10 | $1.0 \times 10^7$ | $1.0 \times 10^{13}$ | $10^6$ |
| 100 | $1.0 \times 10^8$ | $1.0 \times 10^{12}$ | $10^4$ |

Values shown in Table 1 are results of the measurements of resistances. A polyamide resin {FR-104 (trade code) available from Namariichi Chemical Industrial Co., Ltd.} as the binder resin, and a conductive titanium dioxide as the conductive filler {EC-300 (trade code) available from Titan Kogyo K.K.} were mixed in the ratio by weight of 1:1.3, dispersed by ultrasonic vibration technique with ethanol solvent, and applied on a substrate of Al to form layers of 1–100 $\mu$m in thickness. The measurements were made for the resultant layers by using a "HIRESTA" manufactured by Mitsubishi Petrochemical Co., Ltd.

As for each layer, the volume resistivity and the surface resistivity were measured by the HIRESTA. The vertical resistance and the lateral resistance can be calculated from the measured values of the volume resistivity and the surface resistivity, the thickness of the layer, and the surface area of the electrodes of the HIRESTA. The results are generally as shown in Table 1. It can be found also from experiments as will be described later that the conductive portions 2*c* of smaller thickness are advantageous in improving the precision for writing latent images. Even with thickness more than 1 $\mu$m, the conductive portions 2*c* can apply or remove charge as desired, but the thickness is preferably set to be smaller than 1 $\mu$m.

Figure 6A:
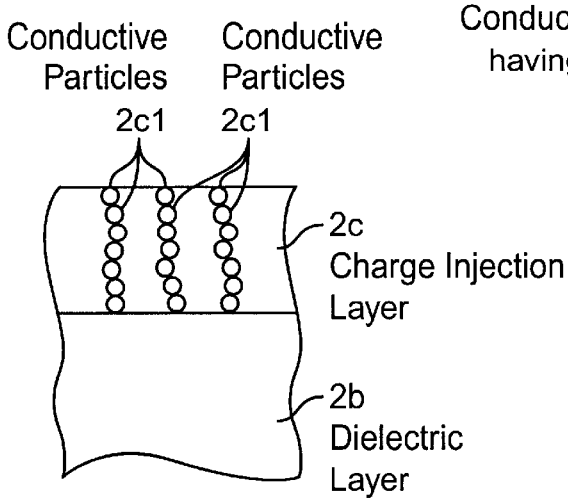
FIGS. 6(*a*), 6(*b*) show partially the image carrier, wherein FIG. 6(*a*) is an illustration for explaining an example of methods for setting the resistance in the vertical direction to be lower than the resistance in the lateral direction, and FIG. 6(*b*) is an illustration for explaining another example of methods for setting the resistance in the vertical direction to be lower than the resistance in the lateral direction.
Figure 6B:
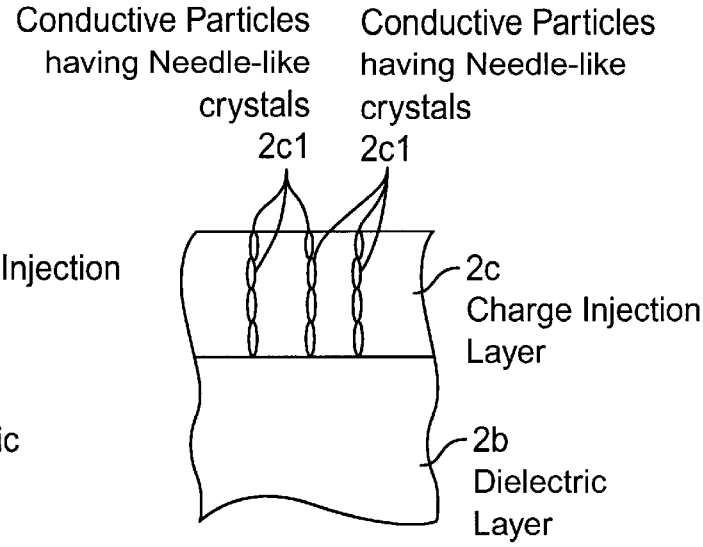

To set the electric resistivity of the charge injection layer 2*c* to satisfy "electric resistance in vertical direction<electric resistance in lateral direction", the charge injection layer 2*c* is formed in such a manner that conductive particles are as continuously aligned in the vertical direction from the surface thereof to the dielectric layer 2*b* as possible as shown in FIG. 6(*a*). Even when the conductive material has conductive particles having needle-like crystals like titanium dioxide, the charge injection layer 2*c* is formed in such a manner that the particles are as continuously aligned in the vertical direction as possible, similarly to the above case, as shown in FIG. 6(*b*). A plurality of lines of conductive particles which are aligned vertically as described above are separately dispersed, that is, are arranged in a matrix structure (described later).

Figure 7A:
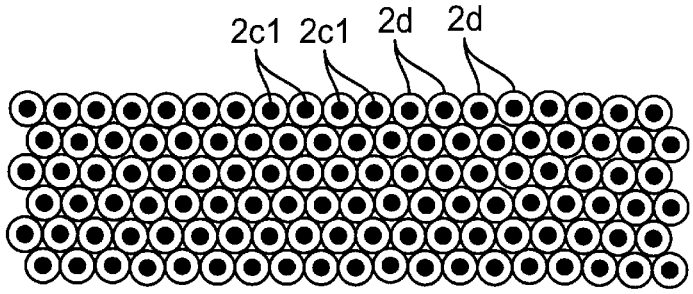
FIGS. 7(*a*), 7(*b*) show a variation of the image carrier in the image forming apparatus of the present invention, wherein FIG. 7(*a*) is a plan view and FIG. 7(*b*) is a sectional view taken along a transverse direction of FIG. 7(*a*)
Figure 7B:
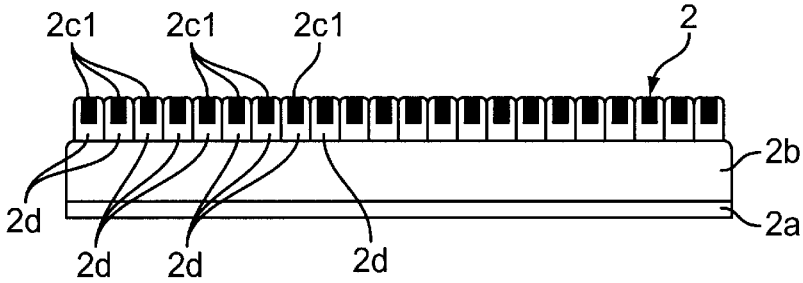

As shown in FIGS. 7(*a*) and 7(*b*), the conductive portions $2c_1$ may be formed by spraying a liquid, prepared by dispersing conductive particles in the alkali liquid, onto an insulating binder layer 2*d* (a part of the dielectric layer 2*b*), as the outermost layer of the image carrier which is soluble relative to alkali, at equal intervals defined by the ink jet printing method. Besides the alkaline liquid and the insulating binder layer which is soluble relative to alkali, it should be noted that a liquid of another kind and a dielectric layer 2*b* made of an insulating material which is soluble relative to the liquid may be employed.

In the aforementioned islands-in-sea structure, a large number of conductive portions $2c_1$ which are separately dispersed can be formed in the outer surface of the dielectric layer 2*b* in another method besides the aforementioned methods.

Charge injection between the writing electrodes 3*b* of the writing device 3 and the conductive portions $2c_1$ can be conducted dominantly by contacts of the writing electrodes 3*b* of the writing device 3 with the conductive portions $2c_1$. Though the description will be made on the assumption that the conductive substrate 2*a* of the image carrier 2 is grounded, this assumption is just for facilitation of explanation. The present invention is not limited to the condition that the conductive substrate 2*a* of the image carrier 2 is grounded, a voltage of lower absolute value than the absolute value of the predetermined voltage $V_0$ to be applied for writing may be applied to the conductive substrate 2*a* as described later.

As shown in FIG. 2, the electric writing device 3 comprises a flexible substrate 3*a*, having high insulation property and being relatively soft and elastic, such as a FPC (Flexible Print Circuit) or a PET (polyethylene terephthalate: hereinafter, referred to as "PET") film, a plurality of writing electrodes 3*b* which are supported by the substrate 3*a* and which are pressed lightly against the image carrier 2 by weak elastic restoring force created by deflection of the substrate 3*a* so that the writing electrodes 3*b* write electrostatic latent image, drivers 11 which are supported by the substrate 3*a* to control the operation of the writing electrodes 3*b*, and a stationary portion 3*c* of which an end opposite to the writing electrodes 3*b* of the substrate 3*a* is fixed to the body (not shown) of the image forming apparatus.

The substrate 3*a* is formed in a rectangular shape having substantially the same axial length as the axial length of the conductive portions $2c_1$ of the image carrier 2. The substrate 3*a* is arranged to extend from the left side in FIG. 1 in the same direction as the rotational direction (the clockwise direction shown by arrow) of the image carrier 2. To the contrary, the substrate 3*a* may be arranged to extend from the right side in FIG. 1 in the opposite direction of the rotational direction of the image carrier 2.

The requirement for material of the writing electrodes 3*b* is conductive and having electric resistance of $10^{10}\Omega$ or less. Too large electric resistance leads to defect in writing of an latent image due to some delay of writing, similarly to the aforementioned conductive portions 2*c*. Therefore, the electric resistance of the writing electrodes 3*b* is preferably lower as the process speed is increased. In the experiments as will be described later, writing electrodes made of Al and writing electrodes made of Al of which surface is coated with fluororesin to have electric resistance of $10^6\Omega$ were both used. It was found from the results of the experiments that the writing electrodes of both type can write a latent image. Accordingly, it is preferable that the electric resistance of the writing electrodes is $10^6\Omega$ or less.

Figure 8A:
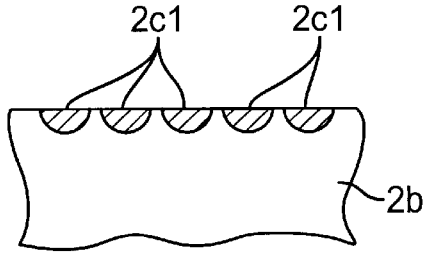
FIGS. 8(*a*), 8(*b*) show further another embodiment of the present invention, wherein FIG. 8(*a*) is a sectional view partially showing the section along the axial direction of the image carrier and FIG. 8(*b*) is an illustration partially showing the outer surface of the image carrier.
Figure 8B:
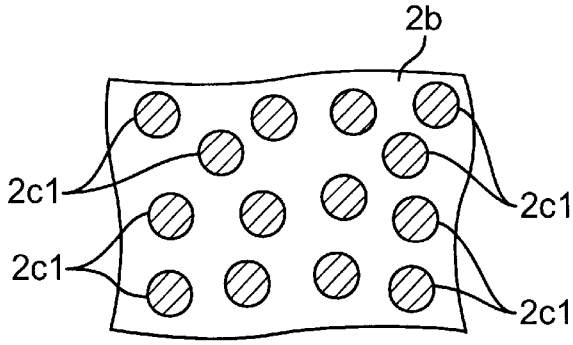
Figure 9A:
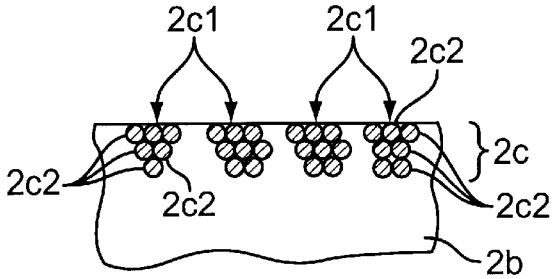
FIGS. 9(*a*), 9(*b*) show still further embodiment of the present invention, wherein FIG. 9(*a*) is a sectional view partially showing the section along the axial direction of the image carrier and FIG. 9(*b*) is an illustration partially showing the outer surface of the image carrier.
Figure 9B:
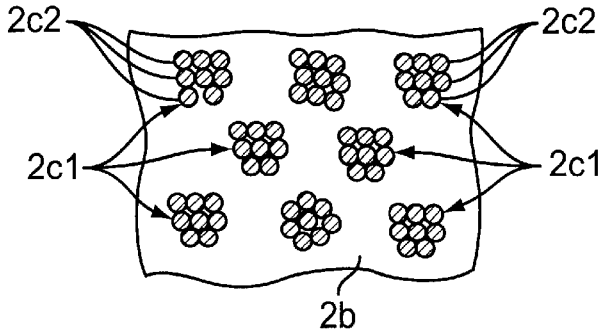

FIGS. 8(*a*), 8(*b*) and FIGS. 9(*a*), 9(*b*) show different embodiments of the present invention, respectively, wherein FIGS. 8(*a*), 9(*a*) are sectional views partially showing the section along the axial direction of the image carrier and FIGS. 8(*b*), 9(*b*) are views partially showing the outer surface of the image carrier.

In the embodiment shown in FIGS. 8(*a*), 8(*b*), a large number of conductive portions $2c_1$ are formed and arranged like dots separately dispersed. In the embodiment shown in FIGS. 9(*a*) and 9(*b*), a large number of conductive portions $2c_1$ which are formed and arranged like dots separately dispersed and each conductive portion $2c_1$ is composed of a predetermined number of gathered conductive particles $2c_2$.

Such an arrangement that a large number of conductive portions $2c_1$ are formed and arranged like dots which are separately dispersed ensures stable and more precise application or removal of charge relative to the image carrier 2.

In either of the embodiments shown in FIGS. 8(*a*), 8(*b*) and FIGS. 9(*a*), 9(*b*), similarly to the aforementioned embodiment, it is preferable that the large number of conductive portions $2c_1$ are formed to be at least partially exposed to the surface.

Figure 10:
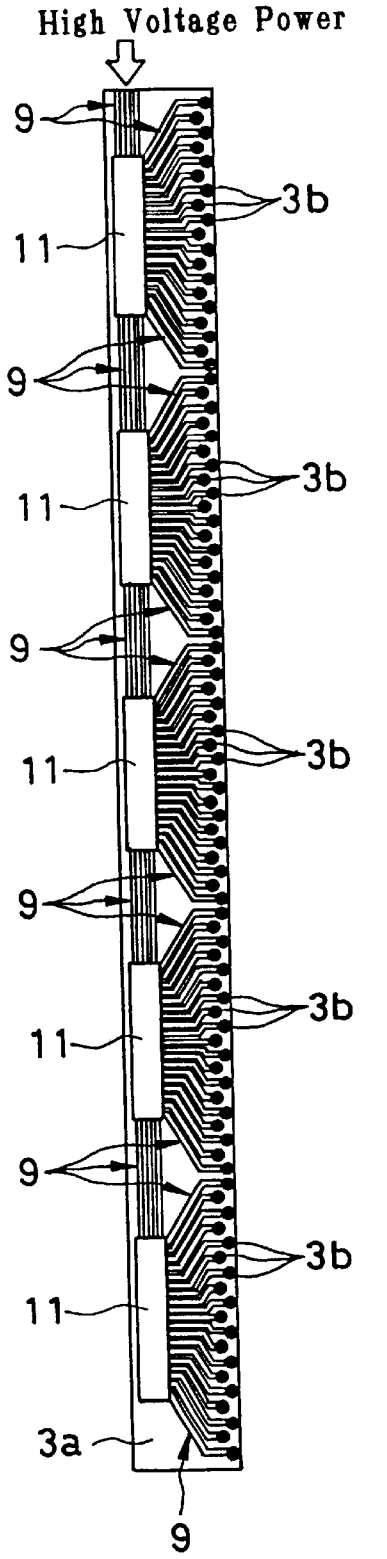
FIG. 10 is an illustration for illustrating the array pattern for the writing electrodes and the wiring pattern for drivers.

FIG. 10 shows an array pattern for arranging a plurality of electrodes 3*b* in the axial direction of the image carrier 2.

As shown in FIG. 10, in the array pattern for the writing electrodes 3*b*, the writing electrodes 3*b* are each formed in circle and are aligned in the axial direction (the vertical direction in FIG. 10) of the image carrier 2. In this case, the writing electrodes 3*b* are arranged in two parallel rows (first and second rows) in a zigzag fashion. Though not clearly shown in FIG. 10, the electrodes are arranged such that electrodes which are in different rows but adjacent to each other are partially overlapped with each other in the direction perpendicular to the axial direction of the image carrier 2. This array pattern can eliminate such portions in the surfaces of the conductive portions $2c_1$ of the image carrier 2 that are not subjected to the application or removal of charge, thereby achieving application or removal of charge relative to the entire surfaces of the conductive portions $2c_1$ of the image carrier 2.

A predetermined number of drivers 11 are provided to extend in the axial direction of the image carrier 2 on the substrate 3*a*. In this example, plural units are each formed of a predetermined number of electrodes 3*b* some of which are in the first row and the other are in the second row by connecting these electrodes 3*b* to one driver 11 and are aligned parallel to the axial direction of the image carrier 2. The respective drivers 11 are electrically connected by conductive patterns 9 made of copper (Cu) foil which is formed on the substrate 3*a* and each line of which is formed into a thin flat bar-like shape having a rectangular section. In the same manner, the drivers 11 are electrically connected to the corresponding writing electrodes 3*b* by the conductive patterns 9 formed on the substrate 3*a*. The conductive patterns 9 can be formed by a conventional known film pattern forming method such as etching. By way of the conductive patterns 9, line data, writing timing signals, and high voltage power are supplied to the respective drivers 11 from the upper side in FIG. 10. Further, a predetermined voltage $V_0$ at the high voltage (based on the absolute value) side and a ground voltage $V_1$ at the low voltage (based on the absolute value) side are supplied from each driver 11 to the corresponding writing electrodes 3*b*.

Figure 11:
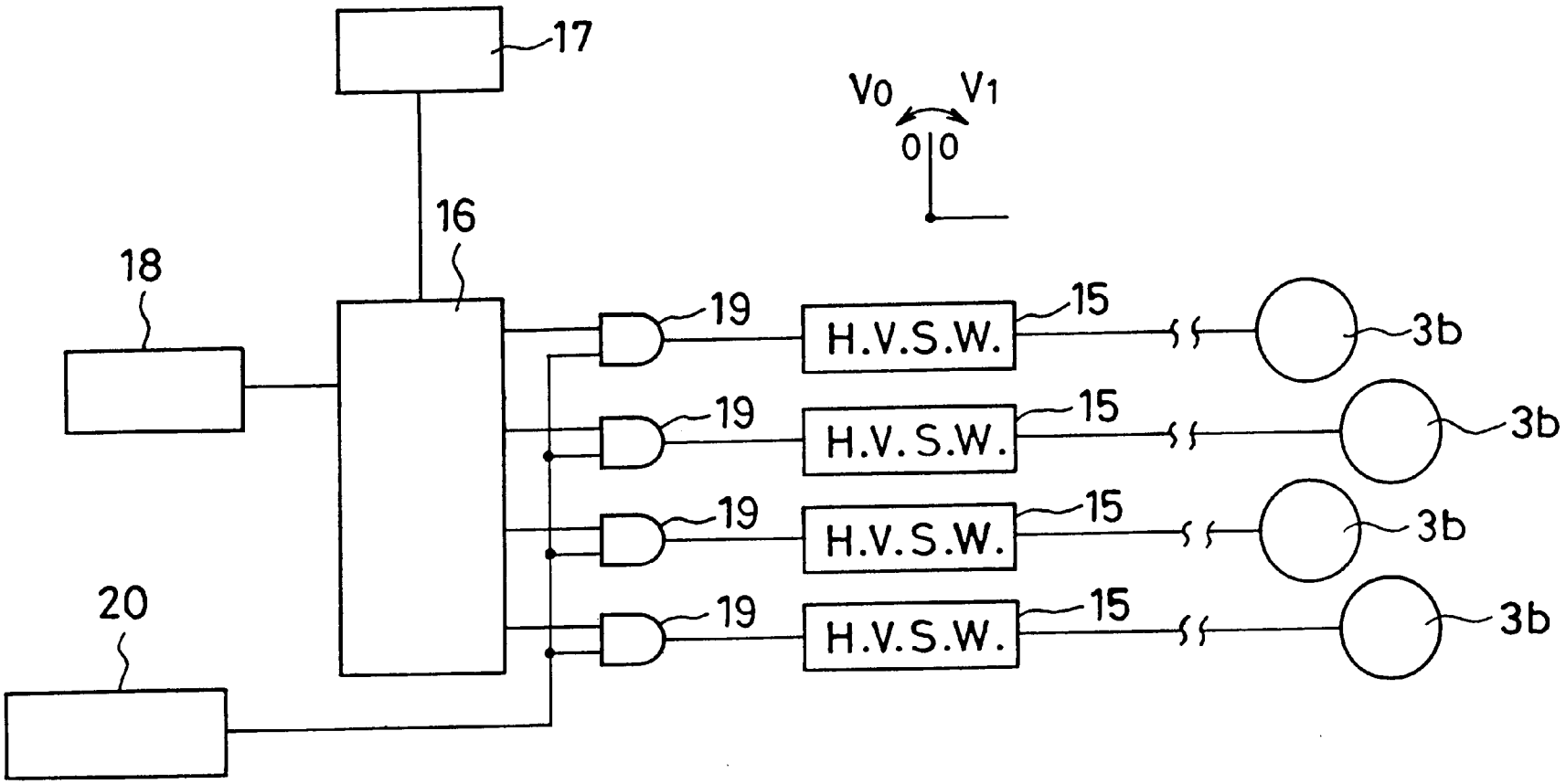
FIG. 11 is a diagram showing a switching circuit for switching the voltage to be applied to electrodes between the predetermined voltage $V_0$ and the ground voltage $V_1$.

FIG. 11 is a diagram showing a switching circuit for switching the voltage to be connected to the writing electrodes 3*b* between the predetermined voltage $V_0$ and the ground voltage $V_1$.

As shown in FIG. 11, the writing electrodes 3*b* are connected to corresponding high voltage switches (H.V.S.W.) 15, respectively. Each of the high voltage switches 15 can switch the voltage to be supplied to the corresponding electrode 3*b* between the predetermined voltage $V_0$ at the high voltage (based on the absolute value) side and the ground voltage $V_1$ at the low voltage (based on the absolute value) side. An image writing control signal is inputted into each high voltage switch 15 from a shift resistor (S.R.) 16, to which an image signal stored in a buffer 17 and a clock signal from a clock 18 are inputted. The image writing control signal is inputted into each high voltage switch 15 through each AND circuit 19 in accordance with a writing timing signal from an encoder 20. The high voltage switch 15 and the AND circuit 19 cooperate together to form the aforementioned driver 11 which controls the corresponding electrodes 3*b* by switching the supply voltage.

Figures 12A, 12B, 12C:
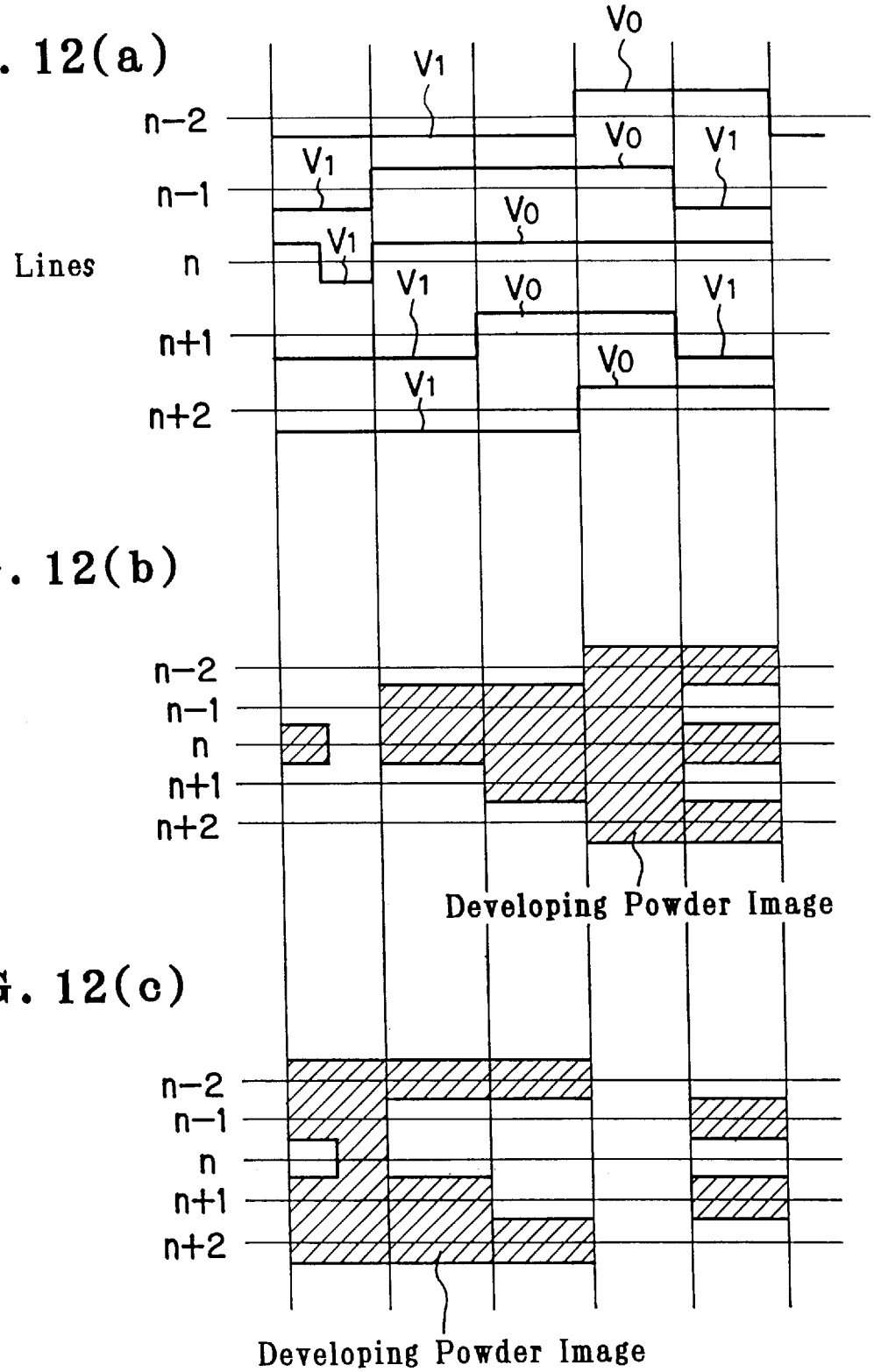
FIGS. 12(*a*)–12(*c*) show profiles when the supply voltage for each electrode is selectively controlled into the predetermined voltage $V_0$ or the ground voltage $V_1$ by switching operation of the corresponding high voltage switch, wherein FIG. 12(*a*) is a diagram showing the voltage profiles of the respective electrodes, FIG. 12(*b*) is a diagram showing a developing powder image obtained by normal developing with the voltage profiles shown in FIG. 12(*a*), and FIG. 12(*c*) is a diagram showing a developing powder image obtained by reverse developing with the voltage profiles shown in FIG. 12(*a*)

FIGS. 12(*a*)–12(*c*) show profiles when the supply voltage for each electrode 3*b* is selectively controlled into the predetermined voltage $V_0$ or the ground voltage $V_1$ by switching operation of the corresponding high voltage switch 15, wherein FIG. 12(*a*) is a diagram showing the voltage profiles of the respective electrodes, FIG. 12(*b*) is a diagram showing a developing powder image obtained by normal developing with the voltage profiles shown in FIG. 12(*a*), and FIG. 12(*c*) is a diagram showing a developing powder image obtained by reverse developing with the voltage profiles shown in FIG. 12(*a*).

Assuming that the electrodes 3*b*, for example as shown in FIGS. 12(*a*)–12(*c*), five electrodes indicated by n−2, n−1, n, n+1, and n+2, respectively, are controlled to be into the voltage profiles shown in FIG. 12(*a*) by switching operation of the respective high voltage switches 15. When an electrostatic latent image is written on the image carrier 2 with the electrodes 3*b* having the aforementioned voltage profiles and is then developed normally, the developing powder (or toner) 8 adheres to portions at the predetermined voltage $V_0$ of the image carrier 2, thereby obtaining a developing powder image (or a toner image) as shown by hatched portions in FIG. 12(*b*). When an electrostatic latent image is written in the same manner and is then developed reversely, the developing powder 8 adheres to portions at the ground voltage $V_1$ of the image carrier 2, thereby obtaining a developing powder image as shown by hatched portions in FIG. 12(*c*).

According to the image forming apparatus 1 employing the electric writing device 3 having the aforementioned structure, charge is injected to the conduct portions $2c_1$ of the image carrier 2 by the writing electrodes 3*b* of the writing device 3 which are in contact with the image carrier 2 so that charge injection is conducted dominantly, thereby achieving the writing of an electrostatic latent image on the image carrier 2. Then, the electrostatic latent image on the image carrier 2 is developed with developing powder 8 conveyed by the developing roller 4*a* of the developing device 4 to form a developing powder image and the developing powder image is subsequently transferred to the receiving medium 5 by the transferring device 6.

As mentioned above, in the image carrier 2 of this embodiment, a large number of the conductive portions $2c_1$ which are dispersed separately from each other are formed in the outer surface of the dielectric layer 2*b* and the application or removal of charge can be conducted dominantly by charge injection between the conductive portions and the charge-transfer controlling means. Therefore, the voltage to be applied can be significantly reduced as compared with the conventional device which applies or removes charge by discharge phenomenon.

Since a large number of the conductive portions $2c_1$ are dispersed separately from each other, charge applied to the conductive portion can be prevented from leaking in the lateral direction and charge on charged conductive portions $2c_1$ can be prevented from leaking i.e. from moving to another conductive portion 2*c*. Therefore, stable application or removal of charge relative to the image carrier can be conducted by charge injection.

Further, since the surface area of each conductive portion $2c_1$ is set to be smaller than the contact area of each writing electrode 3*b* and also smaller than the contact area of toner, stable application or removal of charge by charge injection can be more effectively conducted so as to reliably form a high-quality image. Particularly for application of charge, well writing can be secured.

On the other hand, the method of manufacturing the image carrier 2 of this embodiment comprises previously forming the large number of concavities $2b_1$ such that these are dispersed separately from each other, coating the surface of the dielectric layer 2b including these concavities $2b_1$ with the conductive material $2c_1$, and then grinding the coated conductive material $2c_1$. According to this method, the large number of conductive portions $2c_1$ separately dispersed can be easily formed. Therefore, the image carrier 2 can be easily manufactured.

In another method of manufacturing the image carrier 2, the conductive portions $2c_1$ are formed by spraying liquid, prepared by dispersing conductive particles in the alkali liquid, onto an insulating binder layer 2d, as the outermost layer of the image carrier 2 which is soluble relative to alkali, at equal intervals defined by the ink jet printing method. Also according to this method, the large number of conductive portions $2c_1$ separately dispersed can be easily formed. Therefore, the image carrier 2 can be easily manufactured.

Though the aforementioned embodiments are described assuming that the image carrier 2 of the present invention is of a type writing a latent image by charge injection between the image carrier 2 and the writing electrodes 3b as the charge-transfer controlling means, the present invention is not limited thereto. For example, the present invention may be applied to an image carrier to be uniformly charged or uniformly discharged by a charge-transfer controlling means prior to the writing of a latent image.

EXAMPLES

Description will now be made as regard to concrete examples (1), (2) of the aforementioned image carrier 2 which is formed in double layer comprising the dielectric layer 2b and the charge injection layer 2c.

The binder resin, the conductive filler, and the solvent used for Examples (1) and (2) are the same and shown in Table 2.

TABLE 2

| Materials of charge injection layer | |
|---|---|
| Binder Resin | Polyamide resin (available from Namariichi Chemical Industrial Co., Ltd., Trade Code: FR-104) |
| Conductive Filler | Conductive titanium dioxide (available from Titan Kogyo K. K., Trade Code: EC-300) |
| Solvent | Ethanol |

As shown in Table 2, in either Example (1), (2), polyamide resin {available from Namariichi Chemical Industrial Co., Ltd., Trade code: FR-104} was used as the binder resin, conductive titanium dioxide {available from Titan Kogyo K.K., Trade code: EC-300} was used as the conductive filler, and ethanol was used as the solvent.

The ratio (gr.) of the polyamide resin as the binder resin and the conductive titanium dioxide as the conductive filler (c-$TiO_2$), the content (%) of the conductive titanium dioxide, and the thickness of the coated layer are shown in Table 3 with respect to Examples (1) and (2), respectively.

TABLE 3

Liquid coat for charge injection layer and electric resistance of the coated layer made of the same

| No. | B/c-TiO2 (gr.) | Content (%) of c-$TiO_2$ | Rv (Ω) | Rs (Ω) | Thickness of layer (μm) |
|---|---|---|---|---|---|
| (1) | 5.0/2.5 | 33.0 | $1.3 \times 10^9$ | $7.6 \times 10^{13}$ | 1 |
| (2) | 5.0/2.5 | 33.0 | $1.3 \times 10^{10}$ | $7.6 \times 10^{12}$ | 10 |

As shown in Table 3, in Example (1), the ratio of the polyamide resin and the conductive titanium dioxide was 5.0/2.5 (gr.), the content of the conductive titanium dioxide was 33.0 (%), and the thickness of the coated layer was 1 (μm). Example (1) had a volume resistance Rv (Ω) of $1.3\times10^9$(Ω) and a surface resistance Rs (Ω) of $7.6\times10^{13}$(Ω). On the other hand, in Example (2), the ratio of the polyamide resin and the conductive titanium dioxide was 5.0/2.5 (gr.), the content of the conductive titanium dioxide was 33.0 (%), and the thickness of the coated layer was 10 (μm). Example (2) had a volume resistance Rv (Ω) of $1.3\times10^{10}$(Ω) and a surface resistance Rs (Ω) of $7.6\times10^{12}$(Ω).

An aluminium drum of ϕ30 (mm) was used as the conductive substrate 2a of the image carrier 2, PET was applied to the aluminium drum to form a dielectric layer 2b of 100 μm in thickness. Each liquid coat was prepared by mixing the materials shown in Table 2 at the ratio shown in Table 3, and uniformly dispersed by the ultrasonic dispersion. The liquid coat was applied to the PET layer by a wire bar. After that, by holding it in a vacuum dryer at 150° C. for 3 hours, a charge injection layer 2c was formed on the conductive substrate 2a. In this manner, the image carrier 2 was manufactured.

Some writing electrodes 3b were made of Al and the other writing electrodes 3b were made of Cu. All writing electrodes 3b were set to be ϕ50 μm and arranged to be spaced apart by 50 μm and aligned parallel to the axial direction of the image carrier 2. The voltage $V_0$ at the high voltage (based on the absolute value) side was set to be −400V and the voltage $V_1$ at the low voltage (based on the absolute value) side was set to be 0V. By switching operation (ON/OFF) of the respective high voltage switches 15, the voltage to be connected to the writing electrodes 3b was switched between the voltage $V_0$ and the voltage $V_1$. The peripheral velocity of the image carrier 2 was set to be 30 mm/sec.

Under the aforementioned conditions, a toner image was developed by reverse developing with all of the writing electrodes being ON. An image obtained by using the image carrier 2 of Example (1) was superior to an image obtained by using the image carrier 2 of Example (2).

Figure 13:
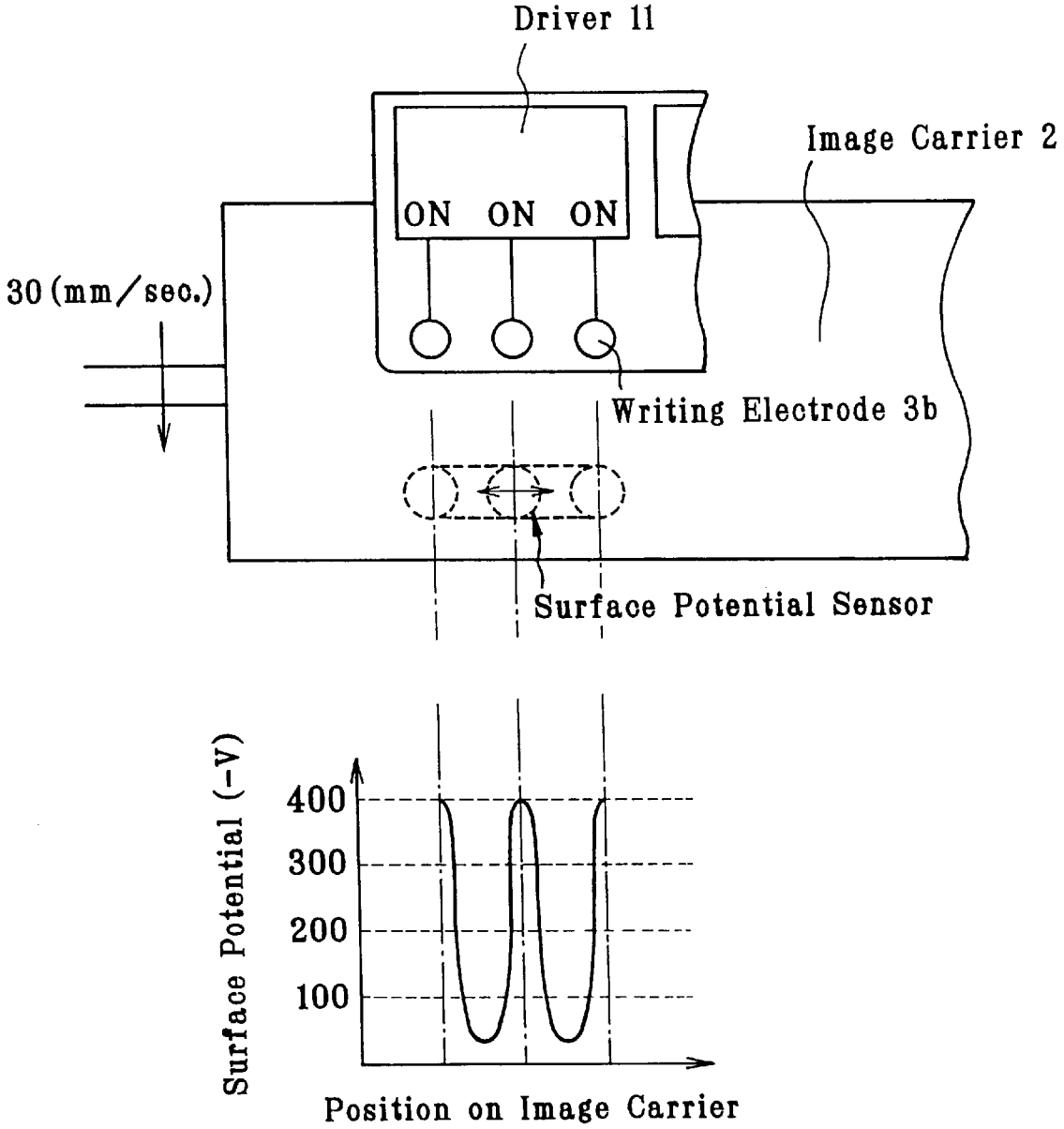
FIG. 13 is a diagram schematically illustrating a concrete example (1) of writing electrodes and an image carrier in the image forming apparatus of the present invention and showing surface potential of the image carrier when writing.
Figure 14:
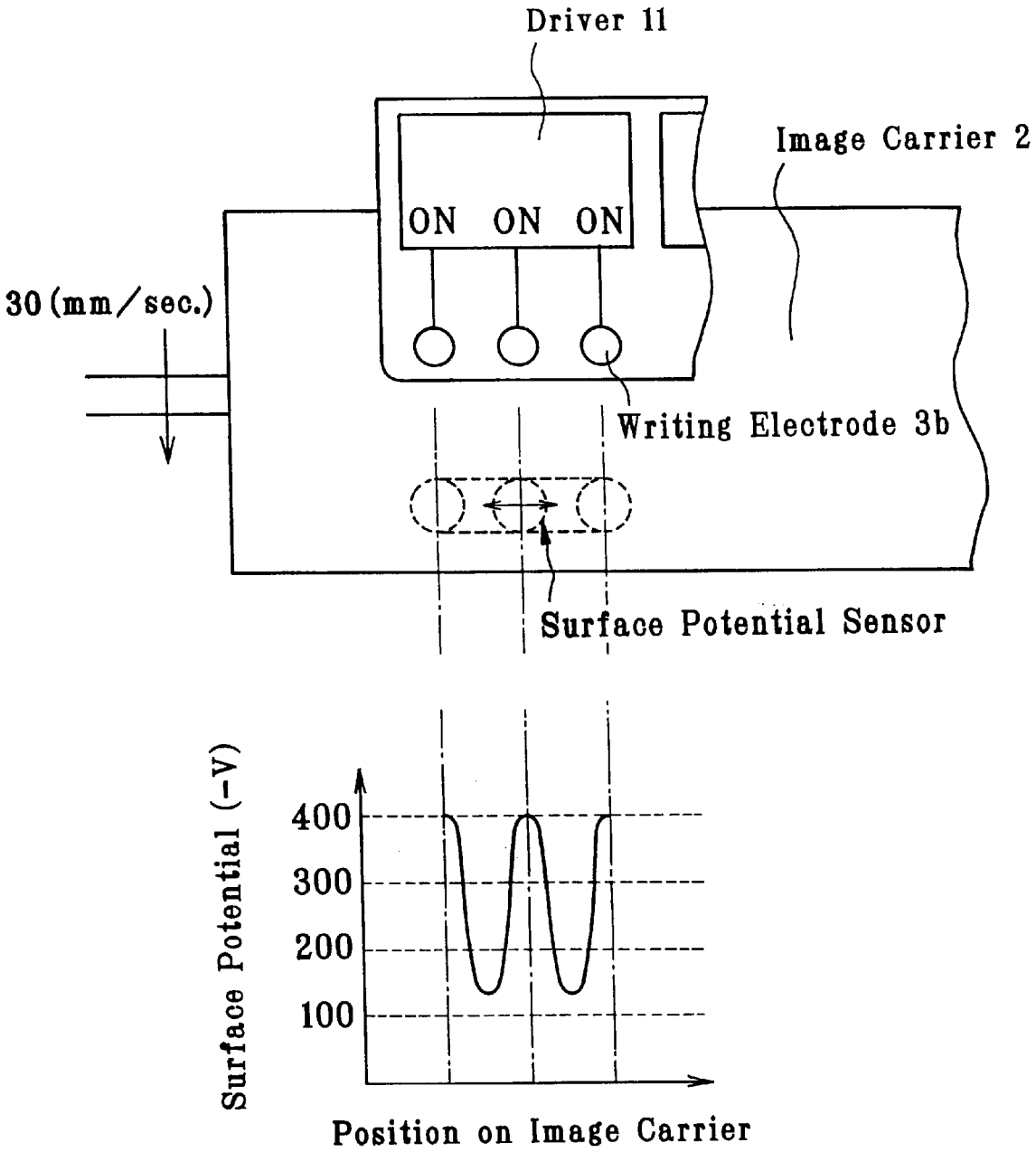
FIG. 14 is a diagram schematically illustrating a concrete example (2) of writing electrodes and an image carrier in the image forming apparatus of the present invention and showing surface potential of the image carrier when writing.

As for each of Example (1) and Example (2), the surface potential of an image portion where writing was conducted at −400V and the surface potential of a non-image portion which is the nearest to the image portion among non-image portions where writing was not conducted on the developed position were measured by a surface potential sensor. As shown in FIG. 13 and FIG. 14, the surface potential of the image portion was −400V in either case of Example (1) and Example (2), the potential of the non-image portion was −30V in the case of Example (1) and −120V in the case of example (2). That is, Example (1) made less leakage of voltage in the abscissa, i.e. in the axial direction of the image carrier 2, than Example (2).

Accordingly, it was found that in case of using a charge injection layer 2c of resin uniformly dispersed type just like the image forming apparatus 1 of this embodiment, the thinner the layer is, the better the reproducibility is, on the condition that the same material is used. In other words, if comparing charge injection layers 2*c* have the same or similar electric resistance, a charge injection layer 2*c* having smaller thickness is preferable because it can obtain larger potential contrast. Particularly, the thickness of the charge injection layer 2*c* is preferably set to be 1 μm or less.

However, formation of toner image also depends on factors other than latent image writing conditions such as charge on toner and developing condition, so the above description means merely that Example (1) can form a stable image as compared to Example (2). It should be understood that the image forming apparatus 1 of Example (2) also can form an image.

The area based on the average distance between adjacent conductive particles is set to be smaller than the contact area of each writing electrode 3*b*. In the image carrier 2 of this embodiment, assuming that the contact area of each writing electrode 3*b* is "S" and the average distance between adjacent conductive particles is "d", the contact area S of each writing electrode 3*b* is set to be satisfy "$S>(d/2)^2\cdot\pi$", Further, assuming that the average sectional area of toner particles is "S toner", these are set to be satisfy "$S>S\ toner>(d/2)^2\cdot\pi$".

Therefore, leakage of charge in the lateral direction can be prevented, thus minimizing the drifts of electrostatic latent image in the lateral direction. Since one writing electrode 3*b* can be positioned in contact with a plurality of conductive particles, charge injection between the writing electrodes 3*b* and the charge injection layer 2*c* can be stably conducted so that application or removal of charge relative to the image carrier 2 can be stably conducted. Therefore, writing can be successfully conducted by charge injection. In addition, since "$S>S\ toner>(d/2)^2\cdot\pi$" is satisfied, the reproducibility of digital data is improved.

Further, as the contact area of each writing electrode 3*b* relative to the charge injection layer 2*c* is larger than the sectional area of each conductive particle, conductive particles as the charge injection layer which are in contact with the writing electrodes 3*b* can be securely charged by charge injection, thereby securely reproducing an electrostatic latent image to be written on the image carrier 2 and thus improving the precision for writing latent images.

Figure 15:
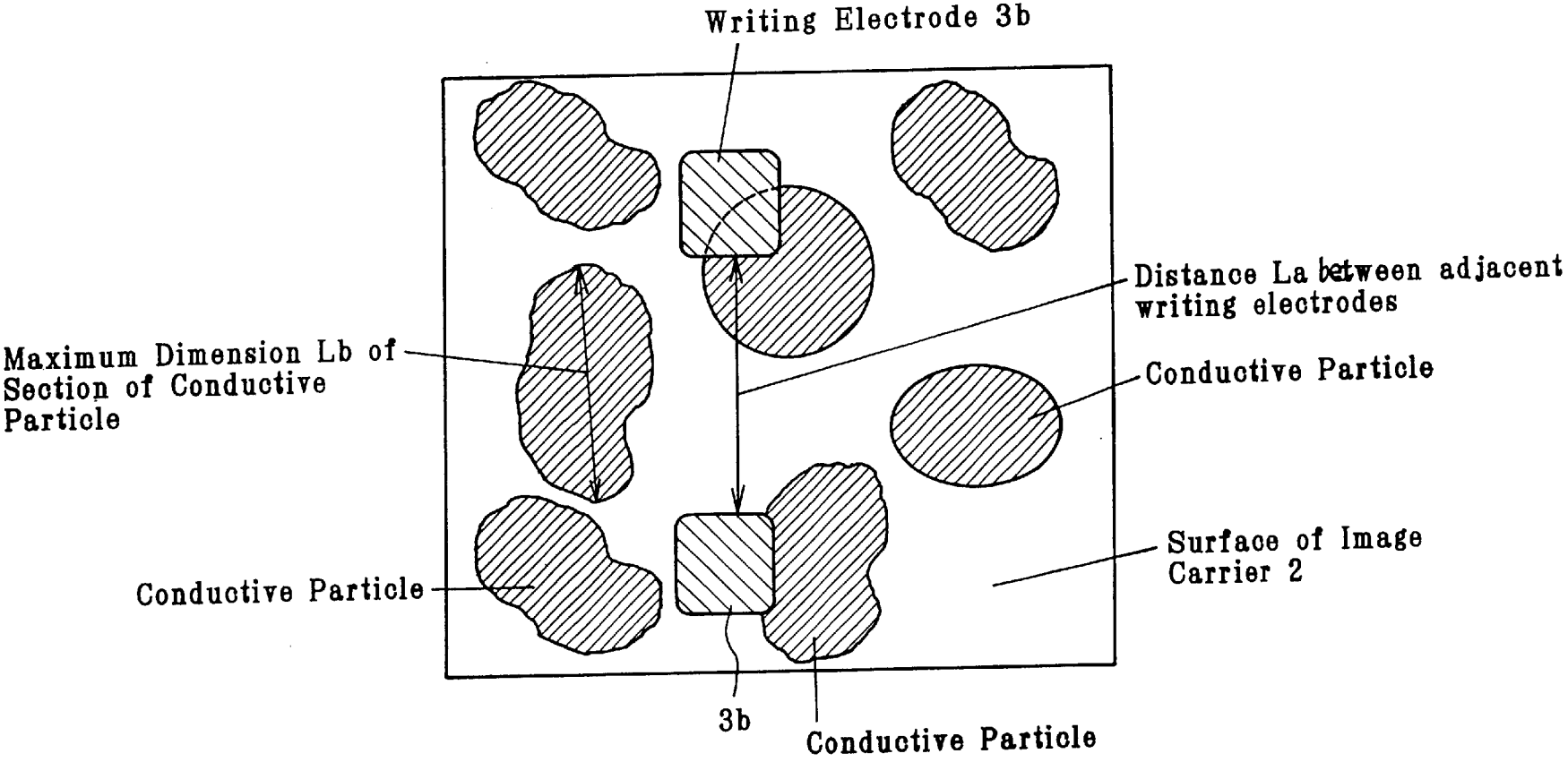
FIG. 15 is an illustration for explaining the relation between the writing electrodes and conductive micro particles in a charge injection layer.

As shown in FIG. 15, when the contact area of each writing electrode 3*b* relative to the charge injection layer 2*c* is smaller than the sectional area of each conductive particle and the maximum dimension Lb of the section of each conductive particle is smaller than the distance La between adjacent writing electrodes 3*b*, 3*b* (La>Lb), even if the writing electrode 3*b* is in contact with a very small area of the conductive particle, the apparatus can form a latent image larger than the very small contact area. In addition, this design prevents conduction between the adjacent electrodes 3*b*, 3*b*. Therefore, this design allows the writing electrodes 3*b* to be arranged to have greater distance therebetween and also allows the wirings for applying voltage to the writing electrodes 3*b* to have greater distance therebetween, thus reducing the possibility of crosstalk (electromagnetic field hindrance) between the electrodes.

Figure 16A:
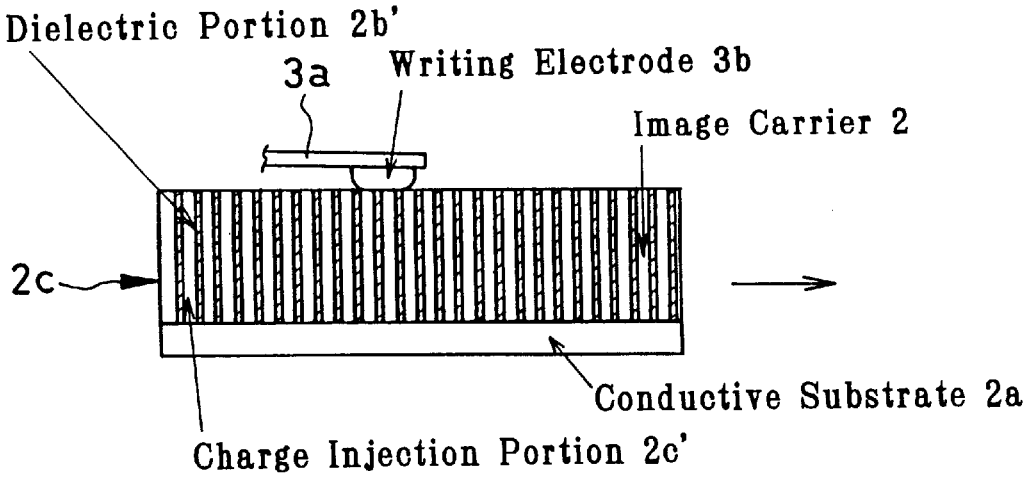
FIGS. 16(*a*), 16(*b*) show another embodiment of the image carrier of the present invention, wherein FIG. 16(*a*) is a sectional view taken along a line A—A in FIG. 16(*b*) and FIG. 16(*b*) is a plan view thereof.
Figure 16B:
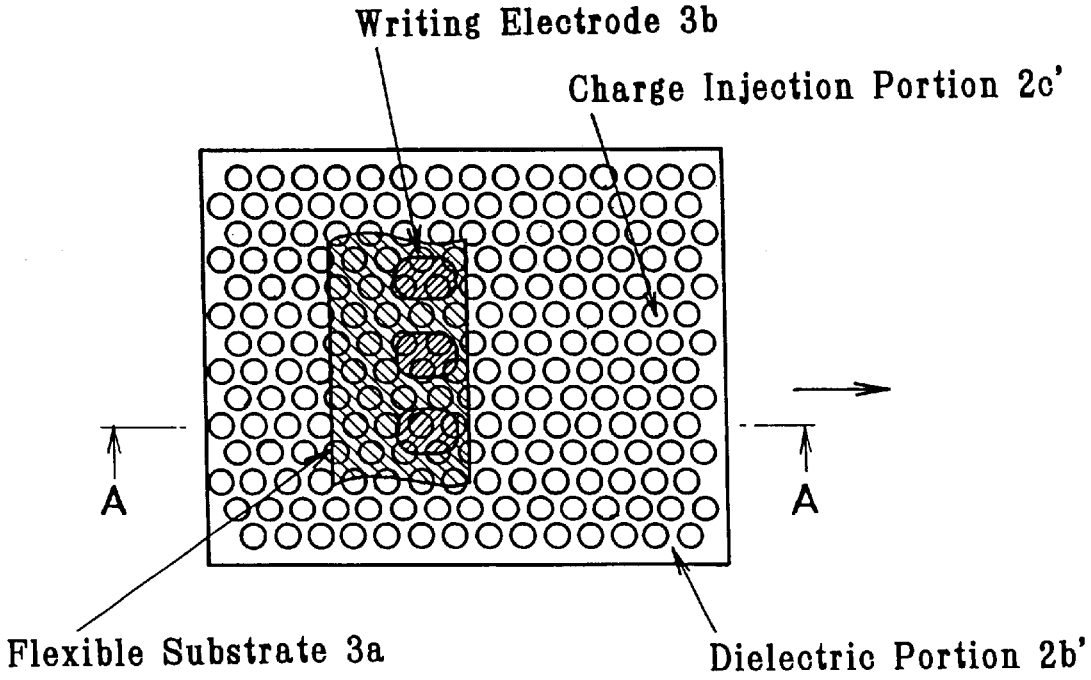

FIGS. 16(*a*), 16(*b*) show another example of the image carrier of the present invention, wherein FIG. 16(*a*) is a sectional view taken along a line A—A in FIG. 16(*b*) and FIG. 16(*b*) is a plan view thereof.

As shown in FIG. 16(*a*), an image carrier 2 of this embodiment has no dielectric layer 2*b* as described with respect to the aforementioned embodiment and is formed a single layer structure in which a charge injection layer 2*c* is directly formed on a conductive substrate 2*a* which is grounded. In this case, the charge injection layer 2*c* of this embodiment comprises a large number of dielectric portions 2*b*' (non-charge injection portions) which extend in the vertical direction and have high insulating property, and a large number of charge injection portions 2*c*' which extend in the vertical direction, wherein the dielectric portions 2*b*' and the charge injection portions 2*c*' are alternately arranged at equal intervals. As shown in FIG. 16(*b*), the large number of charge injection portions 2*c*' are arranged in a matrix structure i.e. dispersed separately from each other. That is, the charge injection portions 2*c*' are arranged in such a structure that they are formed just like islands in the sea.

In the charge injection layer 2*c* having conductive portions arranged in the islands-in-sea structure, the electric resistance in the vertical direction is set to be relatively small by the large number of charge injection portions 2*c*' extending in the vertical direction, while the electric resistance in the lateral direction is set to be relatively large by the large number of dielectric portions 2*b*' (non-charge injection portions) having high insulating property and the large number of charge injection portions 2*c*' which are alternately arranged at equal intervals. That is, the charge injection layer 2*c* of this example also satisfies the relation "electric resistance in vertical direction<electric resistance in lateral direction".

In the charge injection layer 2*c* in the islands-in-sea structure, similarly to the aforementioned embodiment shown in FIG. 10, voltage can be locally applied when the large number of writing electrodes 3*b* are in contact with the image carrier 2 uniformly in the axial positions of the image carrier 2. According to the local application, the stable selective application or removal of charge can be conducted relative to the image carrier 2. Therefore, stable precise writing of latent images is achieved.

Further, since the image carrier 2 has the charge injection layer 2*c*, charge for the writing of the last image can be removed at the same time as the next writing.

The area of each charge injection portion 2*c*' (the area of a surface to be in contact with the writing electrode 3*b*) and the area of the dielectric portion (non-charge injection portions) 2*b*' between one charge injection portion 2*c*' and an adjacent charge injection portion 2*c*' are both set to be smaller than the contact area of each writing electrode 3*b* relative to the dielectric layer 2*b*.

Therefore, the leakage of charge in the lateral direction in a charging range can be prevented, thus minimizing the drifts of electrostatic latent image in the lateral direction. Since one writing electrode 3*b* can be positioned in contact with a plurality of charge injection portions 2*c*', charge injection between the writing electrodes 3*b* and the charge injection portions 2*c*' can be stably conducted so that application or removal of charge relative to the image carrier 2 can be stably conducted. Therefore, writing can be successfully conducted by charge injection.

The method of manufacturing the image carrier 2 of the single-layer structure comprises:

(1) A step of bonding a micropores membrane to a substrate 2*a* such as an Al drum or a conductive belt. The micropores membrane is previously known in the art and the explanation of micropores membrane has been printed, for example, in a journal "Kagaku to Kogyo (Chemistry and Industry)", Vol. 53, No. 12, p. 1436 (2000), so that the description for the material will be omitted.

The micropores membrane preferably has pore diameter from 2.6 to 3.4 μm and interval of pores from 2.8 to 4.4 μm. Further, the thickness thereof is arbitrarily set in a range from 4.5 to 30 μm.

(2) A dip applying step of pouring a liquid coat into the pores of the micropores membrane on the substrate 2*a* with the micropores prepared in the above step (1), wherein the liquid coat is prepared by dispersing a conductive material such as conductive particles or a conductive filler in a binder resin.

As examples of the binder resin, there are polyester resin, polycarbonate resin, polyethylene resin, fluoride resin, cellulose, vinyl chloride resin, polyurethane resin, acrylic resin, epoxy resin, silicone resin, alkyd resin, vinyl chloride-vinyl acetate copolymer resin, polyamide resin (nylon), and the like. As examples of the material used as the conductive particles/conductive filler, there are metallic powder of Cu, Al, or Ni, metallic oxide powder of ZnO, tin oxide, antimony oxide, or $TiO_2$ (treated to have conductivity), conductive high-molecular powder such as a high-molecular complex made of polyacetylene doped with iodine, a high-molecular complex made of polythiopene doped with iodine, and a high-molecular complex made of polypyrrole doped with iodine, and a combination thereof. In this case, the content of conductive particles/conductive filler is from 10 to 100% by weight for regulating the resistance.

(3) A step of drying the applied liquid coat. In this manner, the image carrier 2 is manufactured. At this point, the surface of the image carrier 2 may be ground to have improved surface.

The electric resistance of the image carrier 2 is set to be such an electric resistance to hold a toner image after writing an latent image during the developing, transferring, and following processes and this setting of resistance depends on the process speed. Therefore, the potential of image portions gradually decreases after the writing of the latent image.

The requirement for material of the writing electrodes 3*b* is conductive, basically similar to the aforementioned embodiment shown in FIG. 2, and having electric resistance of $10^{13}\Omega$ or less. Similarly to the charge injection layer 2*c* of the aforementioned embodiment, too large electric resistance leads to defect in writing of an latent image due to some delay of writing. Therefore, the electric resistance is preferably lower as the process speed is increased. Each writing electrode 3*b* may be made of metallic material such as Cu or Al to be formed in a head-like configuration and may be made of a conductive resin to be formed in a head-like configuration. In case of manufacturing the writing electrodes 3*b* from a conductive resin, each writing electrode is manufactured by dispersing conductive particles/conductive filler in a binder resin to make its material and forming the material in a head-like configuration, alternatively, by dispersing conductive particles/conductive filler in a binder resin to make its material and applying the material on the surface of a conductive member (made of Cu or the like).

Figure 17A:
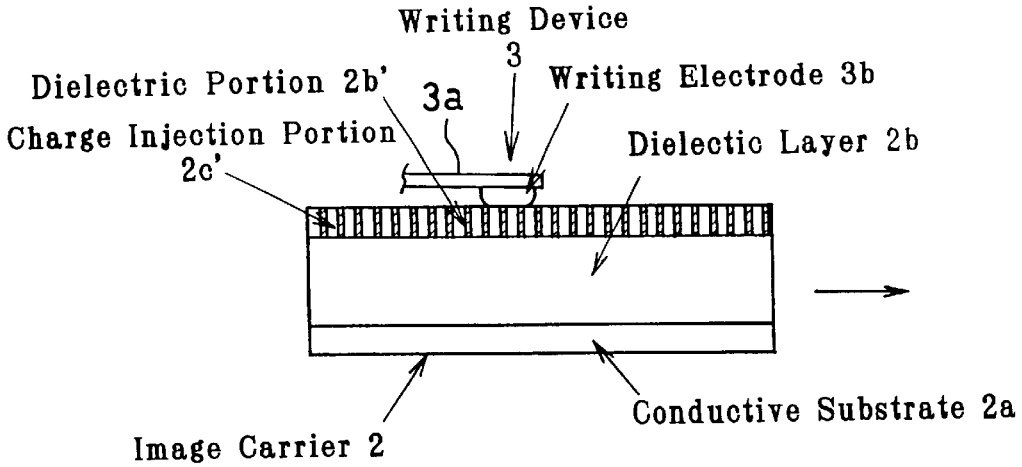
FIGS. 17(*a*), 17(*b*) show another embodiment of the image carrier of the present invention, wherein FIG. 17(*a*) is a sectional view taken along a line A—A in FIG. 17(*b*) and FIG. 17(*b*) is a plan view thereof.
Figure 17B:
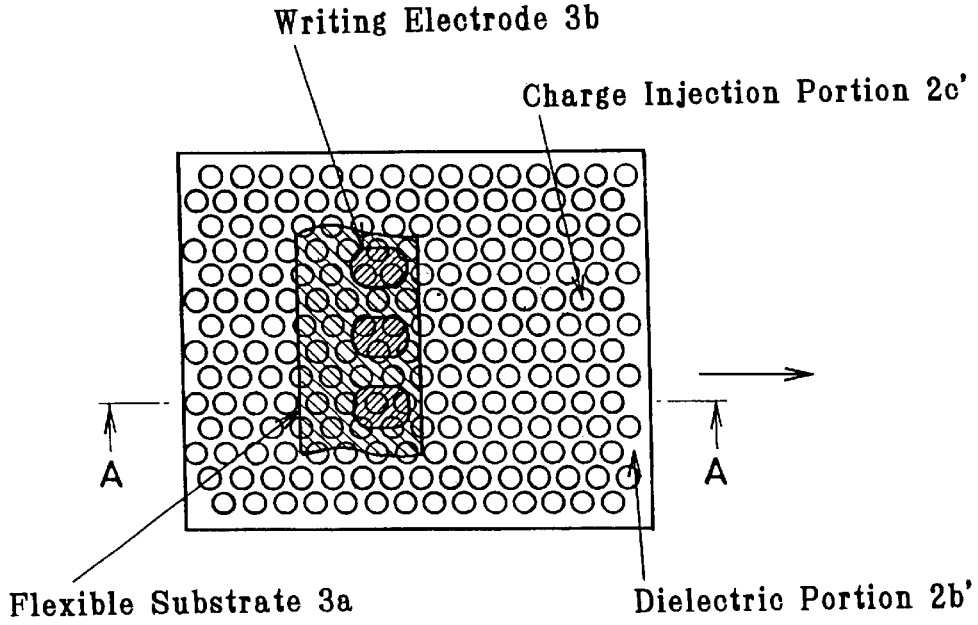
Figure 18A:
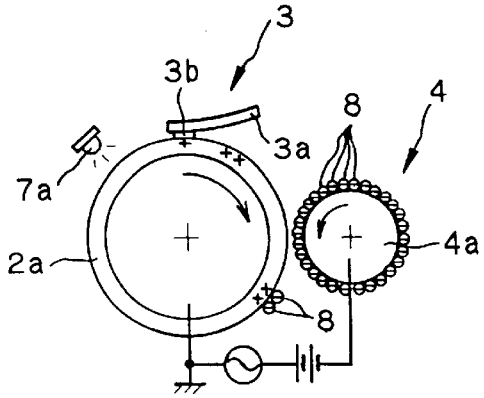
FIGS. 18(*a*)–18(*h*) are illustrations each showing an example of the basic process of forming an image in the image forming apparatus of the present invention.
Figure 18B:
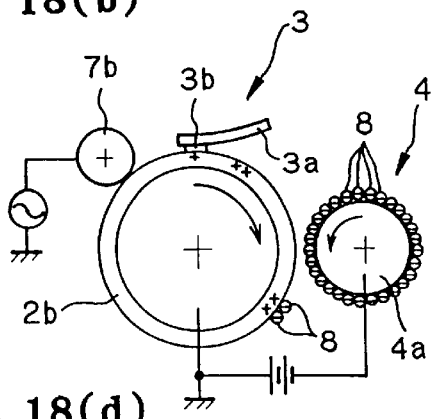
Figure 18C:
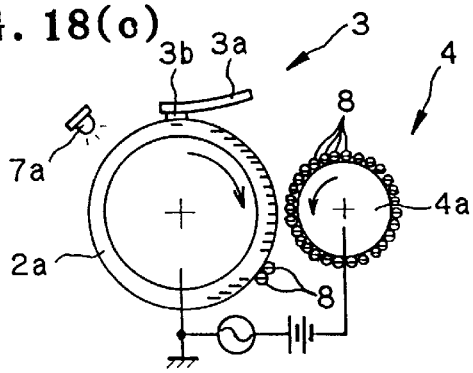
Figure 18D:
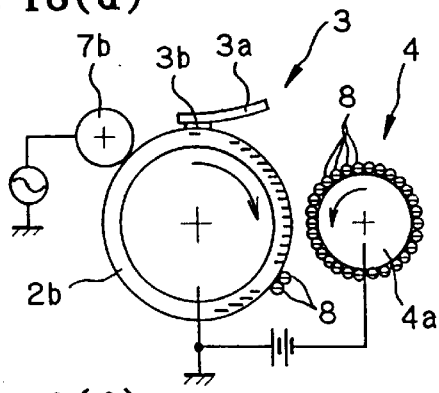
Figure 18E:
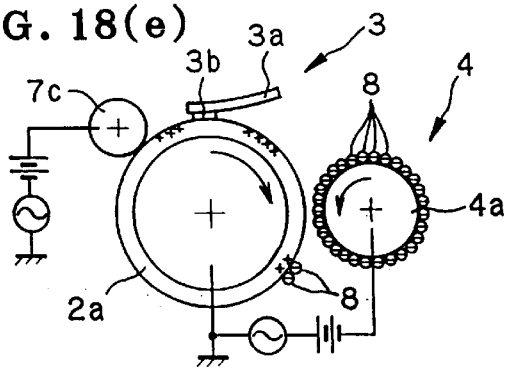
Figure 18F:
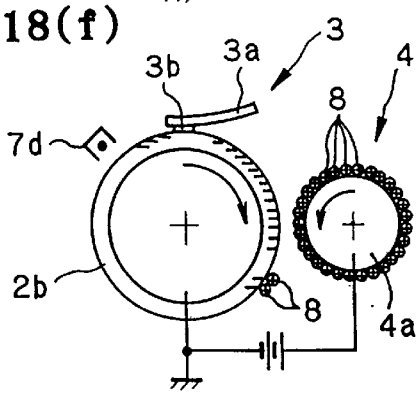
Figure 18G:
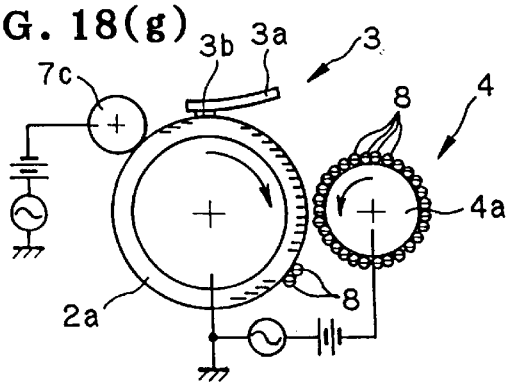
Figure 18H:
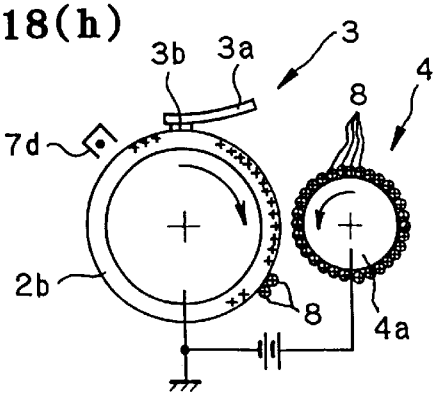

FIGS. 17(*a*), 17(*b*) show another embodiment of the image carrier of the present invention, wherein FIG. 17(*a*) is a sectional view taken along a line A—A in FIG. 17(*b*) and FIG. 17(*b*) is a plan view thereof.

As shown in FIG. 17(*a*), the image carrier 2 of this embodiment is a combination of the embodiment shown in FIGS. 3(*a*), 3(*b*) and the embodiment shown in FIGS. 16(*a*), 16(*b*), wherein instead of the charge injection layer 2*c* of the image carrier 2 of the embodiment shown FIGS. 3(*a*), 3(*b*), the charge injection layer 2*c* of the islands-in-sea structure shown in FIGS. 16(*a*), 16(*b*) is employed. That is, the image carrier 2 of this embodiment formed a multi (double)-layer structure has a charge injection layer 2*c* having charge injection portions 2*c*' as shown in FIGS. 16(*a*), 16(*b*), dielectric portions 2*b*' (non-charge injection portions) on a dielectric layer 2*b* which is similar to the dielectric layer 2*b* shown in FIGS. 3(*a*), 3(*b*). In this case, as shown in FIG. 16(*b*), the charge injection layer 2*c* is in the islands-in-sea structure in which a large number of the dielectric portions 2*b*' (non-charge injection portions) and a large number of the charge injection portions 2*c*' are alternately arranged at equal intervals.

In the charge injection layer 2*c* with conductive portions arranged in the islands-in-sea structure, similarly to the aforementioned embodiment shown in FIGS. 16(*a*), 16(*b*), the electric resistance in the vertical direction is set to be relatively low by the large number of charge injection portions 2*c*' which extends in the vertical direction, while the electric resistance in the lateral direction is set to be relatively high by the large dielectric portions 2*b*' (non-charge injection portions), having high insulation property, and the large number of charge injection portions 2*c*' which are alternately arranged at equal intervals. That is, the charge injection layer 2*c* of this embodiment is also set to satisfy "electric resistance in vertical direction<electric resistance in lateral direction".

According to the charge injection layer 2*c*, also similarly to the aforementioned embodiments, voltage can be locally applied when the large number of writing electrodes 3*b* are in contact with the image carrier 2 uniformly in the axial positions of the image carrier 2. According to the local application, the stable selective application or removal of charge can be conducted relative to the image carrier. Therefore, stable precise writing of latent images is achieved.

Further, since the image carrier 2 has the charge injection layer 2*c*, charge for the writing of the last image can be removed at the same time as the next writing.

Similarly to the embodiment shown in FIGS. 16(*a*), 16(*b*), the area of each charge injection portion 2*c*' and the area of the dielectric portion (non-charge injection portions) 2*b*' between one charge injection portion 2*c*' and an adjacent charge injection portion 2*c*' are both set to be smaller than the contact area of each writing electrode 3*b* relative to the dielectric layer 2*b*. Therefore, the leakage of charge in the lateral direction in a charging range can be prevented, thus minimizing the drifts of electrostatic latent image in the lateral direction. Since one writing electrode 3*b* can be positioned in contact with a plurality of charge injection portions 2*c*', charge injection between the writing electrodes 3*b* and the charge injection portions 2*c*' can be stably conducted so that application or removal of charge relative to the image carrier 2 can be stably conducted. Therefore, writing can be successfully conducted by charge injection.

The method of manufacturing the image carrier 2 of the multi-layer structure comprises:

(1) A step of preparing a substrate 2*a* (such as an Al drum or a conductive belt) having a dielectric layer 2*b* thereon. The material for the dielectric layer 2*b* may be the same as that for the dielectric layer 2*b* of the aforementioned embodiment shown in FIGS. 3(*a*), 3(*b*). This material is applied to the surface of the substrate 2*a* by dipping or spraying, thereby making the conductive substrate 2*a* having the dielectric layer 2*b*.

(2) A step of bonding a micropores membrane to the substrate 2*a* having the dielectric layer 2*b* thereon prepared by the step (1), similarly to the aforementioned embodiment shown in FIGS. 16(*a*), 16(*b*). In this case, it is preferable that the thickness of the micropores membrane is as smaller as possible and particularly preferably 10 μm or less.

The micropores membrane preferably has pore diameter from 2.6 to 3.4 μm and interval of pores from 2.8 to 4.4 μm. Further, the thickness thereof is arbitrarily set in a range from 4.5 to 30 μm.

(3) A dip applying step of pouring a liquid coat into the pores of the micropores membrane on the substrate 2*a* with the micropores prepared in the above step (2), wherein the liquid coat is prepared by dispersing a conductive material such as conductive particles or a conductive filler in a binder resin, similarly to the-embodiment shown in FIGS. 16(*a*), 16(*b*). The material for the binder resin may be the same as that of the embodiment shown in FIGS. 16(*a*), 16(*b*).

(4) A step of drying the applied liquid coat, similarly to the embodiment shown in FIGS. 16(*a*), 16(*b*). In this manner, the image carrier 2 is manufactured. At this point, the surface of the image carrier 2 may be ground to have improved surface.

The electric resistance of the image carrier 2 is set to be such an electric resistance to hold a toner image after writing an latent image during the developing, transferring, and following processes and this setting of resistance depends on the process speed. Therefore, the potential of image portions gradually decreases after the writing of the latent image.

On the other hand, the materials used in the writing electrodes 3*b* and the method of manufacturing the writing electrodes 3*b* of this embodiment are the same as those of the embodiment shown in FIGS. 16(*a*), 16(*b*).

According to the image forming apparatus 1 of this embodiment, the writing of an electrostatic latent image to the image carrier 2 can be conducted dominantly by charge injection between the writing electrodes 3*b* and the charge injection layer 2*c* because of the contacts of the writing electrodes 3*b* and the charge injection layer 2*c*. Therefore, the voltage to be applied to the writing electrodes 3*b* can be significantly reduced, based on the absolute value, as compared with the conventional device which applies or removes charge by discharge phenomenon.

Since the writing by charge injection does not depend on the environmental conditions such as temperature and humidity because charge performs the role of carrier, the positions of a latent image to be written are never distorted, thereby improving the stability in controlling the latent image writing positions.

Since the electric resistance of the charge injection layer 2*c* of the image carrier 2 is set such that the resistance in the vertical direction is smaller than the resistance in the lateral direction, the leakage of charge in the lateral direction can be prevented in the charge injection layer 2*c* so that charge can be effectively injected between the writing electrodes 3*b* and the charge injection layer 2*c*, thereby achieving the reliable application or removal of charge relative to the image carrier 2. Therefore, an electrostatic latent image can be written on the image carrier 2 with high precision by charge injection. In addition, since the efficiency of charge injection is improved, the voltage to be applied to the writing electrodes 3*b* can be further reduced so as not to occur discharge phenomenon between the writing electrodes 3*b* and the charge injection layer 2*c*, thereby preventing irregularity of the latent image and generation of ozone.

Since the thickness of the charge injection layer 2*c* is set to be 1 μm or less, the electric resistance can be easily set such that the difference between the resistance in the lateral direction and the resistance in the vertical direction is enlarged by just forming the charge injection layer 2*c* to have a small thickness. Therefore, the potential contrast of the electrostatic latent image can be larger, thereby further improving the precision in writing latent images.

Further, since the large number of charge injection portions 2*c*' which are dispersed separately from each other are formed in the charge injection layer 2*c*, the leakage of charge, applied to the charge injection portions 2*c*', in the lateral direction can be securely prevented. The stable application or removal of charge relative to the image carrier 2 can be conducted by charge injection.

Furthermore, since the large number of concavities $\mathbf{2}b_1$, are formed to be dispersed separately from each other in the charge injection layer 2*c* and the charge injection portions 2*c*' are formed in the large number of concavities $\mathbf{2}b_1$, the large number of charge injection portions 2*c*' can be formed just by coating a conductive material $\mathbf{2}c_1$ to the charge injection layer 2*c* with the concavities $\mathbf{2}b_1$ and grinding the coated conductive material $\mathbf{2}c_1$. Accordingly, the image carrier 2 can be easily manufactured.

Further, since the area of a surface of each charge injection portion 2*c*' to be in contact with the writing electrode 3*b* can be set to be smaller than the contact area of each writing electrode 3*b* relative to the charge injection layer 2*c*. Therefore, the stable application or removal of charge can be effectively conducted by charge injection and a high-quality image can be reliably formed.

Moreover, since the writing electrodes 3*b* are in contact with the image carrier 2 uniformly in the axial positions of the image carrier 2, voltage can be locally applied. According to the local application, the stable selective application or removal of charge can be conducted relative to the image carrier. Therefore, stable precise writing of latent images is achieved. In addition, charge for the writing of the last image can be removed at the same time as the next writing. Therefore, charge cleaning step for the image carrier 2 before the next writing can be eliminated, thereby simplifying the process.

Since the average sectional area of toner particles for developing an electrostatic latent image written on the image carrier 2 is set to be smaller than the contact area of each writing electrode 3*b* relative to the charge injection layer 2*c*, the reproducibility of digital data is improved.

It should be noted that the image carrier 2 may be a photoreceptor. In this case, the charge injection layer 2*c* is designed to have light transmitting property.

The image forming apparatus 1 of this embodiment may be of a type of normal developing with negative charge, just like the aforementioned examples (1), (2) and also may be of a type of normal developing with positive charge, of a type of reversal developing with positive charge or a type of reversal developing with negative charge. The image forming apparatus of the present invention may also be applied to an image forming apparatus which writes a latent image by removing charge from a positively charged or negatively charged image carrier 2 by writing electrodes 3*b*.

FIGS. 18(*a*)–18(*h*) are illustrations each showing an example of the basic process of forming an image in the image forming apparatus 1 of the present invention.

As the basic process of forming an image in the image forming apparatus 1 of the present invention, there are four types as follows: (1) making uniformly charged state by removal of charge—writing by contact application of charge—normal developing; (2) making uniformly charged state by removal of charge—writing by contact application of charge—reversal developing; (3) making uniformly charged state by application of charge—writing by contact removal of charge—normal developing; and (4) making uniformly charged state by application of charge—writing by contact removal of charge—reversal developing. Following description will be made as regard to these image forming processes.

(1) Making Uniformly Charged State by Removal of Charge—Writing by Contact Application of Charge—Normal Developing A process illustrated in FIG. 18(*a*) is an example of this image forming process. As shown in FIG. 18(*a*), in this example, a photoreceptor 2*a* is employed as the image carrier 2 and a charge removing lump 7*a* is employed as the charge control device 7. By positively (+) charging image portions of the photoreceptor 2*a* through the writing electrodes 3*b* of the writing device 3 which are in contact with the photoreceptor 2*a*, an electrostatic latent image is written on the photoreceptor 2*a*. In addition, a bias voltage composed of an alternating current superimposed on a direct current of a negative (−) polarity is applied to a developing roller 4*a* of the developing device 4, similarly to conventional ones. Accordingly, the developing roller 4*a* conveys negatively (−) charged developing powder 8 to the photoreceptor 2*a*. It should be noted that a bias voltage composed of a direct current of a negative (−) polarity only may be applied to the developing roller 4*a*.

In the image forming process of this example, the charge removing lump 7*a* removes charge from the surface of the photoreceptor 2*a* to make the surface into the uniformly charged (charge-removed) state with nearly 0V (zero volt) and, after that, the image portions of the photoreceptor 2*a* are positively (+) charged by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the positively (+) charged image portions of the photoreceptor 2*a*, thereby normally developing the electrostatic latent image.

A process illustrated in FIG. 18(*b*) is another example of this image forming process. As shown in FIG. 18(*b*), in this example, a dielectric body 2*b* is employed as the image carrier 2 and a charge removing roller 7*b* is employed as the charge control device 7. Similarly to conventional ones, a bias voltage composed of a direct current of a negative (−) polarity may be applied to the developing roller 4*a*. It should be noted that a bias voltage composed of an alternating current superimposed on a direct current of a negative (−) polarity may be applied to the developing roller 4*a*. On the other hand, a bias voltage composed of an alternating current is applied to the charge removing roller 7*b*. Other structures of this example are the same as those of the aforementioned example shown in FIG. 18(*a*).

In the image forming process of this example, the charge removing roller 7*b* is in contact with the dielectric body 2*b* so as to remove charge from the surface of the dielectric body 2*b* to make the surface of the dielectric body 2*b* into the uniformly charged (charge-removed) state with nearly 0V (zero volt). The image forming actions after that are the same as those of the aforementioned example shown in FIG. 18(*a*), except that the dielectric body 2*b* is used instead of the photoreceptor 2*a*.

(2) Making Uniformly Charged State by Removal of Charge—Writing by Contact Application of Charge—Reversal Developing A process shown in FIG. 18(*c*) is an example of this image forming process. As shown in FIG. 18(*c*), in this example, a photoreceptor 2*a* is employed as the image carrier 2 and a charge removing lump 7*a* is employed as the charge control device 7 just like the example shown in FIG. 18(*a*). The writing electrodes 3*b* of the writing device 3 are in contact with the photoreceptor 2*a* so that non-image portions of the photoreceptor 2*a* are negatively (−) charged. Other structures of this example are the same as those of the aforementioned example shown in FIG. 18(*a*).

In the image forming process of this example, the charge removing lump 7*a* removes charge from the surface of the photoreceptor 2*a* to make the surface of the photoreceptor 2*a* into the uniformly charged (charge-removed) state with nearly 0V (zero volt) and, after that, the non-image portions of the photoreceptor 2*a* are negatively (−) charged by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to image portions, not negatively (−) charged and having nearly 0V (zero volt), of the photoreceptor 2*a*, thereby reversely developing the electrostatic latent image.

A process illustrated in FIG. 18(*d*) is another example of this image forming process. As shown in FIG. 18(*d*), in this example, a dielectric body 2*b* is employed as the image carrier 2 and a charge removing roller 7*b* is employed as the charge control device 7 just like the example shown in FIG. 18(*b*). The writing electrodes 3*b* of the writing device 3 are arranged in contact with the dielectric body 2*b* to negatively (−) charge non-image portions of the dielectric body 2*b*. Other structures of this example are the same as those of the aforementioned example shown in FIG. 18(*b*).

In the image forming process of this example, the charge removing roller 7*b* is in contact with the dielectric body 2*b* so as to remove charge from the surface of the dielectric body 2*b* to make the surface into the uniformly charged (charge-removed) state with nearly 0V (zero volt). The image forming actions after that are the same as those of the aforementioned example shown in FIG. 18(*c*), except that the dielectric body 2*b* is used instead of the photoreceptor 2*a*.

(3) Making Uniformly Charged State by Application of Charge—Writing by Contact Removal of Charge—Normal Developing A process shown in FIG. 18(*e*) is an example of this image forming process. As shown in FIG. 18(*e*), in this example, a photoreceptor 2*a* is employed as the image carrier 2 and a charging roller 7*c* is employed as the charge control device 7. A bias voltage composed of an alternating current superimposed on a direct current of a positive (+) polarity is applied to the charging roller 7*c* so that the charging roller 7*c* uniformly positively (+) charges the surface of the photoreceptor 2*a*. It should be noted that a bias voltage composed of a direct current of a positive (+) polarity only may be applied to the charging roller 7*c*. In addition, the writing electrodes 3*b* of the writing device 3 are in contact with the photoreceptor 2*a* so that positive (+) charge is removed from the non-image portions of the photoreceptor 2*a*. Other structures of this example are the same as those of the aforementioned example shown in FIG. 18(*a*).

In the image forming process of this example, the charging roller example are the same as those of the aforementioned example shown in FIG. 18(*b*).

In the image forming process of this example, the surface of the dielectric body 2*b* is negatively (−) charged by the corona charging device 7*d* to make the surface of the dielectric body 2*b* into the uniformly charged state with the predetermined voltage and, after that, negative (−) charge is removed from the non-image portions of the dielectric body 2*b* by the writing electrodes 3*b* of the writing device 3, thereby writing an electrostatic latent image on the dielectric body 2*b*. Then, positively (+) charged developing powder 8 conveyed by the developing roller 4*a* of the developing device 4 adheres to the image portions, negatively (−) charged, of the dielectric body 2*b*, thereby normally developing the electrostatic latent image.

(4) Making Uniformly Charged State by Application of Charge—Writing by Contact Removal of Charge—Reversal Developing A process shown in FIG. 18(*g*) is an example of this image forming process. As shown in FIG. 18(*g*), in this example, a photoreceptor 2*a* is employed as the image carrier 2 and a charging roller 7*c* is employed as the charge control device 7. A bias voltage composed of an alternating current superimposed on a direct current of a negative (−) polarity is applied to the charging roller 7*c* so that the charging roller 7*c* uniformly negatively (−) charges the surface of the photoreceptor 2*a*. It should be noted that a bias voltage composed only of a direct current of a negative (−) polarity may be applied to the charging roller 7*c*. The writing electrodes 3*b* of the writing device 3 are in contact with the photoreceptor 2*a* so that negative (−) 7*c* is arranged in contact with the photoreceptor 2*a* so as to positively (+) charge the surface of the photoreceptor 2*a* to make the surface into the uniformly charged state with a predetermined voltage and, after that, positive (+) charge is removed from the non-image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, positively (+) charged, of the photoreceptor 2*a*, thereby normally developing the electrostatic latent image.

A process illustrated in FIG. 18(*f*) is another example of this image forming process. As shown in FIG. 18(*f*), in this example, a dielectric body 2*b* is employed as the image carrier 2 and a corona charging device 7*d* is employed as the charge control device 7. A bias voltage composed of a direct current of a negative (−) polarity or a bias voltage composed of an alternating current superimposed on a direct current of a negative (−) polarity is applied to the corona charging device 7*d* in the same manner as the conventional one, but not illustrated. The writing electrodes 3*b* of the writing device 3 are arranged in contact with the dielectric body 2*b* to remove negative (−) charge from the non-image portions of the dielectric body 2*b*. Moreover, a bias voltage composed of a direct current of a positive (+) polarity is applied to the developing roller 4*a* so that the developing roller 4*a* conveys positively (+) charged developing powder 8 to the dielectric body 2*b*. It should be noted that a bias voltage composed of an alternating current superimposed on a direct current of a positive (+) polarity may be applied to the developing roller 4*a*. Other structures of this charge is removed from the image portions of the photoreceptor 2*a*. Other structures of this example are the same as those of the aforementioned example shown in FIG. 18(*a*).

In the image forming process of this example, the charging roller 7*c* is arranged in contact with the photoreceptor 2*a* to negatively (−) charge the surface of the photoreceptor 2*a* to make the surface into the uniformly charged state with a predetermined voltage and, after that, negative (−) charge is removed from the image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, not negatively (−) charged, of the photoreceptor 2*a*, thereby reversely developing the electrostatic latent image.

A process illustrated in FIG. 18(*h*) is another example of this image forming process. As shown in FIG. 18(*h*), in this example, a dielectric body 2*b* is employed as the image carrier 2 and a corona charging device 7*d* is employed as the charge control device 7. A bias voltage composed of a direct current of a positive (+) polarity or a bias voltage composed of an alternating current superimposed on a direct current of a positive (+) polarity is applied to the corona charging device 7*d*, but not illustrated. Other structures of this example are the same as those of the aforementioned example shown in FIG. 18(*f*).

In the image forming process of this example, the surface of the dielectric body 2*b* is positively (+) charged by the corona charging device 7*d* to make the surface of the dielectric body 2*b* into the uniformly charged state with the predetermined voltage and, after that, positive (+) charge is removed from the image portions of the dielectric body 2*b* by the writing electrodes 3*b* of the writing device 3, thereby writing an electrostatic latent image onto the dielectric body 2*b*. Then, positively (+) charged developing powder 8 conveyed by the developing roller 4*a* of the developing device 4 adheres to the image portions, not positively (+) charged, of the dielectric body 2*b*, thereby reversely developing the electrostatic latent image.

Figure 19A:
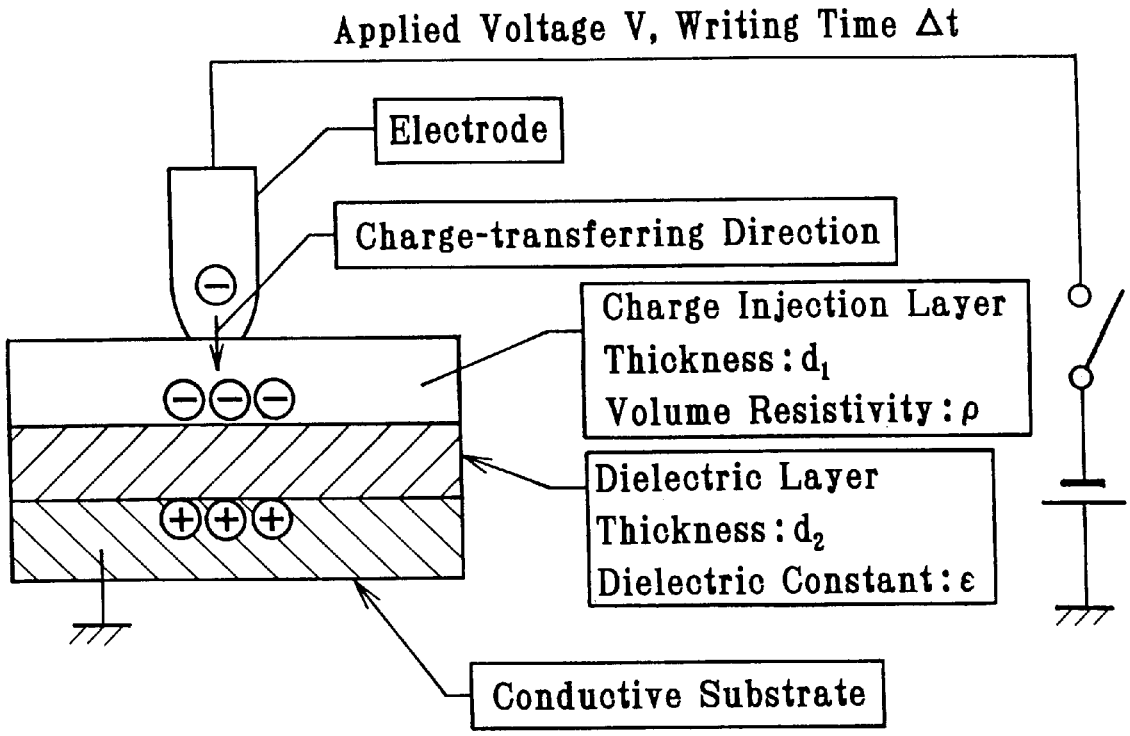
FIG. 19(A) is a schematic illustration showing the function of a charge injection layer through application or removal of charge of the writing electrodes of the writing device.
Figure 19B:
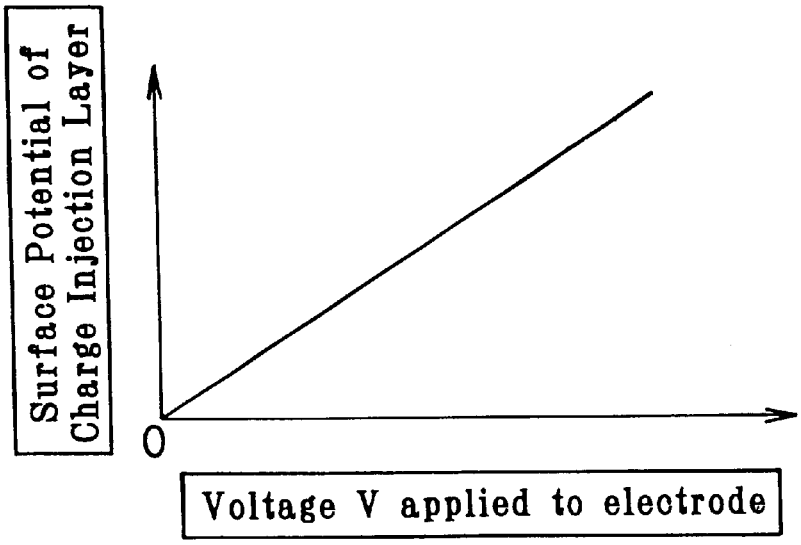
FIG. 19(B) is a graph showing the relation between the voltage applied to electrodes and the surface potential of the charge injection layer.

FIG. 19(A) is a schematic illustration showing the function of a charge injection layer 2*a* through application or removal of charge of the writing electrodes 3*b* of the writing device 3, and FIG. 19(B) is a graph showing the relation between the voltage applied to electrodes and the surface potential of the charge injection layer 2*a*.

As shown in FIG. 19(A), as voltage V is applied to a writing electrode 3*b*, injection of negative (−) charge is conducted directly from a lower voltage side to a higher voltage side between the writing electrode 3*b* and the charge injection layer 2*a*. This means that charge is applied to or removed from the charge injection layer 2*a* via the charge injection. During this, as shown in FIG. 19(B), the surface potential of the charge injection layer 2*a* is proportional to the voltage V applied to the electrode 3*b* so that charge is injected in proportion to the applied voltage.

Figure 20A:
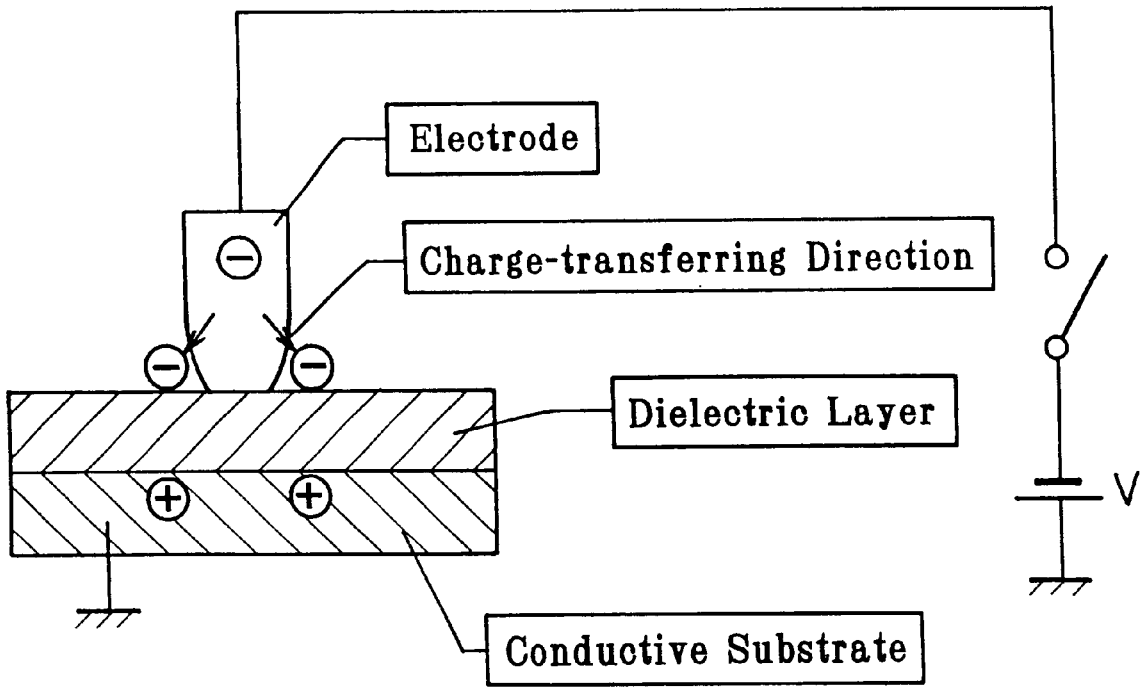
Figure 20B:
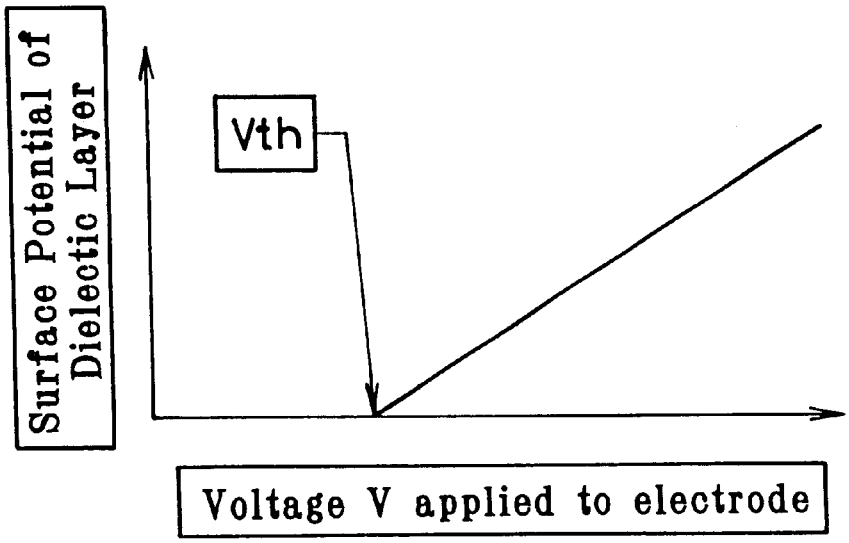

FIGS. 20(A), 20(B) show a comparative example relative to the present invention, wherein FIG. 20(A) is a schematic illustration showing the function of a case without charge injection layer 2*a* in FIG. 19(A) and FIG. 20(B) is a graph showing the relation between the voltage applied to electrodes and the surface potential of a dielectric layer.

After the voltage V applied to the writing electrode is increased and reaches to a discharge starting voltage $V_{th}$, charge is transferred from the periphery of the electrode through the gaps to the surface of the dielectric layer by discharge phenomenon, thereby achieving the transfer of charge to the dielectric layer. It should be understood that since the dielectric layer is insulative, charge injection does not take place relative to the dielectric layer even though the writing electrode is in contact therewith. If the voltage applied to the electrode is increased until charge is injected, the insulating property is broken, that is, the property of the dielectric layer is altered. Therefore, the writing method of electrostatic latent image by charge injection described with reference to FIGS. 19(*a*), 19(*b*) has an advantage of allowing the employment of a power source of low voltage.

Figure 21:
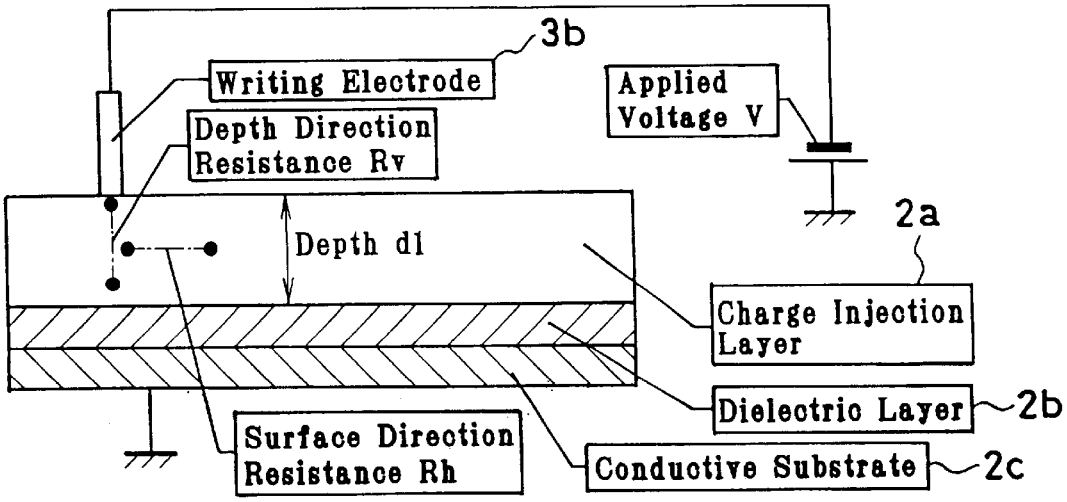
FIG. 21 is a schematic illustration for explaining the characteristic of the present invention.

FIG. 21 is a schematic illustration for explaining the characteristic of the present invention. The requirement for the writing method of electrostatic latent image by charge injection is that charge injected directly below the writing electrode 3b is larger than leakage charge around the writing electrode 3b (hereinafter, such difference will be referred to as "contrast potential"). For this, assuming that the resistance in the depth direction of the charge injection layer 2a is $R_v$ and the resistance in the surface direction of the charge injection layer 2a is $R_h$, the requirement is to satisfy:

$$R_h > R_v \quad (1)$$

In addition, assuming that the volume resistivity of the charge injection layer 2a is ρ (the volume resistivity is common to the depth direction and the surface direction), the following equation can be obtained from Equation (1):

$$\rho/d_1 > \rho \cdot d_1$$

that is, $$d_1^2 < 1 \quad (2)$$

so that the requirement is that $d_1^2$ is smaller than the unit area of the electrode.

Now, description will now be made as regard to a case where the volume resistivity of the charge injection layer 2a is anisotropic. That is, the volume resistivity in the depth direction of the charge injection layer 2a is $\rho_v$ and the volume resistivity in the surface direction of the charge injection layer 2a is $\rho_s$, the following equation is obtained from Equation (1):

$$\rho_s/d_1 > \rho_v \cdot d_1$$

that is, the requirement is to satisfy $$d^{12} < \rho_s/\rho_v \quad (3)$$

In this case, as compared to Equation (2), when $\rho_s > \rho_v$, the thickness $d_1$ of the charge injection layer 2a can be set larger than $d_1$. As a result, the large thickness improves the resistance against abrasion by the writing electrodes 3b and the like, thereby prolonging the life of the charge injection layer 2a.

Now, examples will be described in which a charge injection layer 2a has volume resistivity p which is common to the depth direction and the surface direction thereof.

EXAMPLE 1

(1) Charge Injection Layer 2a

Titanium dioxide $T_iO_2$ treated to have conductivity (available from Titan Kogyo K.K., Trade code: FC-300) and polyamide resin (available from Namariichi Chemical Industrial Co., Ltd., Trade code: FR-104) were mixed with each other using ethanol as a solvent. The mixing ratio by weight was (titanium dioxide/polyamide resin)=95%. The mixed liquid was coated on a dielectric layer 2b and dried (in a vacuum dryer at 150° C. for 3 hours), thereby forming a charge injection layer 2a. Its volume resistivity ρ was $7\times10^9\Omega\cdot$cm (measured by "HIRESTA IP" manufactured by Mitsubishi Petrochemical Co., Ltd.).

(2) Dielectric layer 2b and Conductive Substrate 2c.

A dielectric layer of 120 μm in thickness was formed by polycarbonate resin on an aluminium tube. Its dielectric constant ε was $2.9\times10^{-13}$ F/cm.

(3) Writing time.

Since the diameter of each electrode was 60 μm and the peripheral velocity of the image carrier was 60 mm/sec, $$\text{Writing time } \Delta t = 60\times10^{-4}/6 = 1 \text{ (ms)}.$$

(4) Charge was injected to an area (unit area)=100 μm×100 μm by using a plurality of electrodes.

(5) The surface potential of the charge injection layer in the writing area was −300V when the potential of the electrode was −300V (no insufficient charge injection appeared in the depth of 275 μm).

(6) The surface potential of an area (unit area)=100 μm×100 μm of the charge injection layer adjacent to the writing area was −150 V when the thickness of the charge injection layer was 70 μm, −60 V when the thickness of the charge injection layer was 50 μm, and −30 V when the thickness of the charge injection layer was 30 μm.

COMARATIVE EXAMPLE 1

The surface potential was −300 V when the thickness of the charge injection layer was 100 μm and also −300 V when the thickness of the charge injection layer was 120 μm. There was no potential difference.

EXAMPLE 2

(1)–(3) were the same as Example 1.

(4) Charge was injected to an area (unit area)=200 μm×200 μm by using a plurality of electrodes.

(5) The surface potential of the charge injection layer in the writing area was −300V when the potential of the electrode was −300V (no insufficient charge injection appeared in the depth of 275 μm).

(6) The surface potential of an area (unit area)=200 μm×200 μm of the charge injection layer adjacent to the writing area was −75 V when the thickness of the charge injection layer was 100 μm, −30 V when the thickness of the charge injection layer was 70 μm, −25 V when the thickness of the charge injection layer was 50 μm, and 0 V when the thickness of the charge injection layer was 30 μm.

COMARATIVE EXAMPLE 2

The surface potential was −300 V when the thickness of the charge injection layer was 200 μm so that there was no potential difference.

Next, examples will be described in which the relation between the volume resistivity $\rho_v$ in the depth direction of the charge injection layer 2a and the volume resistivity $\rho_s$ in the surface direction of the charge injection layer 2a is represented by $\rho_s > \rho_v$.

EXAMPLE 3

Figure 22:
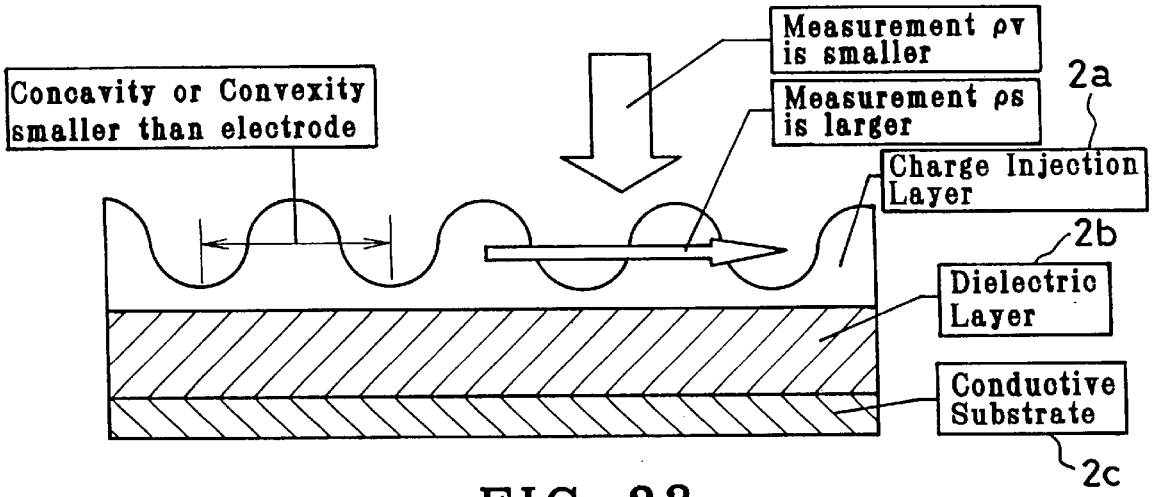
FIG. 22 is an illustration for explaining an embodiment of the present invention.

As shown in FIG. 22, convexoconcaves each of which is smaller than each electrode were formed in the surface of a charge injection layer 2a so as to set the volume resistivity $\rho_s$ in the surface direction to be larger than the volume resistivity $\rho_v$ in the depth direction.

As a method of forming the convexoconcaves, blasting, grinding, etching, and using a mesh member of conductive fiber (carbon, stainless steel) may be employed.

EXAMPLE 4

Figure 23:
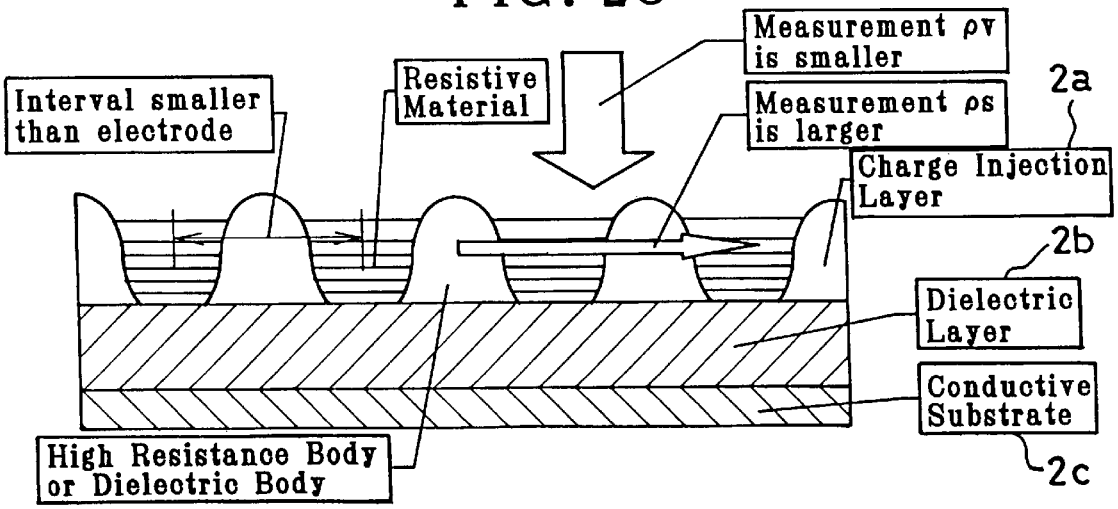
FIG. 23 is an illustration for explaining another embodiment of the present invention.

As shown in FIG. 23, convexoconcaves each of which is smaller than each electrode were formed in the surface of a dielectric layer 2b and resistive material is filled in the concavities so as to set the volume resistivity $\rho_s$ in the surface direction to be larger than the volume resistivity $\rho_v$ in the depth direction. Concretely, convexoconcaves are formed in the surface of the dielectric layer 2b and then a conductive coat is applied to the surface. Alternatively, a conductive coat is impregnated in or applied to a porous dielectric body (a drawn or foamed porous high polymer, an alumite honeycomb body, a porous ceramic). Alternatively, conductive fibers (carbon fibers, graphite, iron fibers, stainless steel fibers, copper fibers) and a polymeric material were mixed and dispersed and the fibers are oriented in the depth direction of the charge injection layer by drawing or shrinking. Still alternatively, a polymer alloy sheet is made of poly (acrylonitrile) and another polymeric material and is locally burned in the depth direction by electric energy to form carbon fibers.

EXAMPLE 5

In this example, the material itself is anisotropic, that is, a conductive polymeric material is drawn or shrunk to orient the easy-to-carry-current direction of its molecules in the depth direction of a charge injection layer.

Hereinafter, the thickness condition of the charge injection layer for a case of a stripe gray-reproducing pattern composed of thin lines for reproducing a gray (gradation) which is neither a solid black nor a solid white will be described with reference to FIGS. 24(A), 24(B).

Figure 24A:
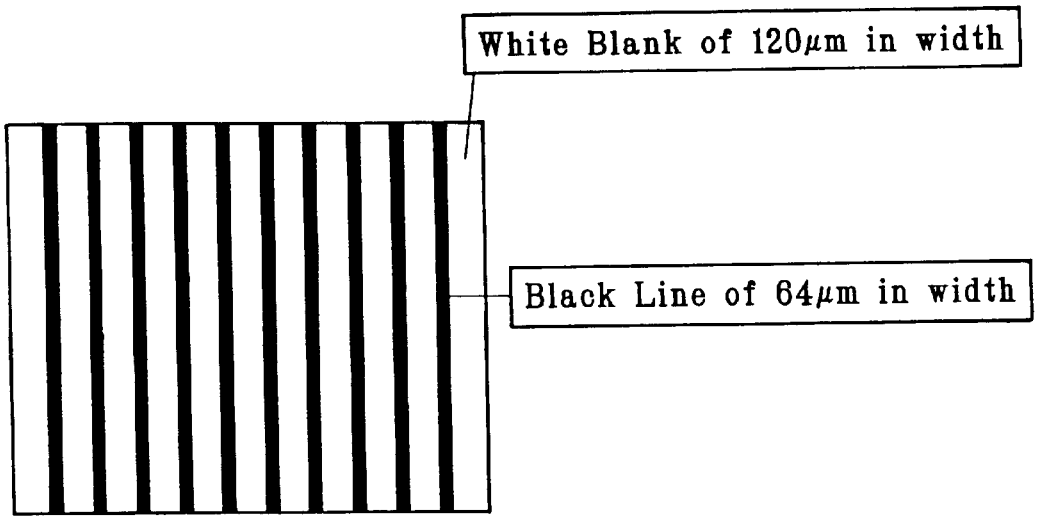
FIGS. 24(A), 24(B) are diagrams for explaining the condition in thickness of the charge injection layer for a stripe gray-reproducing pattern.
Figure 24B:
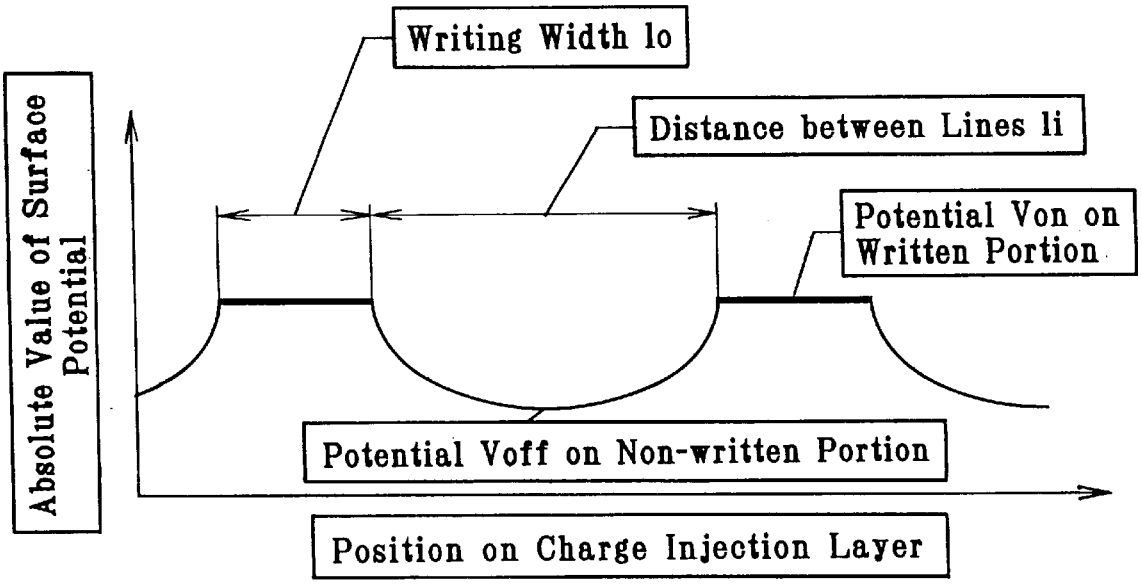

FIG. 24(A) shows an example of the stripe gray-reproducing pattern, in which, for example, black lines of 64 μm in width are aligned to form white blanks of 120 μm in width therebetween. FIG. 24(B) shows absolute values of the surface potential corresponding to positions on the charge injection layer in the stripe gray-reproducing pattern shown in FIG. 24(A).

As for the aforementioned stripe gray-reproducing pattern, the requirement for obtaining a predetermined contrast potential $|V_{ct}|$ is that the potential produced by injected charge in a writing width $1_0$ of the writing electrode 3*b* is larger than the potential produced by injected charge at the middle between lines ($l_1/2$). Therefore, the following equation is obtained:

$$|V|d_2\Delta t/(\rho d_1\in)-|V|d_1d_2\Delta t/(\rho(l_1/2)\in(l_1/2))>|V_{on}-V_{off}|=|V_{ct}| \quad (4)$$

wherein V is voltage applied to the electrodes, $d^1$ is thickness of the charge injection layer, $d_2$ is the thickness of the dielectric layer, ρ is the volume resistivity of the charge injection layer, ∈ is the dielectric constant of the dielectric layer, and Δt is the writing time. Therefore, the following equation can be obtained:

$$(d_2/(\rho d_1\in))(1-4\ d_1^2/l_1^2)>|V_{ct}|/|V|\Delta t) \quad (5)$$

Hereinafter, the thickness condition of the charge injection layer for a case of a gray-reproducing pattern composed of dots for reproducing a gray (gradation) which is neither a solid black nor a solid white will be described with reference to FIGS. 25(A), 25(B) and FIGS. 26(A), 26(B).

Figure 25A:
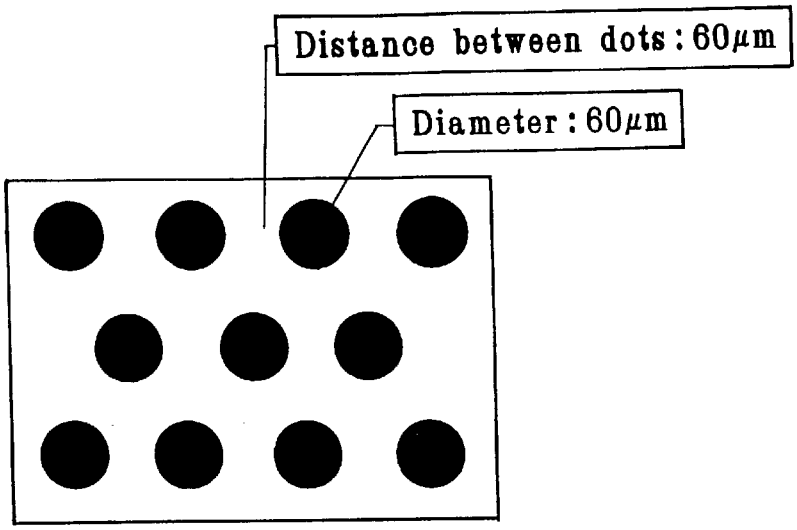
FIGS. 25(A), 25(B) are diagrams for explaining the condition in thickness of the charge injection layer for a dot gray-reproducing pattern.
Figure 25B:
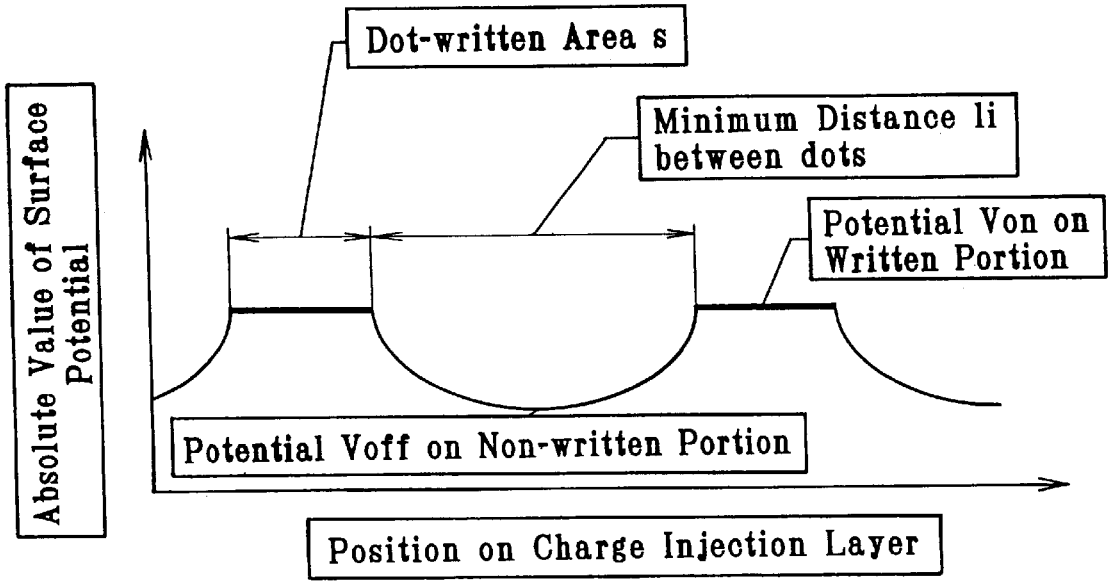

FIG. 25(A) shows an example of the dot gray-reproducing pattern which is composed, for example, of black dots of 60 μm in diameter and in interval. FIG. 25(B) shows absolute values of the surface potential corresponding to positions on the charge injection layer in the dot gray-reproducing pattern shown in FIG. 25(A).

The resistance $R_v$ of a dot zone of the charge injection layer 2*a* in the depth direction is represented by:

$$R_v=\rho d_1/(\pi(r_0/2)^2) \quad (7)$$

wherein $d_1$ is the thickness of the charge injection layer, ρ is the volume resistivity of the charge injection layer, $r_0$ is the diameter of each dot.

The capacity $C_v$ of the dot zone of the dielectric layer 2*b* in the depth direction is represented by:

$$C_v=\in(\pi(r_0/2)^2)/d_2 \quad (8)$$

wherein $d_2$ is the thickness of the dielectric layer and ∈ is the dielectric constant of the dielectric layer.

Figure 26A:
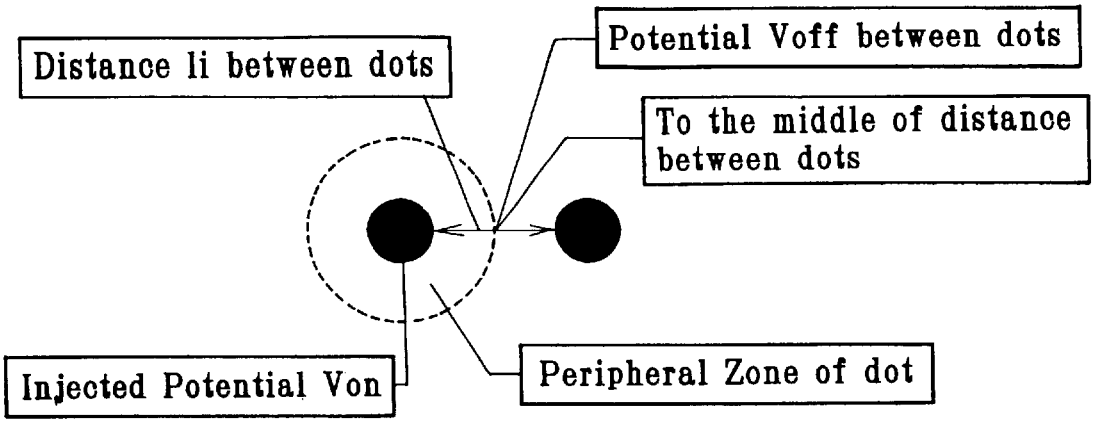
FIGS. 26(A), 26(B) are diagrams for explaining the condition in thickness of the charge injection layer for a dot gray-reproducing pattern.
Figure 26B:
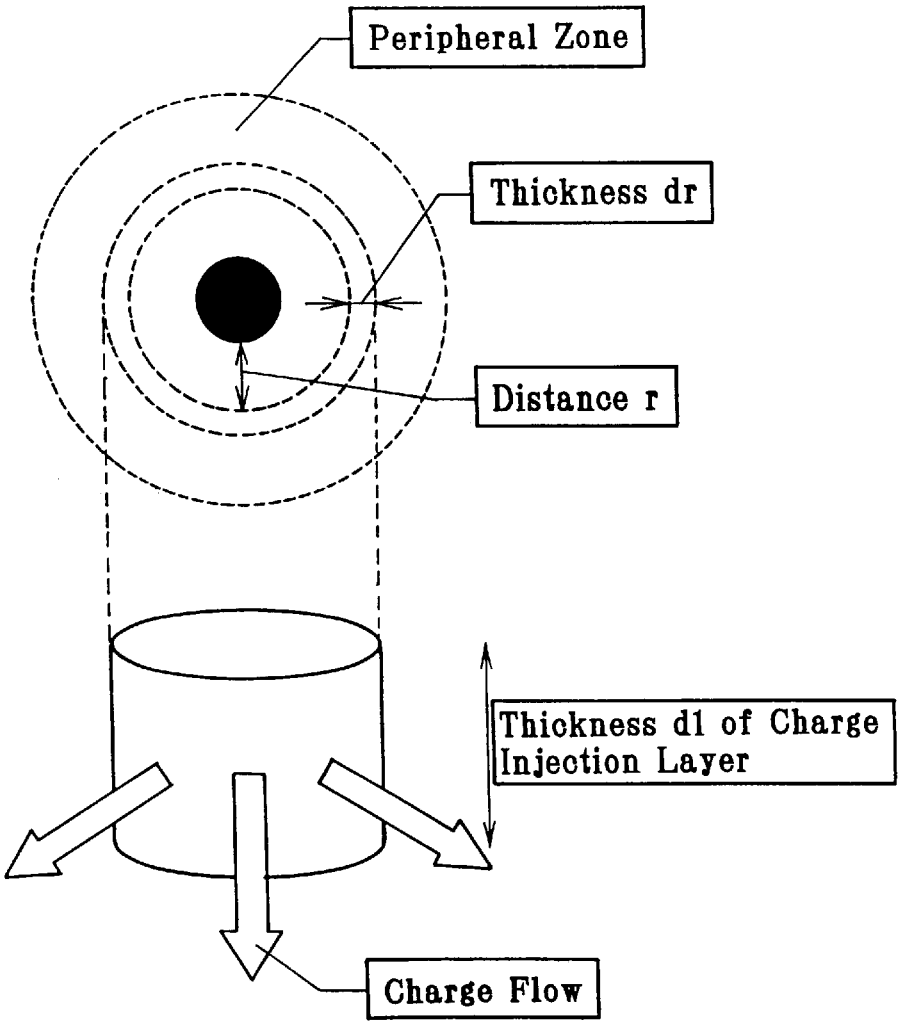

In FIG. 26(A), assuming that there is a circle of which radius is a distance between the center of one dot and the middle of a distance from the dot to an adjacent dot, the inside of the circle except the dot is referred to as the peripheral zone of the dot. In this state, the resistance in a direction of white arrow of a cylinder having a very small thickness dr as shown in FIG. 26(B) is represented by:

$$dR=\rho d\ r/(\pi(2r+r_0)d_1) \quad (9)$$

The resistance $R_h$ of the peripheral zone is represented by:

$$R_h=\int dR=2\rho/(\pi d_1)\times 1_n(1+l_1/r_0) \quad (10)$$

Values from r=0 to $l_1/2$ are integrated.

The capacity $C_h$ of the peripheral zone of each dot in the depth direction of the dielectric layer is represented by:

$$C_h=(\pi\in l_1^2/(4d_2))\times(1+2r_0/l_1) \quad (11)$$

Accordingly, the following is a conditional expression for potential difference:

$$1/(R_vC_v)-1/(R_hC_h)>|V_{on}-V_{off}|/(|V|\Delta t)$$

wherein V is electrode voltage, Δt is time taken for applying voltage, $V_{on}$ is injected potential, and $V_{off}$ is potential between dots. From the above equations (7), (8), (10), and (11), the following equation can be obtained:

$$i\ d_2/(\in 92\ d_1)\times(1-2d_1^2/(l_1^2(1+2r_0/l_1)1_n(1+l_1/r_0)))>|V_{on}-V_{off}|/(|V|\Delta t) \quad (12)$$

Figure 27A:
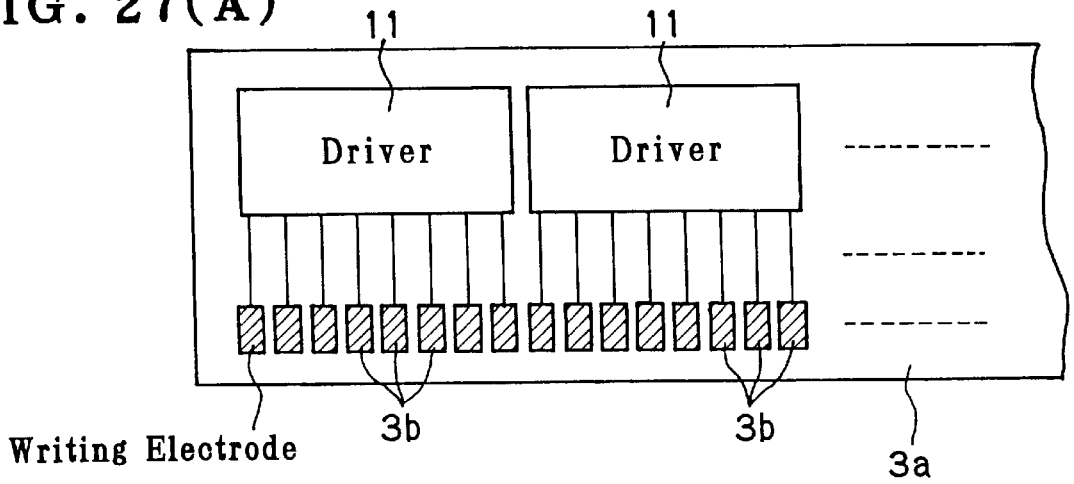
FIGS. 27(A)–27(C) show array patterns for arranging the writing electrodes of the writing device according to the present invention.
Figure 27B:
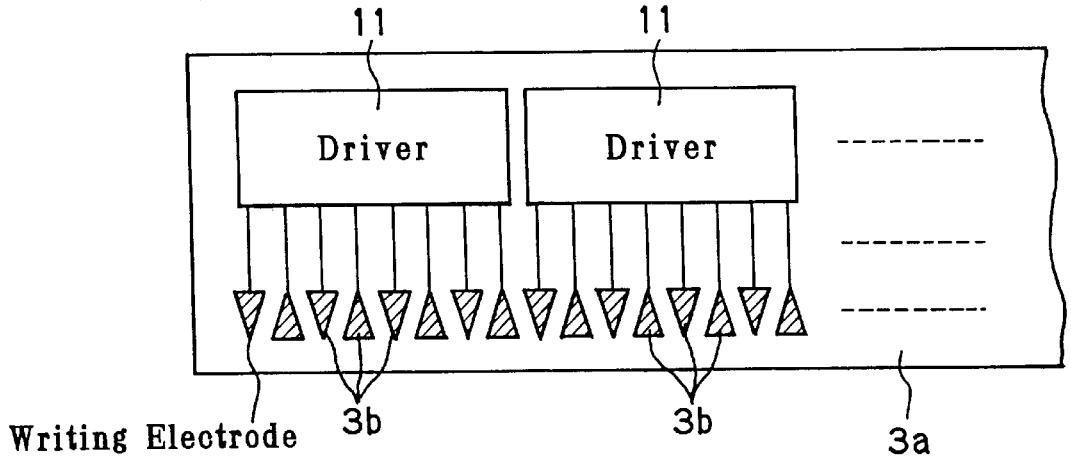
Figure 27C:
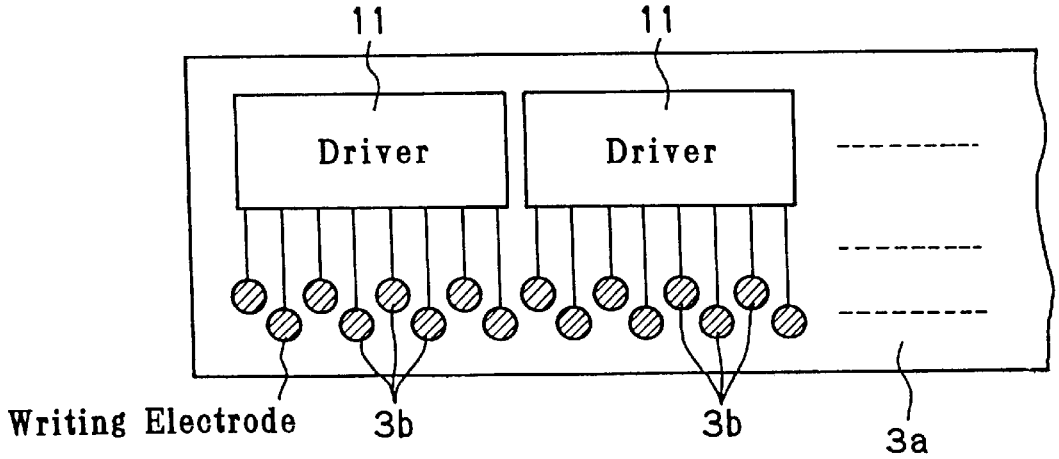

FIGS. 27(A)–27(C) show array patterns for arranging a plurality of writing electrodes 3*b* in the axial direction of the image carrier 2.

The simplest array pattern for the writing electrodes 3*b* is shown in FIG. 27(A). In this pattern, a plurality of rectangular writing electrodes 3*b* are aligned in one row extending in the axial direction of the image carrier 2 as shown in FIG. 27(A). In this case, among the writing electrodes 3*b*, a predetermined number (eight in the illustrated example) of writing electrodes 3*b* are connected to and thus united by a driver 11 which controls the corresponding electrodes 3*b* by switching the supply voltage between the predetermined voltage or the ground voltage. Plural units of writing electrodes 3*b* are aligned in the same row extending in the axial direction of the image carrier 2.

However, when the rectangular electrodes 3*b* are simply aligned in one row extending in the axial direction of the image carrier 2 just like this pattern, there should be clearances between adjacent electrodes 3*b*. Portions of the surface of the image carrier 2 corresponding to the clearances can not be subjected to the application or removal of charge. Therefore, in the array pattern for the writing electrodes 3*b* shown in FIG. 27(B), the writing electrodes 3*b* are each formed in triangle and are alternately arranged in such a manner that the orientations of the adjacent electrodes 3*b* are opposite to each other. In this case, the electrodes are arranged such that ends of the triangle bases of adjacent electrodes which are opposed to each other are overlapped with each other in a direction perpendicular to the axial direction of the image carrier 2 (the rotational direction of the image carrier). The design of partially overlapping adjacent electrodes in the direction perpendicular to the axial direction of the image carrier 2 can eliminate such portions that are not subjected to the application or removal of charge as mentioned above, thereby achieving application or removal of charge relative to the entire surface of the image carrier 2. It should be noted that, instead of triangle, each electrode 3*b* may be formed in any configuration that allows adjacent electrodes to be partially overlapped with each other in the direction perpendicular to the axial direction of the image carrier, for example, trapezoid, parallelogram, and a configuration having at least one angled side among sides opposed to adjacent electrodes 3*b*.

In the array pattern for the writing electrodes 3*b* shown in FIG. 27(C), the writing electrodes 3*b* are each formed in circle and are aligned in two parallel rows (first and second rows) extending in the axial direction of the image carrier 2 in such a manner that the writing electrodes 3*b* are arranged in a zigzag fashion. In this case, the electrodes are arranged such that electrodes which are in different rows but adjacent to each other are partially overlapped with each other in the direction perpendicular to the axial direction of the image carrier 2. Also this array pattern can eliminate such portions in the surface of the image carrier 2 that are not subjected to the application or removal of charge as mentioned above, thereby achieving application or removal of charge relative to the entire surface of the image carrier 2. In this example, plural units are each formed of a predetermined number of electrodes 3*b* some of which are in the first row and the other are in the second row by connecting these electrodes 3*b* to one driver 11 and are aligned parallel to the axial direction of the image carrier 2. The respective drivers 11 are disposed on the same side of the corresponding electrodes 3*b*.

Figure 28A:
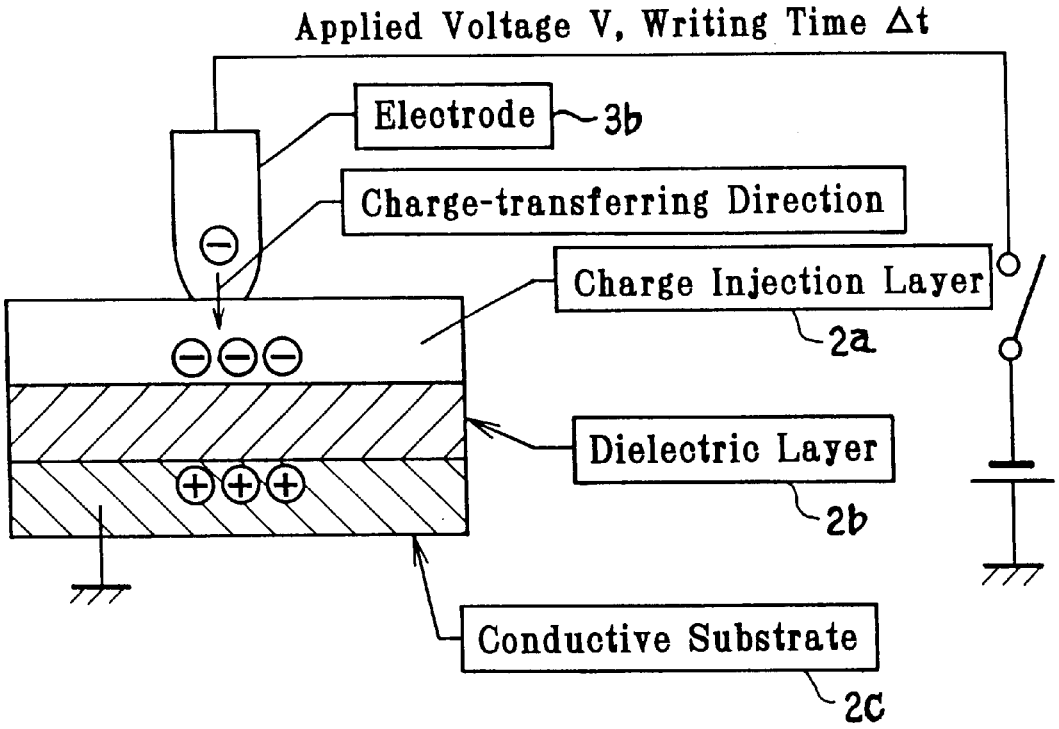

Now, other embodiments of the image forming apparatus of the present invention will be described. FIG. 28(A) is a schematic illustration showing the function of a charge injection layer 2*a* through application or removal of charge of the writing electrodes 3*b* of the writing device 3, and FIG. 28(B) is a graph showing the relation between the voltage applied to electrodes and the surface potential of the charge injection layer.

As shown in FIG. 28(A), as voltage V is applied to a writing electrode 3*b*, injection of negative (−) charge is conducted directly from a lower voltage side to a higher voltage side between the writing electrode 3*b* and the charge injection layer 2*a*. This means that charge is applied to or removed from the charge injection layer 2*a* via the charge injection. During this, as shown in FIG. 28(B), the surface potential of the charge injection layer 2*a* is proportional to the voltage V applied to the electrode 3*b* so that charge is injected in proportion to the applied voltage.

In the example shown in FIGS. 20(A), 20(B), after the voltage V applied to the writing electrode is increased and reaches to a discharge starting voltage $V_{th}$, charge is transferred from the periphery of the electrode through the gaps to the surface of the dielectric layer by discharge phenomenon, thereby achieving the transfer of charge to the dielectric layer. It should be understood that since the dielectric layer is insulative, charge injection does not take place relative to the dielectric layer even though the writing electrode is in contact therewith. If the voltage applied to the electrode is increased until charge is injected, the insulating property is broken, that is, the property of the dielectric layer is altered. Therefore, the writing method of electrostatic latent image by charge injection described with reference to FIGS. 28(*a*), 28(*b*) has an advantage of allowing the employment of a power source of low voltage.

Figure 28B:
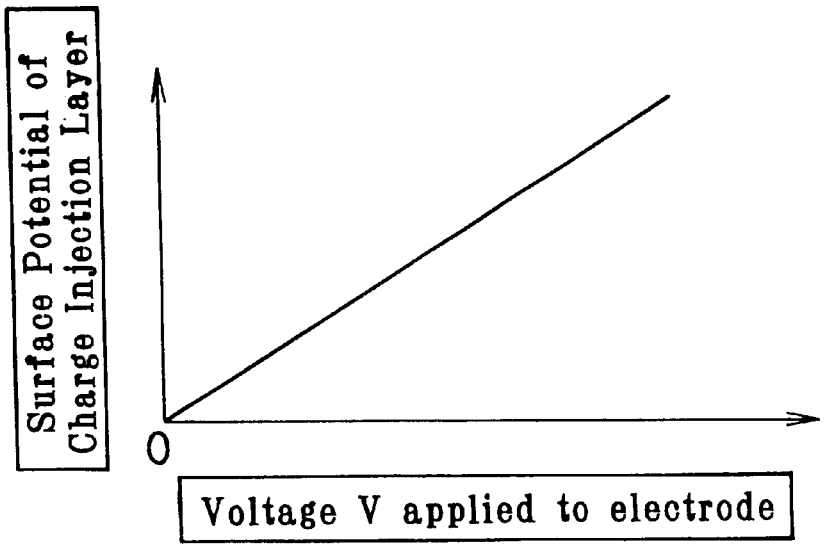
Figure 29:
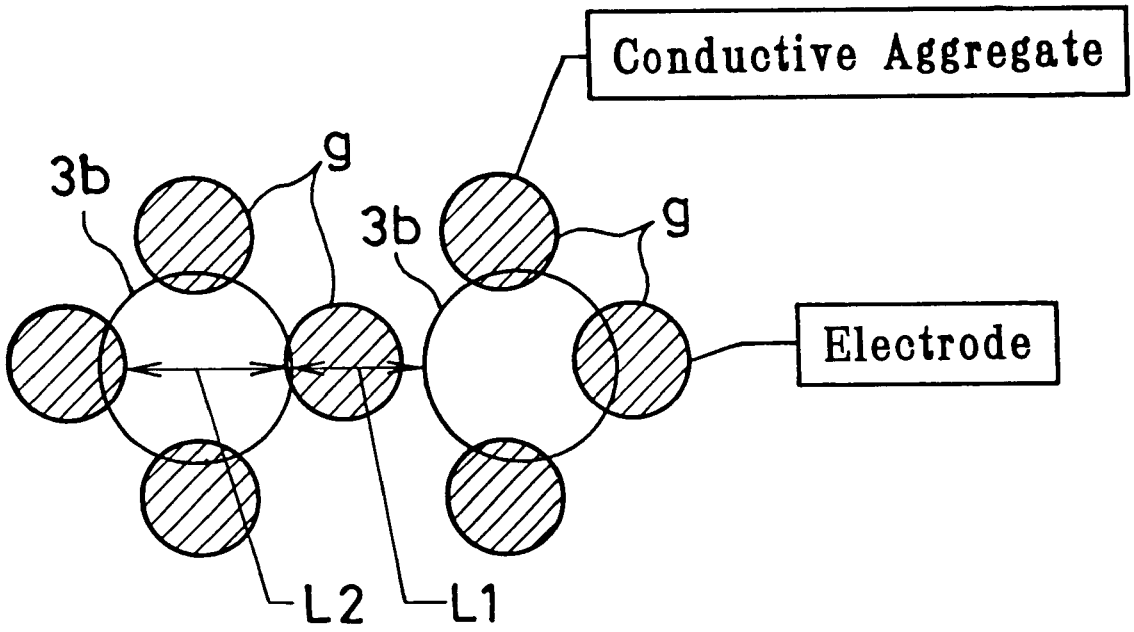
FIG. 29 is a schematic illustration for explaining a problem of the embodiment shown in FIGS. 28(A) and 28(B)

FIG. 29 is a schematic illustration for explaining a problem of the embodiment shown in FIGS. 28(A), 28(B). As described in the above, when an electrostatic latent image pattern of which resolution is 400 dpi is written by using the writing electrodes 3*b*, the writing electrodes 3*b* should be very small electrodes of 25.4 mm/400=63 μm in diameter. This means that the size of writing electrodes to be used should be smaller as the resolution is increased. Therefore, as shown in FIG. 29, there are problems that crosstalk (short between the electrodes 3*b*) may be occurred and that it may be impossible to write high resolution images if the size control of conductive aggregates g is not conducted. Therefore, the size of the conductive aggregates g is required to be smaller than the distance L1 between electrodes in order to prevent crosstalk and the distance L2 between adjacent conductive aggregates is required to be smaller than the width of each electrode in order to secure the injection of charge by ON/OFF of the electrodes.

EXAMPLE (1) Writing Head

The diameter of each electrode is 60 μm and the distance between adjacent electrodes is 60 μm.

(2) Charge Injection Layer 2*a*

Titanium dioxide $T_iO_2$ treated to have conductivity (available from Titan Kogyo K.K., Trade code: FC-300) and polyamide resin (available from Namariichi Chemical Industrial Co., Ltd., Trade code: FR-104) were mixed with each other using ethanol as a solvent. The mixing ratio by weight was (titanium dioxide/polyamide resin)=60%. The mixed liquid was agitated by a agitating rod (for 15 minutes), then coated on a dielectric layer 2*b*, and dried (in a vacuum dryer at 150° C. for 3 hours), thereby forming a charge injection layer 2*a*. The outer surface was observed. As a result of the observation, the average diameter of dispersed aggregates of $T_iO_2$ was 12 μm and the distance between adjacent aggregates was 15 μm.

(3) Dielectric layer 2*b* and Conductive Substrate 2*c*.

A dielectric layer of 200 μm in thickness was formed by polycarbonate resin on an aluminium tube.

(4) An image was formed by using the image carrier and the writing electrodes at a process speed 30 mm/sec. A dot pattern with dot diameter of 60 μm and interval of 60 μm was successfully formed.

COMPARATIVE EXAMPLE

This comparative example was the same as the above example, except that the agitating time was 1 minute during the formation of a charge injection layer in step (2). In this case, the average diameter of dispersed aggregates was 80 μm and the distance between adjacent aggregates was 100 μm. An image was formed by using the image carrier and the writing electrodes at a process speed 30 mm/sec. A dot pattern with dot diameter of 60 μm and interval of 60 μm was unsuccessfully formed with 44% blanks. As the formation of image was repeated, crosstalk was caused so that some electrodes were burned.

Hereinafter, description will now be made as regard to concrete examples of the image forming apparatus employing the writing device of the present invention of which the electrode portion 3*b* is arranged in contact with the image carrier 2 to write an electrostatic latent image onto the image carrier 2.

Figure 30B:
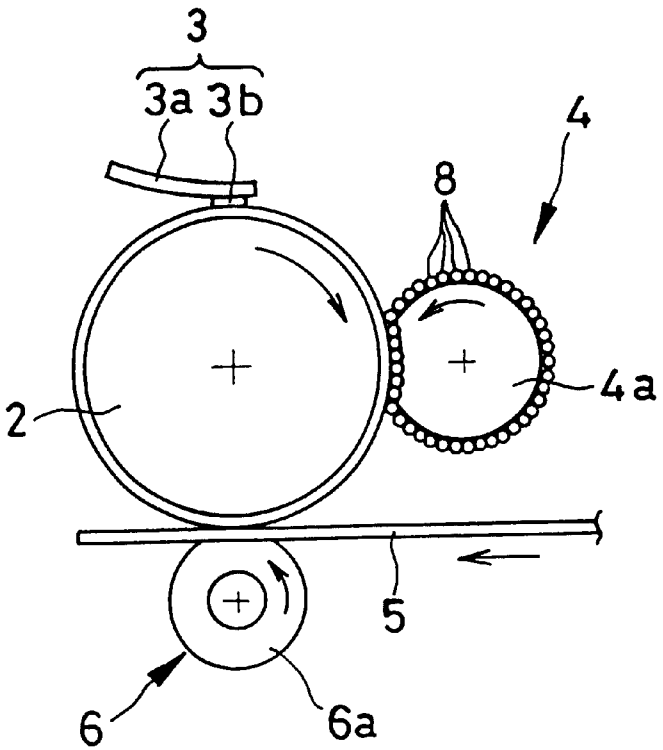
FIGS. 30(A)–30(B) are illustrations schematically showing another embodiment of the image forming apparatus employing the writing device of the present invention.
Figure 30A:
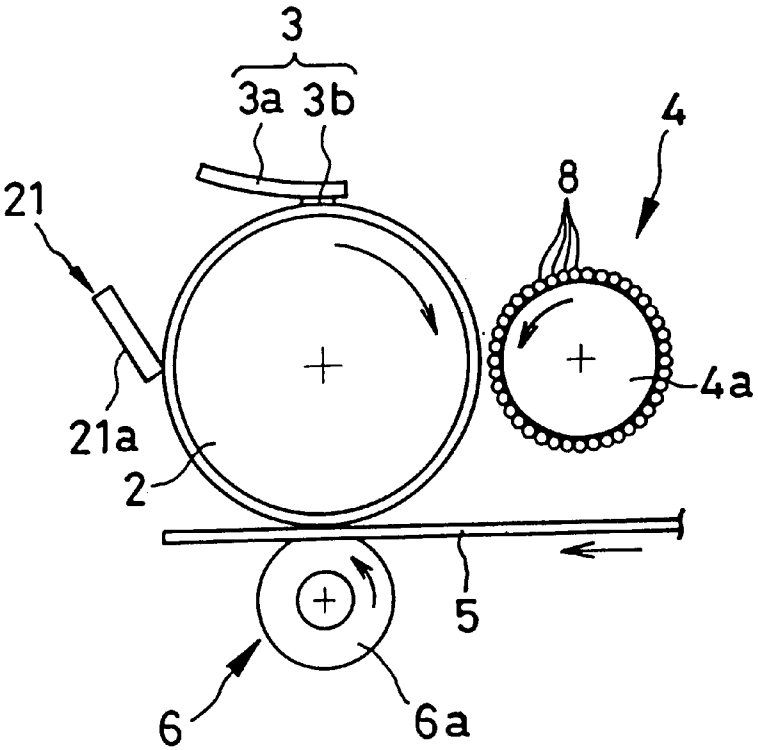

FIGS. 30(A) and 30(B) show examples of the image forming apparatus employing the writing electrodes of the present invention, wherein FIG. 30(A) is an illustration showing an image forming apparatus with a cleaner, and FIG. 30(B) is an illustration showing an image forming apparatus without a cleaner, that is, it is a cleaner-less image forming apparatus.

The image forming apparatus 1 shown in FIG. 30(A) is a monochrome image forming apparatus, a substrate 3*a* of a writing device 3 extends from the upstream toward the downstream in the rotational direction of an image carrier 2, and writing electrodes 3*b* are fixed to the end of the substrate 3*a*. A cleaning device 21 is arranged at a downstream side than a transferring device 6 in the rotational direction of the image carrier 2. A charge control device 7 may be arranged between the writing device 3 and the cleaning device 21, but not illustrated. In case of no charge control device 7, a new latent image is substituted on the former latent image, but the number of parts and the apparatus size can be reduced because of the elimination of the charge control device 7.

In the monochrome image forming apparatus 1 having the aforementioned structure, after the surface of the image carrier 2 is made into the uniformly charged state by the charge control device 7, the writing electrodes 3*b* of the writing device 3 write an electrostatic latent image by applying charge to or removing charge from the surface of the image carrier 2. The latent image on the image carrier 2 is subsequently developed with developing powder by the developing roller 4*a* of the developing device 4, which is spaced apart from the image carrier 2, to form a developing powder image. Then, the developing powder image on the image carrier 2 is transferred to a receiving medium 5 by the transferring device 6. Residual developing powder on the image carrier 2 after the transfer is removed by a cleaning blade 21*a* of the cleaning device 21 and cleaned surface of the image carrier 2 is uniformly charged by the charge control device 7 again. The image forming apparatus 1 can be manufactured to have a smaller size and simple structure because it employs the writing device 3 of the present invention.

The image forming apparatus 1 shown in FIG. 30(B) is similar to the image forming apparatus 1 shown in FIG. 30(A), but without the cleaning device 21, that is, it is a cleaner-less image forming apparatus. In the image forming apparatus 1 of this example, the developing roller 4*a* of the developing device 4 is in contact with the image carrier 2 so as to conduct contact developing.

In the image forming apparatus 1 having the aforementioned structure, the surface of the image carrier 2 is made into the uniformly charged state by the charge control device 7, not shown, together with residual developing powder on the image carrier after the former transfer. Then, the writing electrodes 3*b* of the writing device 3 write an electrostatic latent image on the surface of the image carrier 2 and on the residual developing powder by applying charge to or removing charge from the surface of the image carrier 2 and the surface of the residual developing powder. By the developing device 4, the latent image is developed. During this, by selectively charging the writing electrodes 3*b* to have the same polarity as the original polarity of the developing powder 8, residual developing powder on non-image portions of the image carrier 2 is charged into the polarity by the writing electrodes 3*b* so as to move toward the developing device 4, while residual developing powder on image portions of the image carrier 2 still remains on the image carrier 2 as developing powder for subsequent developing. By transferring the residual developing powder on the non-image portions toward the developing device 4 as mentioned above, the surface of the image carrier 2 can be cleaned even without the cleaning device 21. In particular, a brush may be arranged at a downstream side than the transferring device 6 in the rotational direction of the image carrier 2, but not illustrated. In this case, the residual developing powder can be scattered to be uniformly distributed on the image carrier 2 by this brush, thus further effectively transferring the residual developing powder on the non-image portions to the developing device 4.

The other actions for forming an image of the image forming apparatus 1 of this example are the same as those of the image forming apparatus 1 shown in FIG. 30(A). Employment of the writing device 3 of the present invention achieves reduction in size and simplification of the structure of the image forming apparatus 1. Particularly, since it is a cleaner-less image forming apparatus without the cleaning device 21, further simple structure can be achieved.

Figure 31:
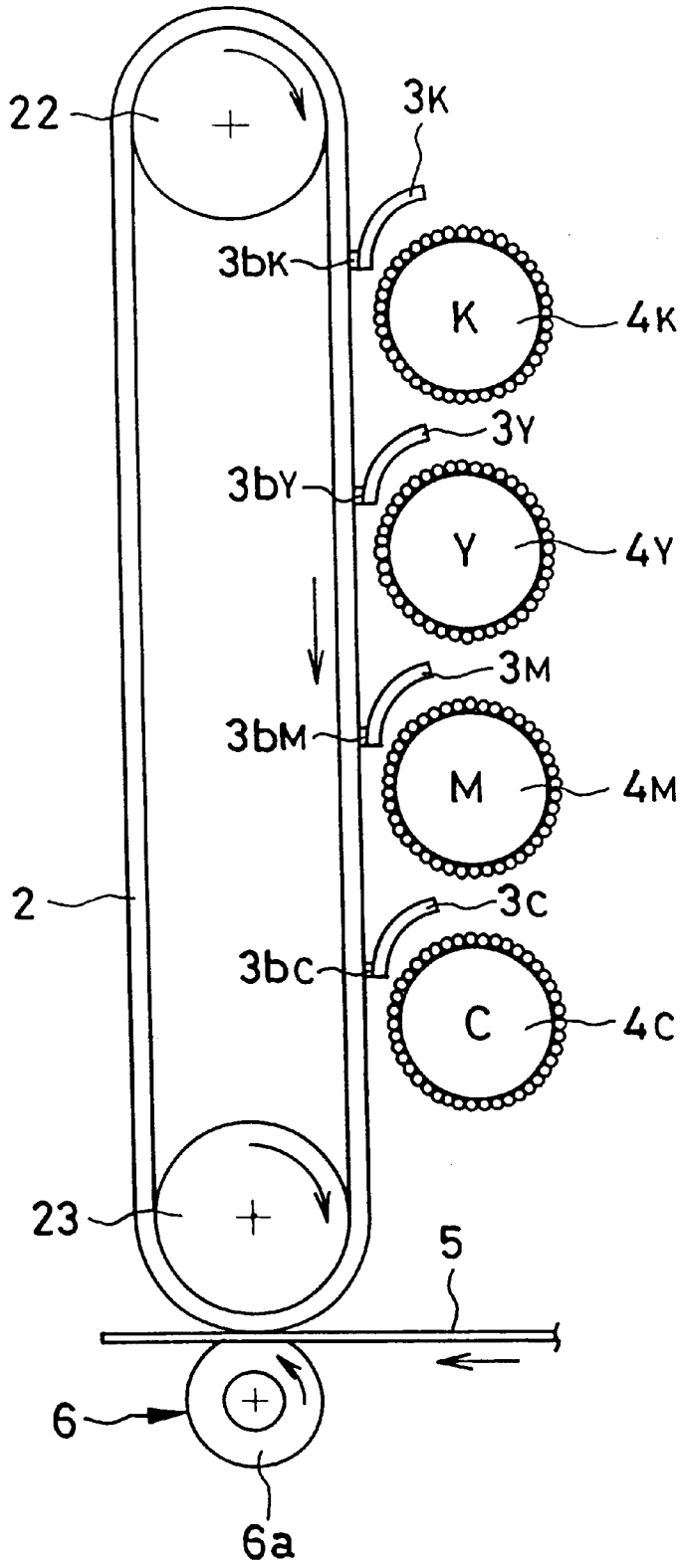
FIG. 31 is an illustration schematically showing another embodiment of the image forming apparatus employing the writing device of the present invention.

FIG. 31 is an illustration schematically showing another example of the image forming apparatus employing the writing device according to the present invention. The image forming apparatus 1 of this example is an image forming apparatus for developing full color image by superposing developing powder images in four colors of black K, yellow Y, magenta M, and cyan C on an image carrier 2 where in the image carrier is in an endless belt-like form. This endless belt-like image carrier 2 is tightly held by two rollers 22, 23 and is rotatable in the clockwise direction in FIG. 31 by a driven roller, i.e. one of the rollers 22, 23.

Writing devices $\mathbf{3}_K$, $\mathbf{3}_Y$, $\mathbf{3}_M$, $\mathbf{3}_C$ and developing devices $\mathbf{4}_K$, $\mathbf{4}_Y$, $\mathbf{4}_M$, $\mathbf{4}_C$ for the respective colors are arranged along a straight portion of the endless belt of the image carrier 2, in the order of colors K, Y, M, C from the upstream of the rotational direction of the image carrier 2. It should be understood that the developing devices $\mathbf{4}_K$, $\mathbf{4}_Y$, $\mathbf{4}_M$, $\mathbf{4}_C$ may be arranged in any order other than the illustrated one. All of the respective writing electrodes $\mathbf{3}b_K$, $\mathbf{3}b_Y$, $\mathbf{3}b_M$, $\mathbf{3}b_C$ of the writing devices $\mathbf{3}_K$, $\mathbf{3}_Y$, $\mathbf{3}_M$, $\mathbf{3}_C$ are formed on flexible substrates $\mathbf{3}a_K$, $\mathbf{3}a_Y$, $\mathbf{3}a_M$, $\mathbf{3}a_C$ as mentioned above. Also in the image forming apparatus of this example, a charge control device as mentioned above is disposed adjacent to a straight portion of the endless belt of the image carrier 2, at a side opposite to the side where the writing devices $\mathbf{3}_K$, $\mathbf{3}_Y$, $\mathbf{3}_M$, $\mathbf{3}_C$ are arranged, but not illustrated.

In the image forming apparatus 1 of this example having the aforementioned structure, first an electrostatic latent image for black K is written on the surface of the image carrier 2 by electrodes ${}^{3}b_K$ of the writing device $\mathbf{3}_K$ for black K. The electrostatic latent image for black K is then developed by the developing device $\mathbf{4}_K$ so as to form a black developing powder image on the surface of the image carrier 2. An electrostatic latent image for yellow Y is subsequently written on the surface of the image carrier 2 and on the black developing powder image, already formed, by the electrodes $\mathbf{3}b_Y$ of the writing device $\mathbf{3}_Y$ for yellow Y such that the electrostatic latent image for yellow Y is partly superposed on the black developing powder image. The electrostatic latent image for yellow Y is then developed by the developing device $\mathbf{4}_Y$ so as to form a yellow developing powder image on the surface of the image carrier 2. In the same manner, an electrostatic latent image for magenta M is subsequently written on the surface of the image carrier 2 and on the black and yellow developing powder images, already formed, by the electrodes $\mathbf{3}b_M$ of the writing device $\mathbf{3}_M$ for magenta M such that the electrostatic latent image for magenta M is partly superposed on the black and yellow developing powder images. The electrostatic latent image for magenta M is then developed by the developing device $\mathbf{3}_M$ so as to form a magenta developing powder image on the black and yellow developing powder images and the surface of the image carrier 2. Moreover, an electrostatic latent image for cyan C is subsequently written on the surface of the image carrier 2 and on the black, yellow and magenta developing powder images, already formed, by the electrodes $\mathbf{3}b_C$ of the writing device $\mathbf{3}_C$ for cyan C such that the electrostatic latent image for cyan C is partly superposed on the black, yellow and magenta developing powder images.

The electrostatic latent image for cyan C is then developed by the developing device $4_C$ so as to form a cyan developing powder image on the black, yellow and magenta developing powder images and the surface of the image carrier 2. These developing powder images are toned. Then, these developing powder images are transferred to the receiving medium 5 by the transferring device 6 to form a multicolored developing powder image on the receiving medium 5. It should be understood that the developing powder of colors may be deposited in any order other than the aforementioned order.

Accordingly, employment of the writing devices 3 of the present invention still achieves reduction in size and simplification of the structure of such a color image forming apparatus for forming a multicolored developing powder image by superposing and toning the developing powder images for the respective colors on an image carrier 2.

Figure 32:
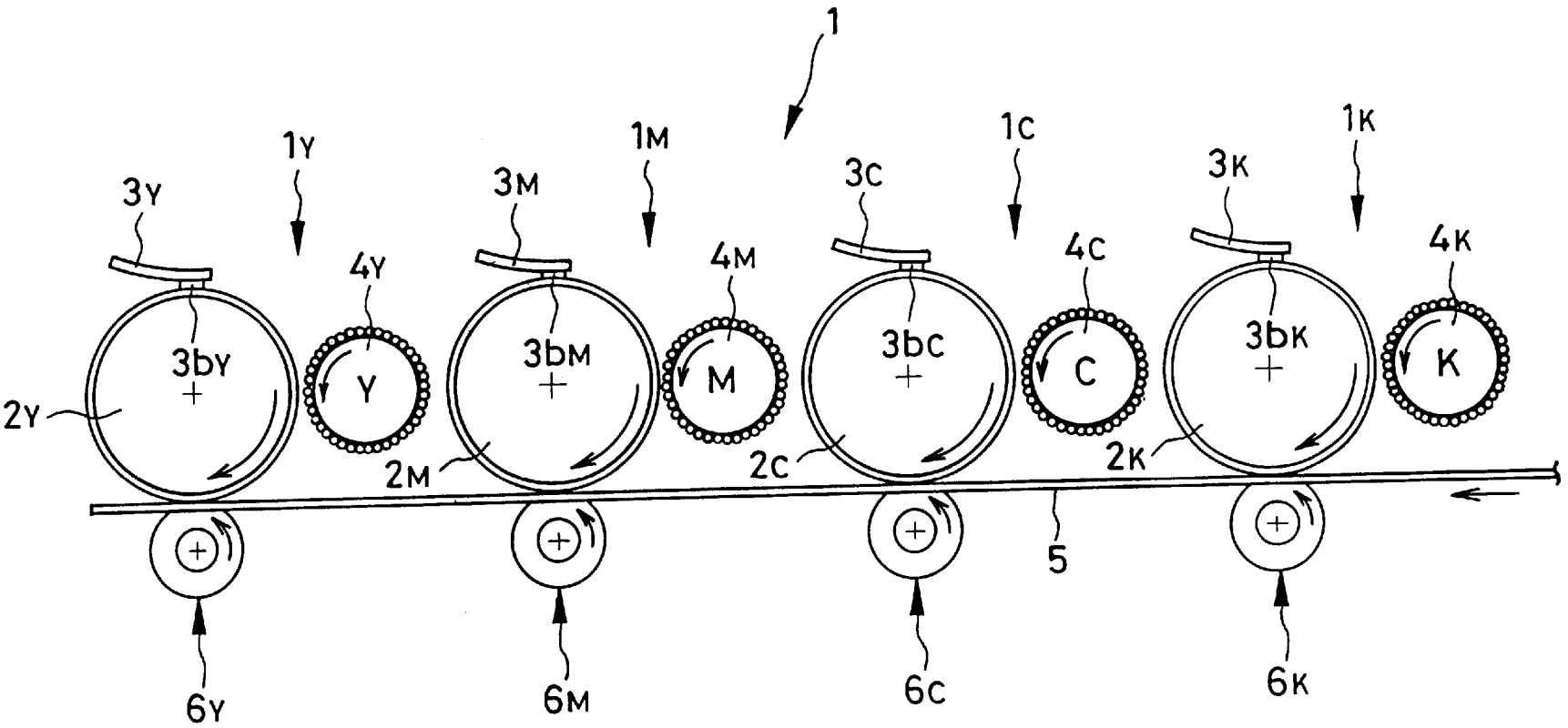
FIG. 32 is an illustration schematically showing another embodiment of the image forming apparatus employing the writing device of the present invention.

FIG. 32 is a view schematically showing still another example of the image forming apparatus employing the writing device according to the present invention. The image forming apparatus 1 of this example comprises image forming units $1_K$, $1_C$, $1_M$, $1_Y$ for the respective colors which are arranged in tandem in this order from the upstream in the feeding direction of a receiving medium 5. It should be understood that the image forming units $1_K$, $1_C$, $1_M$, $1_Y$ may be arranged in any order. The image forming units $1_K$, $1_C$, $1_M$, $1_Y$ comprise image carriers $2_K$, $2_C$, $2_M$, $2_Y$, writing devices $3_K$, $3_C$, $3_M$, $3_Y$, developing devices $4_K$, $4_C$, $4_M$, $4_Y$, and transferring devices $6_K$, $6_C$, $6_M$, $6_Y$, respectively. In the image forming units $1_K$, $1_C$, $1_M$, $1_Y$ of this example, but not shown, charge control devices 7 as mentioned above may be disposed on the upstream sides of the writing devices $3_K$, $3_C$, $3_M$, $3_Y$ in the rotational direction of the image carriers $2_K$, $2_C$, $2_M$, $2_Y$, respectively.

The actions of the image forming apparatus 1 of this example having the aforementioned structure will now be described. First in the image forming unit $1_K$ for black K, after the surface of the image carrier $2_K$ is uniformly charged by the charge control device 7 for black K, an electrostatic latent image for black K is written on the surface of the image carrier $2_K$ by the electrodes $3b_K$ of the writing device $3_K$. The electrostatic latent image for black K is then developed by the developing device $4_K$ SO as to form a black developing powder image on the surface of the image carrier $2_K$ The black developing powder image on the image carrier $2_K$ is transferred to the receiving medium 5 by the transferring device $6_K$ supplied so as to form a black developing powder image on the receiving medium 5. Subsequently, in the image forming unit $1_C$ for cyan C, after the surface of the image carrier $2_C$ is uniformly charged by the charge control device 7 for cyan C, an electrostatic latent image for cyan C is written on the surface of the image carrier $2_C$ by the electrodes $3b_C$ of the writing device $3_C$. The electrostatic latent image for cyan C is then developed by the developing device $4_C$ so as to form a cyan developing powder image on the surface of the image carrier $2_C$. The cyan developing powder image on the image carrier $2_C$ is transferred to the receiving medium 5 by the transferring device $6_C$, supplied and already having the black developing powder image thereon, such that the cyan developing powder image is formed to be partly superposed on the black developing powder image on the receiving medium 5. In the same manner, in the image forming unit $1_M$ for magenta M, an electrostatic latent image for magenta M is written on the surface of the image carrier $2_M$ by the electrodes $3b_M$ of the writing device $3_M$ and then developed by the developing device $4_M$ to form a magenta developing powder image, and the magenta developing powder image is transferred to the receiving medium 5 by the transferring device 6 M such that the magenta developing powder image is formed and partly superposed on the developing powder images already formed on the receiving medium 5. After that, in the image forming unit $1_Y$ for yellow Y, an electrostatic latent image for yellow Y is written on the surface of the image carrier $2_Y$ by the electrodes $3b_Y$ of the writing device $3_Y$ and then developed by the developing device $4_Y$ to form a yellow developing powder image on the image carrier $2_Y$, and the yellow developing powder image is transferred to the receiving medium 5 by the transferring device $6_Y$, thereby superposing the developing powder images for the respective colors to produce a toned multicolored developing powder image on the receiving medium 5.

Accordingly, employment of the writing devices 3 of the present invention still achieves reduction in size and simplification of the structure of such a color image forming apparatus comprising image forming units $1_K$, $1_C$, $1_M$, $1_Y$ for the respective colors arranged in tandem.

Figure 33:
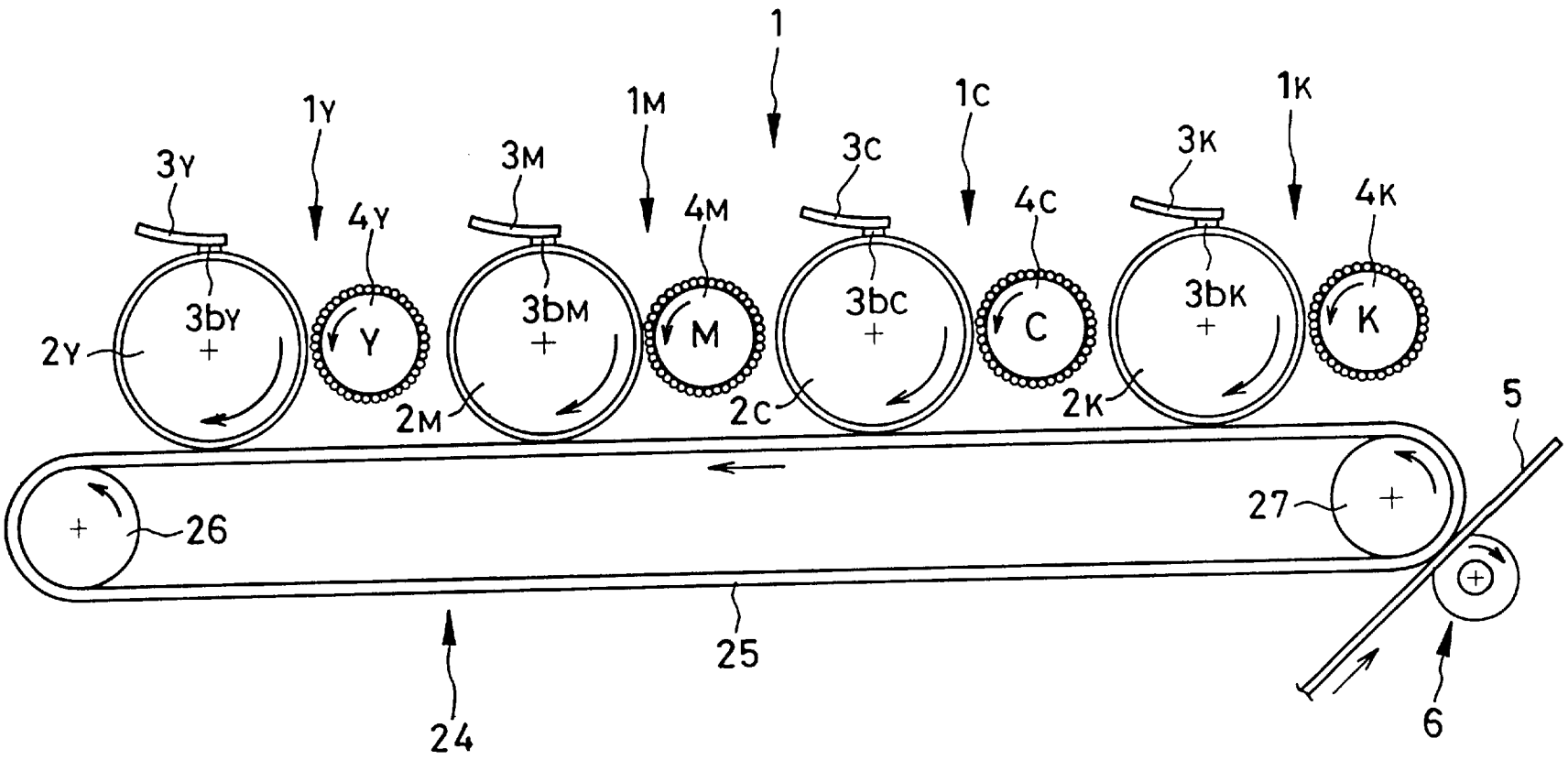
FIG. 33 is an illustration schematically showing another embodiment of the image forming apparatus employing the writing device of the present invention.

FIG. 33 is a view schematically showing further another example of the image forming apparatus employing the writing device according to the present invention. In the image forming apparatus 1 of the example shown in FIG. 32 comprising the image forming units $1_K$, $1_C$, $1_M$, $1_Y$ for the respective colors which are arranged in tandem, respective color developing powder images formed on the image carriers $2_K$, $2_C$, $2_M$, $2_Y$ of the image forming units $1_K$, $1_C$, $1_M$, $1_Y$ are transferred to the receiving medium 5 at every unit $1_K$, $1_C$, $1_M$, $1_Y$. In the image forming apparatus 1 of this example, however, the respective color developing powder images are temporally transferred to another medium before transferred to the receiving medium 5 as shown in FIG. 33. That is, the image forming apparatus 1 of this example is different from the image forming apparatus 1 of the example shown in FIG. 32 by including an intermediate transferring device 24. The intermediate transferring device 24 comprises an intermediate transferring member 25 taking the form as an endless belt. This intermediate transferring member 25 is tightly held by two rollers 26, 27 and is rotated in the counter-clockwise direction in FIG. 33 by the drive of one of the rollers 26, 27.

Image forming units $1_K$, $1_C$, $1_M$, $1_Y$ are arranged along a straight portion of the intermediate transferring member 25. Further, the image forming apparatus 1 has a transferring device 6 disposed adjacent to the roller 27. The other structures of the image forming apparatus 1 of this example are the same as those of the image forming apparatus 1 of the example shown in FIG. 32.

In the image forming apparatus 1 of this example having the aforementioned structure, developing powder images for the respective colors are formed on the image carriers $2_K$, $2_C$, $2_M$, $2_Y$ in the same manner as the image forming apparatus 1 of the example shown in FIG. 32, and the developing powder images for the respective colors are transferred to the intermediate transferring member 25 to be superposed and toned on each other in the same manner as the case of transferring developing powder images to the receiving medium 5 as shown in FIG. 32. The developing powder images for the respective colors temporally transferred to the intermediate transferring member 25 are transferred to the receiving medium 5 by the transferring device 6 so as to form a multicolored developing powder image on the receiving medium 5. The other actions of the image forming apparatus 1 of this example are the same as those of the image forming apparatus 1 of the example shown in FIG. 32.

Accordingly, employment of the writing devices 3 of the present invention still achieves reduction in size and simplification of the structure of such a color image forming apparatus comprising an intermediate transferring device 24 and image forming unit $\mathbf{1}_K$, $\mathbf{1}_C$, $\mathbf{1}_M$, $\mathbf{1}_Y$ for the respective colors arranged in tandem.

What we claim is:

1. An image forming apparatus comprising at least: an image carrier on which an electrostatic latent image is formed and a writing device for writing said electrostatic latent image on said image carrier, wherein said electrostatic latent image is written on said image carrier by said writing device, wherein said writing device has writing electrodes for writing said electrostatic latent image on said image carrier, said image carrier comprising a dielectric layer that has a charge injection layer formed on the outer surface, the electric resistance of said charge injection layer is anisotropic in such a manner as to satisfy "resistance in a direction perpendicular to the plane direction of said charge injection layer (i.e. in vertical direction) <resistance in the plane direction of said charge injection layer (i.e. in lateral direction)", said writing electrodes are in contact with said charge injection layer, whereby said electrostatic latent image is written dominantly by charge injection between said writing electrodes and said charge injection layer.

2. An image forming apparatus as claimed in claim 1, wherein the thickness of said charge injection layer is set to be 1 $\mu$m or less.

3. An image forming apparatus as claimed in claim 1 or 2, wherein said charge injection layer is provided with a large number of charge injection portions to which charge injection is conducted by said writing electrodes, and said charge injection portions are arranged to be dispersed separately from each other.

4. An image forming apparatus as claimed in claim 3, wherein said charge injection layer has a large number of concavities which are formed to be dispersed separately from each other, and said charge injection portions are formed in said large number of concavities.

5. An image forming apparatus as claimed in claim 3, wherein the area of a surface of said each charge injection portion to be in contact with said writing electrode is set to be smaller than the contact area of said each writing electrode relative to said charge injection layer.

6. An image forming apparatus as claimed in claim 3, wherein said writing electrodes are arranged in contact with said image carrier at constant positions relative to the axial direction of said image carrier.

7. An image forming apparatus as claimed in claim 1, wherein the average sectional area of toner particles for developing an electrostatic latent image written on said image carrier is set to be smaller than the contact area of said each writing electrode relative to said charge injection layer.

8. An image forming apparatus as claimed in claim 1, wherein said charge injection layer includes conductive particles and the contact area of said each writing electrode relative to said charge injection layer is set to be larger than the sectional area of said each conductive particle.

9. An image forming apparatus as claimed in claim 1, wherein said charge injection layer includes conductive particles, the contact area of said each writing electrode relative to said charge injection layer is set to be smaller than the sectional area of said each conductive particle, and the maximum dimension of the section of said each conductive particle is set to be smaller than the distance between adjacent writing electrodes.

10. An image forming apparatus comprising at least: an image carrier on which an electrostatic latent image is formed and a writing device for writing said electrostatic latent image on said image carrier, wherein said electrostatic latent image is written on said image carrier by said writing device, wherein said writing device has writing electrodes for writing said electrostatic latent image on said image carrier and a flexible substrate for supporting said writing electrodes, said image carrier has a conductive substrate to which a low voltage, based on the absolute value, is supplied, and said image carrier is provided with a multi-layer structure composed of a dielectric layer formed on said conductive substrate and a low-resistance layer, i.e. a charge injection layer, formed on said dielectric layer, said writing electrodes are in contact with said charge injection layer, whereby said electrostatic latent image is written dominantly by charge injection between said writing electrodes and said charge injection layer.

11. An image forming apparatus as claimed in claim 10, wherein the surface resistance of said charge injection layer is set to satisfy "electric resistance in the vertical direction<electric resistance in the lateral direction".

12. An image forming apparatus as claimed in claim 10 or 11, wherein the thickness of said charge injection layer is set to be 1 $\mu$m or less.

13. An image forming apparatus as claimed in claim 10, wherein said charge injection layer is formed in an islands-in-sea structure in which a large number of charge injection portions are formed in the outer surface of said dielectric layer and are dispersed separately from each other.

14. An image forming apparatus which forms an electrostatic latent image on an image carrier by using a writing device comprising a plurality of writing electrodes which are arranged in contact with said image carrier along a direction parallel to the axial direction of said image carrier, wherein said image carrier comprises a dielectric layer formed on a conductive substrate and a charge injection layer formed on said dielectric layer, and is set to satisfy $$d_1^2 < \text{unit area of electrode}$$

wherein $d_1$ is the thickness of said charge injection layer.

15. An image forming apparatus which forms an electrostatic latent image on an image carrier by using a writing device comprising a plurality of writing electrodes which are arranged in contact with said image carrier along a direction parallel to the axial direction of said image carrier, wherein said image carrier comprises a dielectric layer formed on a conductive substrate and a charge injection layer formed on said dielectric layer, and is set to satisfy the following relation:

$$d_1^2 < \rho_s/\rho_v$$

wherein $d_1$ is the thickness of said charge injection layer, $\rho_v$ is the volume resistivity in the depth direction of said charge injection layer, and $\rho_s$ is the volume resistivity in the surface direction of said charge injection layer.

16. An image forming apparatus as claimed in claim 15, wherein $\rho_s > \rho_v$ is satisfied.

17. An image forming apparatus which forms an electrostatic latent image on an image carrier by using a writing device comprising a plurality of writing electrodes which are arranged in contact with said image carrier along a direction parallel to the axial direction of said image carrier, wherein said image carrier comprises a dielectric layer formed on a conductive substrate and a charge injection layer formed on said dielectric layer, and is set to satisfy the following relation in case of reproducing gradation by using a stripe gray-reproducing pattern:

$$(d_2/(\rho d_1 \in))(1-4d_1^2/l_1^2)>|V_{on}-V_{off}|/(|V|\Delta t)$$

wherein V is voltage applied to the electrodes, $V_{on}$ is injected potential, $V_{off}$ is potential between lines, $d^1$ is thickness of said charge injection layer, $d_2$ is the thickness of said dielectric layer, ρ is the volume resistivity of said charge injection layer, ∈ is the dielectric constant of said dielectric layer, and Δt is the writing time.

18. An image forming apparatus which forms an electrostatic latent image on an image carrier by using a writing device comprising a plurality of writing electrodes which are arranged in contact with said image carrier along a direction parallel to the axial direction of said image carrier, wherein said image carrier comprises a dielectric layer formed on a conductive substrate and a charge injection layer formed on said dielectric layer, and is set to satisfy the following relation in case of reproducing gradation by using a dot gray-reproducing pattern:

$$d_2/(\in\rho d_1)\times(1-2\ d_1^2/(l_1^2(1+2\ r_0/l_1)1_n(1+l_1/r_0)))>|V_{on}-V_{off}|/(|V|\Delta t)$$

wherein V is voltage applied to the electrodes, $V_{on}$ is injected potential, $V_{off}$ is potential between dots, $d^1$ is thickness of said charge injection layer, $d_2$ is the thickness of said dielectric layer, ρ is the volume resistivity of said charge injection layer, ∈ is the dielectric constant of said dielectric layer, Δt is the writing time, and 11 is the distance between dots.

19. An image forming apparatus which forms an electrostatic latent image on an image carrier by using a writing device comprising a plurality of writing electrodes which are arranged in contact with said image carrier along a direction parallel to the axial direction of said image carrier, wherein said image carrier comprises a dielectric layer formed on a conductive substrate and a charge injection layer formed on said dielectric layer, and said charge injection layer is made of a binder and conductive aggregate dispersed in the binder, wherein said each conductive aggregate is set to be smaller than the distance between electrodes and the distance between conductive aggregates is set to be smaller than the width of each electrode.

20. An image forming apparatus as claimed in claim 19, wherein said charge injection layer is made by mixing titanium dioxide treated to have conductivity and polyamide resin by using ethanol as a solvent.

* * * * *